US010155302B2

(12) United States Patent
Kato et al.

(10) Patent No.: US 10,155,302 B2
(45) Date of Patent: Dec. 18, 2018

(54) STAPLER

(71) Applicant: MAX CO., LTD., Tokyo (JP)

(72) Inventors: Yutaka Kato, Tokyo (JP); Suguru Miwa, Tokyo (JP)

(73) Assignee: MAX CO., LTD., Tokyo (JP)

( * ) Notice: Subject to any disclaimer, the term of this patent is extended or adjusted under 35 U.S.C. 154(b) by 15 days.

(21) Appl. No.: 15/462,315

(22) Filed: Mar. 17, 2017

(65) Prior Publication Data

US 2017/0190038 A1 Jul. 6, 2017

Related U.S. Application Data

(63) Continuation of application No. 14/102,842, filed on Dec. 11, 2013, now Pat. No. 9,643,307.

(30) Foreign Application Priority Data

Dec. 12, 2012 (JP) ..... 2012-271444

(51) Int. Cl.

| | |
|---|---|
| ***B27F 7/19*** | (2006.01) |
| ***B25C 5/02*** | (2006.01) |
| ***B25C 5/11*** | (2006.01) |

(52) U.S. Cl.

CPC ..... *B25C 5/0257* (2013.01); *B25C 5/0207* (2013.01); *B25C 5/0214* (2013.01); *B25C 5/0264* (2013.01); *B25C 5/11* (2013.01); *B27F 7/19* (2013.01); *B25C 5/0271* (2013.01)

(58) Field of Classification Search

CPC ..... B25C 5/02; B25C 5/0207; B25C 5/0264; B25C 5/0271; B25C 5/0242; B25C 5/085; B25C 5/11; B25C 5/16; B27F 7/19; B27F 7/21; B27F 7/32; B27F 7/38; B25B 31/005

USPC ..... 227/132, 134, 120, 154, 155, 76, 131, 227/152, 67, 71

See application file for complete search history.

(56) References Cited

U.S. PATENT DOCUMENTS

| | | | |
|---|---|---|---|
| 1,430,048 | A | 9/1922 | Allen |
| 2,933,733 | A | 4/1960 | Strollis |
| 3,291,359 | A | 12/1966 | Butterworth et al. |

(Continued)

FOREIGN PATENT DOCUMENTS

| | | |
|---|---|---|
| CN | 1852791 A | 10/2006 |
| EP | A1-2050543 | 4/2009 |

(Continued)

OTHER PUBLICATIONS

Extended European Search Report dated Jun. 27, 2017 in corresponding European patent application 17000347.9 (7 pages).

(Continued)

*Primary Examiner* — Scott A. Smith

(74) *Attorney, Agent, or Firm* — Drinker Biddle & Reath LLP

(57) ABSTRACT

A stapler includes a penetrating part including a pair of cutting blades to form holes in a workpiece and to cause leg portions of a staple to penetrate the workpiece, an operating member, and a bending part configured to bend the leg portions. The bending part includes a bending member configured to bend the leg portions of the staple, and a driving force transmitting section configured to transmit an operation of the operating member to the bending member.

6 Claims, 86 Drawing Sheets

(56) References Cited

U.S. PATENT DOCUMENTS 4,431,127 A 2/1984 Watanabe
5,029,745 A 7/1991 Akizawa et al.
5,586,710 A 12/1996 Golicz
5,697,747 A 12/1997 Sawada et al.
5,758,813 A 6/1998 Kikuchi et al.
6,036,074 A 3/2000 Manabe
6,056,183 A 5/2000 Tanabe
6,698,640 B2 3/2004 Hakozaki et al.
6,820,790 B2 11/2004 Ura
7,021,512 B1 4/2006 Nakamura
7,124,925 B2 10/2006 Ishizaki
7,621,432 B2 * 11/2009 Chiang ..... B25C 5/1603 227/109
7,975,891 B2 * 7/2011 Aoki ..... B27F 7/21 227/120
8,038,043 B2 * 10/2011 Wang ..... B25C 5/11 227/120
8,038,378 B2 10/2011 Aoki et al.
9,643,307 B2 * 5/2017 Kato ..... B25C 5/0257
9,975,230 B2 * 5/2018 Aoki ..... B25C 5/025
2004/0046001 A1 3/2004 Jairam
2007/0023474 A1 2/2007 Smith et al.
2007/0221699 A1 9/2007 Hsu
2008/0029568 A1 2/2008 Hsu
2009/0136324 A1 5/2009 Aoki et al.
2009/0152318 A1 6/2009 Matsukawa
2009/0184150 A1 * 7/2009 Tsai ..... B25C 5/0221 227/134
2009/0272781 A1 * 11/2009 Maemori ..... B25C 5/0242 227/120
2010/0012701 A1 * 1/2010 Huang ..... B25C 5/0207 227/132
2010/0059568 A1 * 3/2010 Leung ..... B25C 5/025 227/64
2010/0155450 A1 * 6/2010 Aoki ..... B27F 7/21 227/82
2010/0264190 A1 10/2010 Tsai et al.
2012/0097728 A1 * 4/2012 Huang ..... B25C 5/025 227/107
2012/0175397 A1 * 7/2012 Co ..... B25C 5/025 227/155
2013/0001269 A1 * 1/2013 Aoki ..... B25C 5/0207 227/155
2013/0284787 A1 10/2013 Aoki et al.
2014/0158738 A1 6/2014 Kato et al.

FOREIGN PATENT DOCUMENTS

JP 4967521 B2 7/2012
JP A-2013-230517 11/2013
WO WO 2007/072939 A2 6/2007

OTHER PUBLICATIONS

Extended European Search Report dated Jun. 27, 2017 in corresponding European patent application 1700347.9 (7 pages).

* cited by examiner

STAPLER

The present application is a continuation of U.S. patent application Ser. No. 14/102,842, entitled "Stapler" filed Dec. 11, 2013, now U.S. Pat. No. 9,643,307, which is hereby incorporated by reference in its entirety.

FIELD OF INVENTION

The present invention relates to a stapler capable of stapling a workpiece using non-metal staples.

BACKGROUND ART

Conventionally, there has been proposed a stapler capable of stapling a workpiece using staples made of a non-metal material which is a soft material, such as paper, instead of metal staples.

A stapler using staples made of such a non-metal material includes insert blades for forming holes in the workpiece, by which the workpiece is formed with holes by the insert blades, and leg portions of the staples penetrate the holes.

In the stapler using the staple made of the non-metal soft material, a member configuring a stapling table, on which the workpiece is placed, is provided with a bending member for bending the leg portions of the staple. By movement of an operating member causing the insert blades and the leg portions of the staple to penetrate the workpiece, the stapling table is moved at a given timing, and the bending member is relatively moved by operation of the stapling table, thereby bending the leg portions of the staple that has penetrated the workpiece (see, e.g., JP 4967521 B2).

In the configuration which relatively moves the bending member by the operation of the stapling table, on which the workpiece is placed, to bend the leg portions of the staple, since the bending member is not directly moved by the movement of the operating member, motion of the bending member is not stable. Further, in the process of stapling the workpiece, the motion of the bending member becomes unstable also by the movement of the stapling table. In addition, since the workpiece placed on the stapling table is also moved according to the movement of the stapling table, the stapling motion becomes unstable.

SUMMARY OF INVENTION

One or more embodiments of the present invention provides a stapler capable of reliably performing stapling motion of a workpiece.

According to an aspect of the present invention, a stapler is configured to bind a workpiece using a non-metal staple. The staple has a crown portion and a pair of leg portions extending from respective ends of the crown portion. The stapler includes a penetrating part, an operating member, and a bending part. The penetrating part includes a pair of cutting blades spaced apart from each other. The penetrating part is configured to form holes in the workpiece and to cause the leg portions to penetrate the workpiece by inserting and withdrawing the cutting blades with respect to the workpiece. The operating member is operable to cause the leg portions of the staple to penetrate the workpiece by the penetrating part. The bending part is configured to bend the leg portions of the staple, which has penetrated the workpiece, along the workpiece to bond the leg portions to each other. The bending part includes a bending member configured to bend the leg portions of the staple, and a driving force transmitting section configured to transmit an operation of the operating member to the bending member.

The stapler performs the stapling operation by directly transmitting the movement of the operating member to the bending member to operate the bending member and to bend the pair of leg portions of the staple that has penetrated the workpiece.

That is, the bending member is not moved by the movement of a paper placing base on which the workpiece is placed. Instead, the bending member is moved directly by the movement of the operating member. Therefore, operation of each member is stable, and it is possible to reliably perform the stapling operation. Further, in the process of stapling the workpiece, the paper placing base is not moved. Thus, the operation of each member is stable, and the stapling operation can be reliably performed. In addition, since the workpiece placed on the paper placing base is not moved, the stapling operation is stable, and the stapling operation can be reliably performed.

DETAILED DESCRIPTION

An exemplary embodiment of a stapler according to the present invention will be described with reference the accompanying drawings.

Exemplary Configuration of Stapler of the Embodiment

Figure 1:
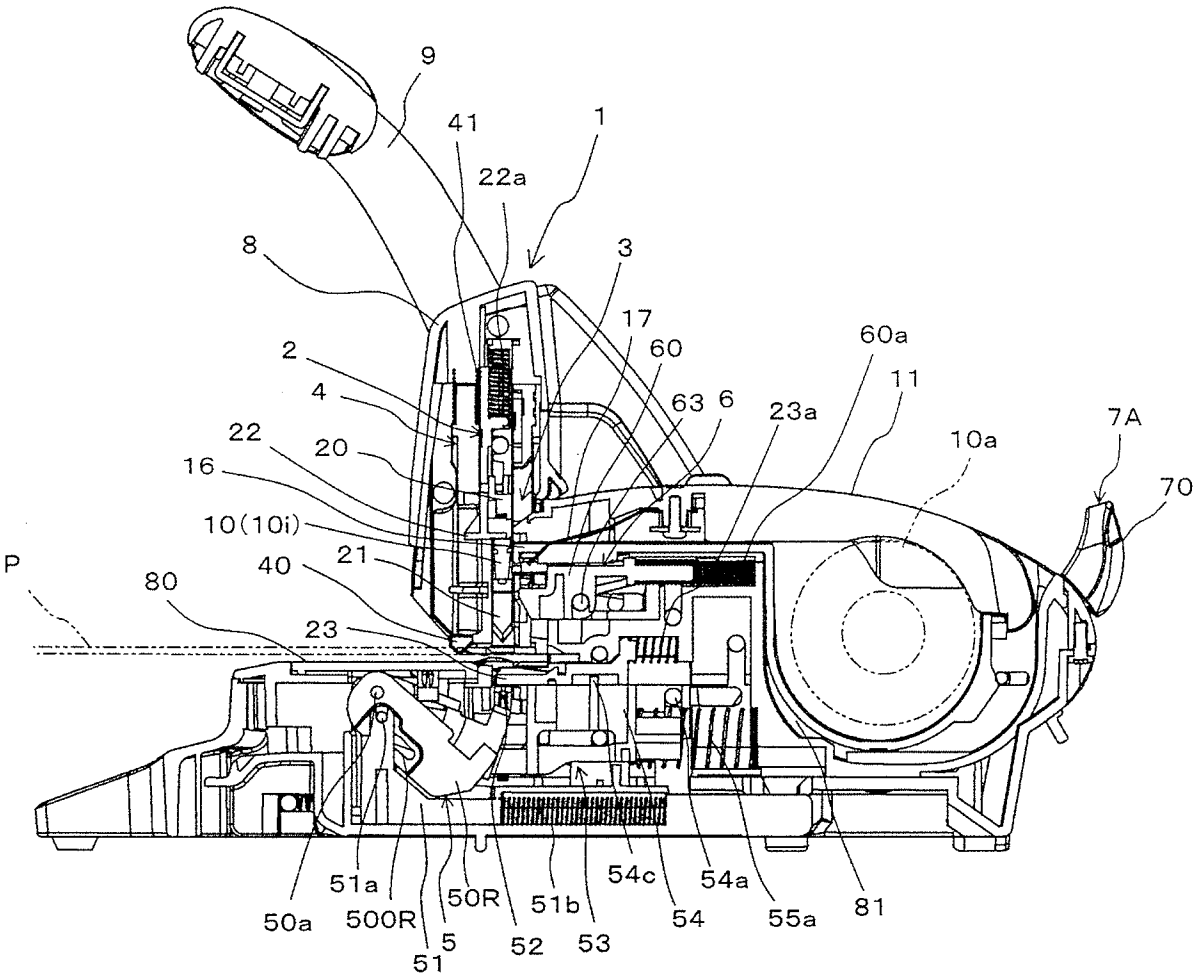
FIG. 1 is a side sectional view illustrating one example of an internal configuration of a stapler according to one embodiment.
Figure 2:
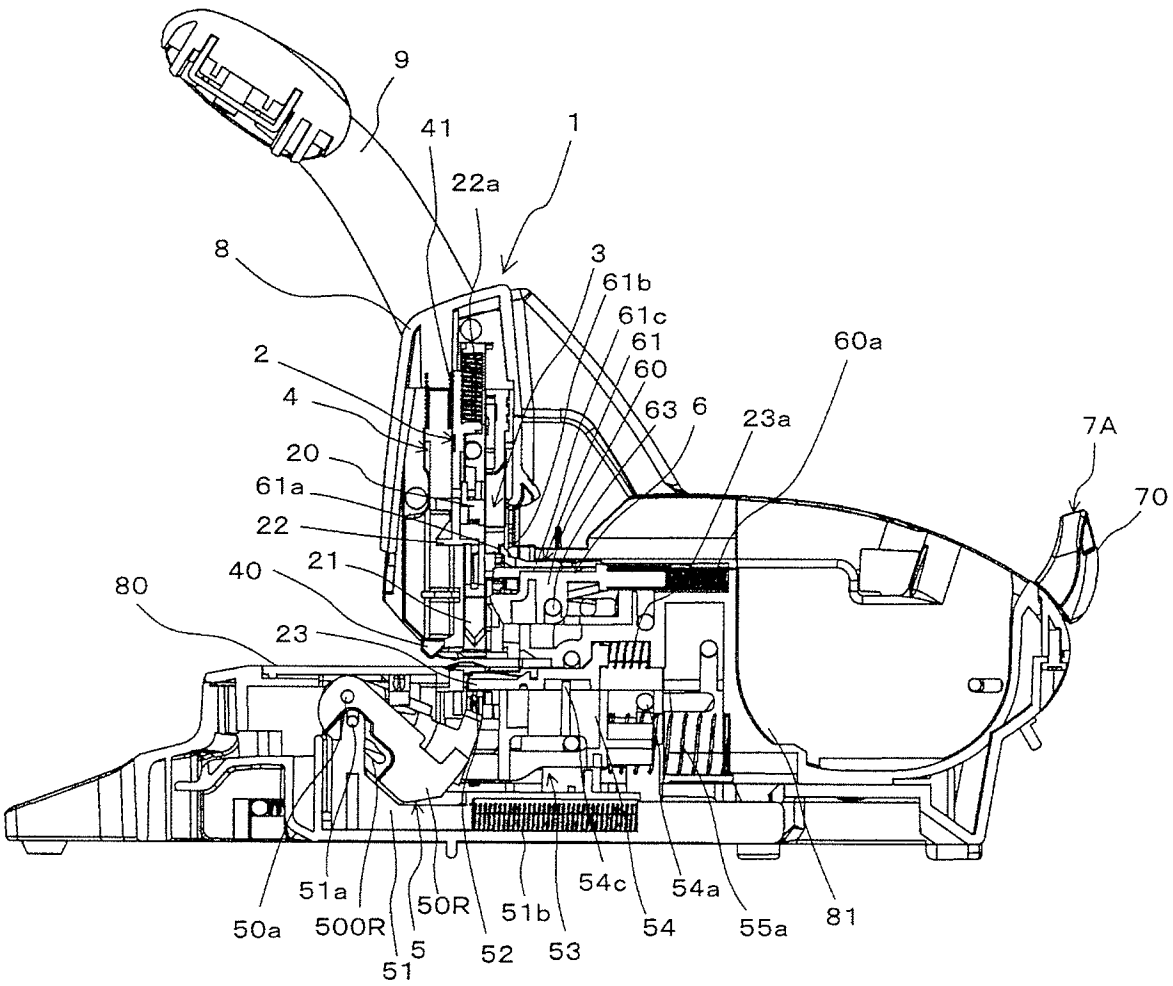
FIG. 2 is a side sectional view illustrating one example of the internal configuration of the stapler according to this embodiment.
Figure 3:
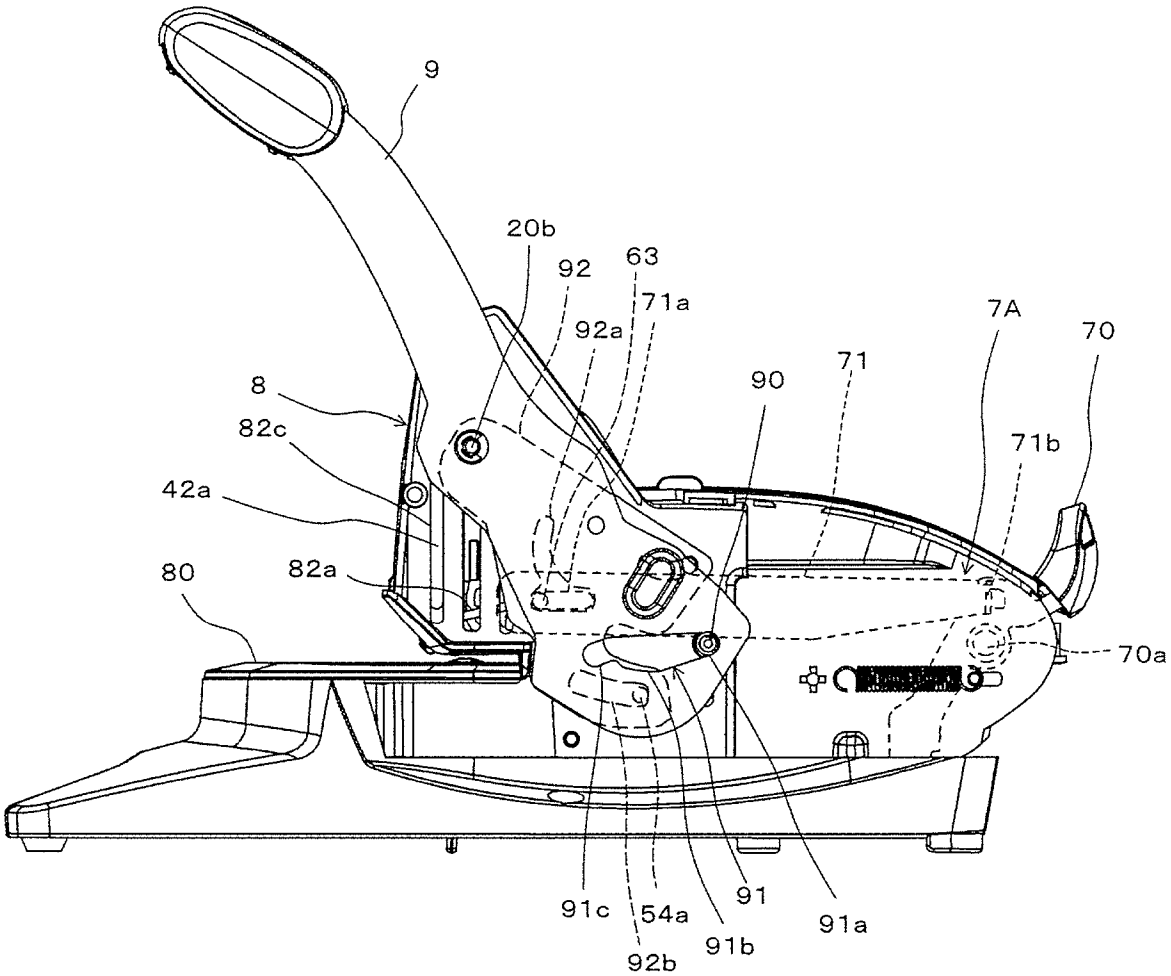
FIG. 3 is a side sectional view illustrating one example of the stapler according to this embodiment.

FIGS. 1 and 2 are side sectional views illustrating one example of the internal configuration of the stapler according to the embodiment, in which FIG. 1 shows a mounting state of a staple cartridge, and FIG. 2 shows a detached state of the staple cartridge. FIG. 3 is a side view illustrating one example of the stapler according to the embodiment.

Figure 4:
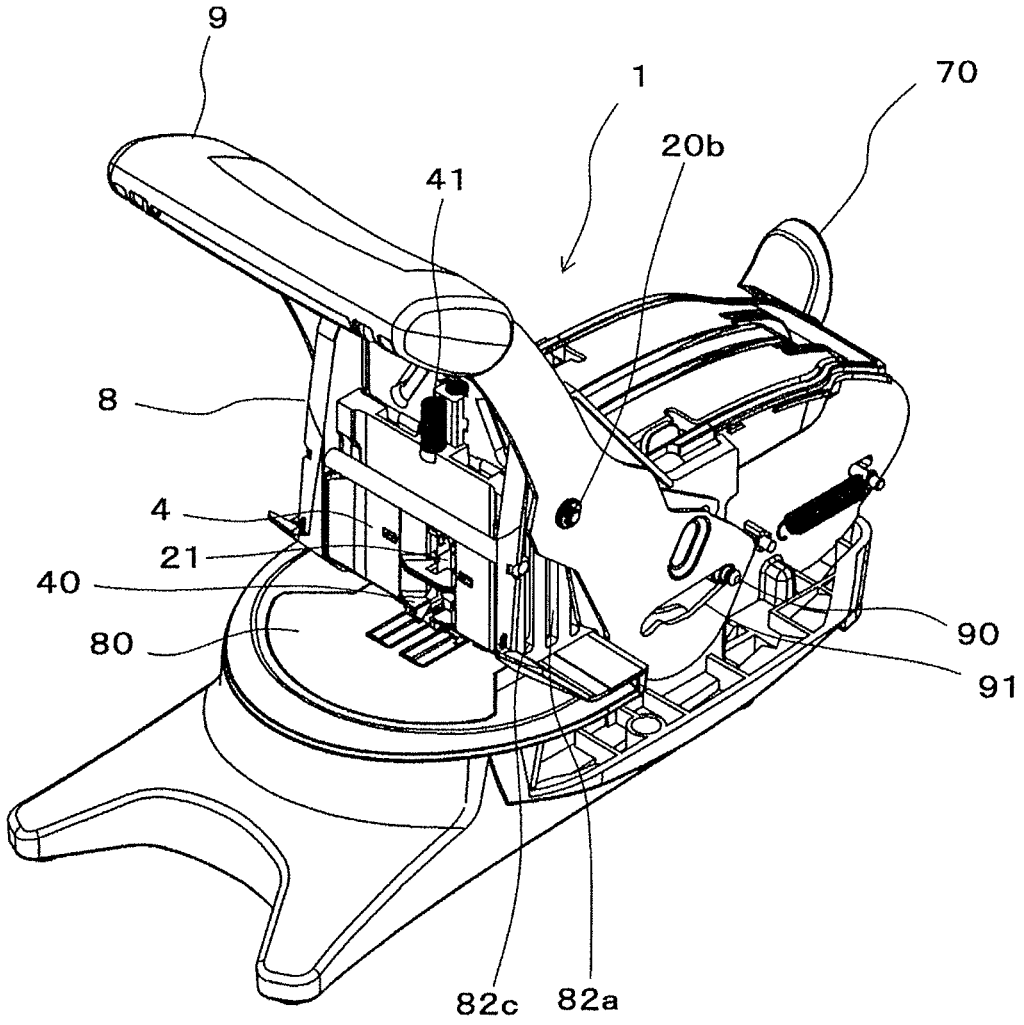
FIG. 4 is a perspective view illustrating one example of the stapler according to one embodiment when seen from a front.
Figure 5:
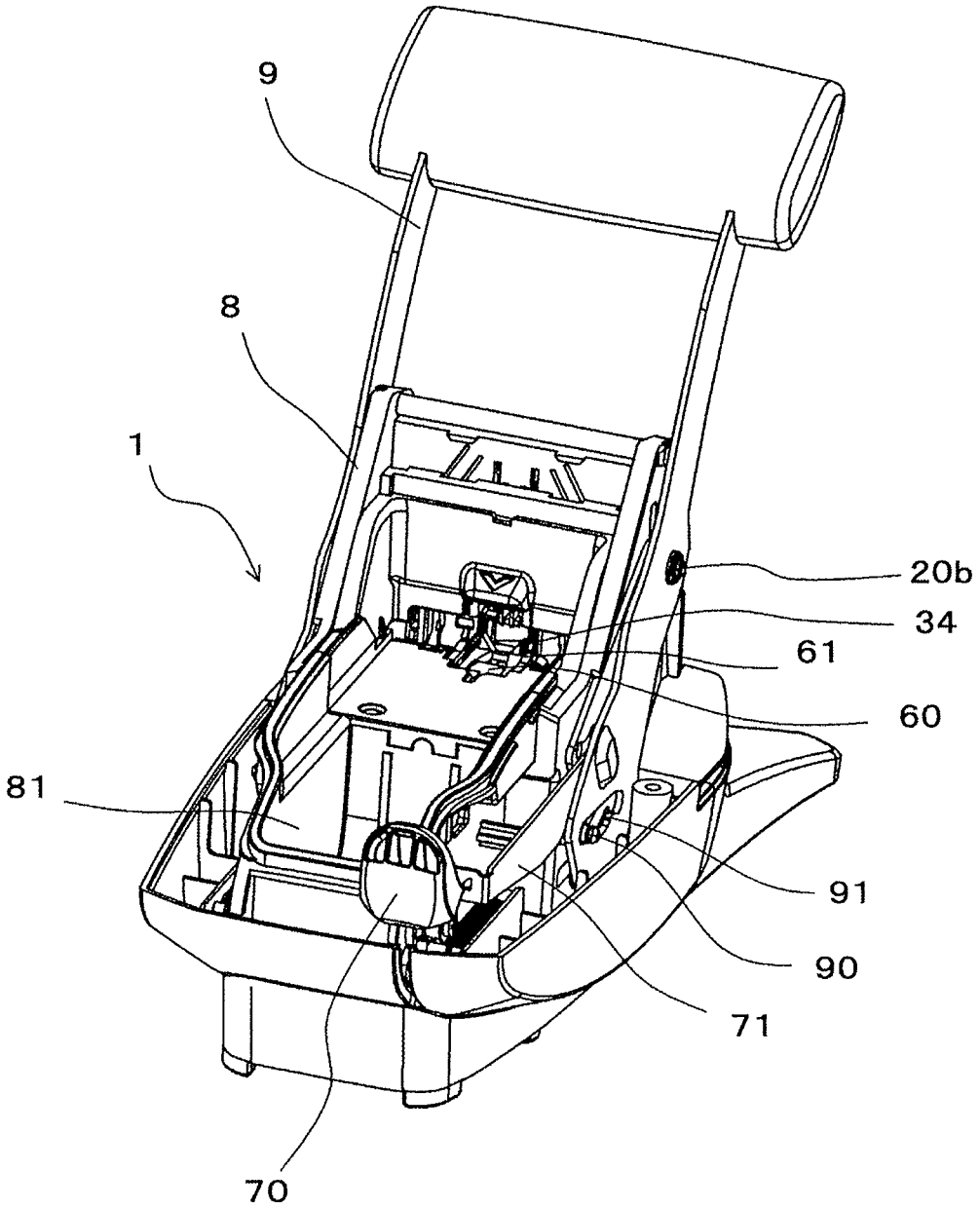
FIG. 5 is a perspective view illustrating one example of the stapler according to this embodiment when seen from a rear.
Figure 6:
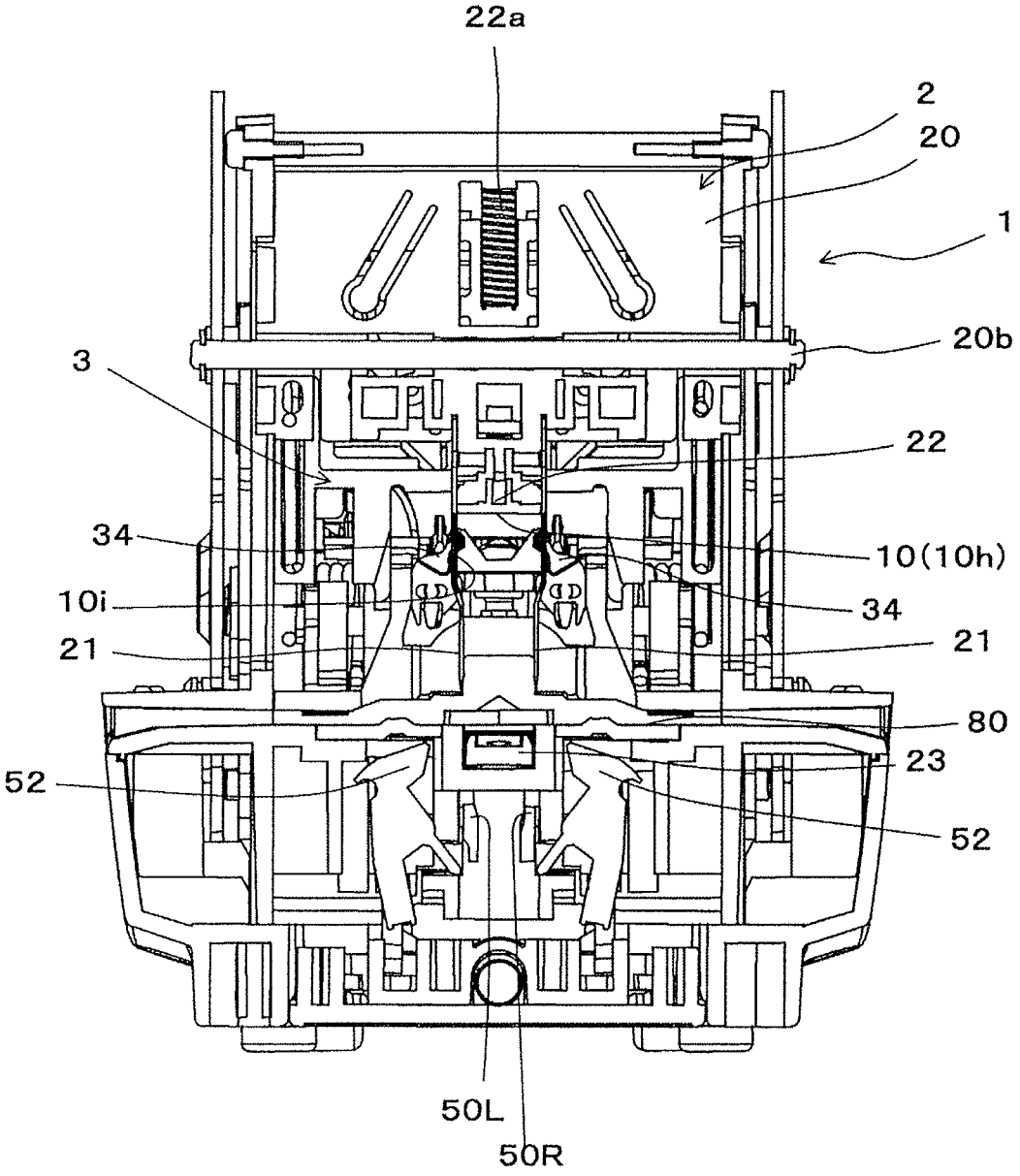
FIG. 6 is a forward sectional view illustrating one example of the internal configuration in a penetrating mechanism of the stapler according to this embodiment.
Figure 7:
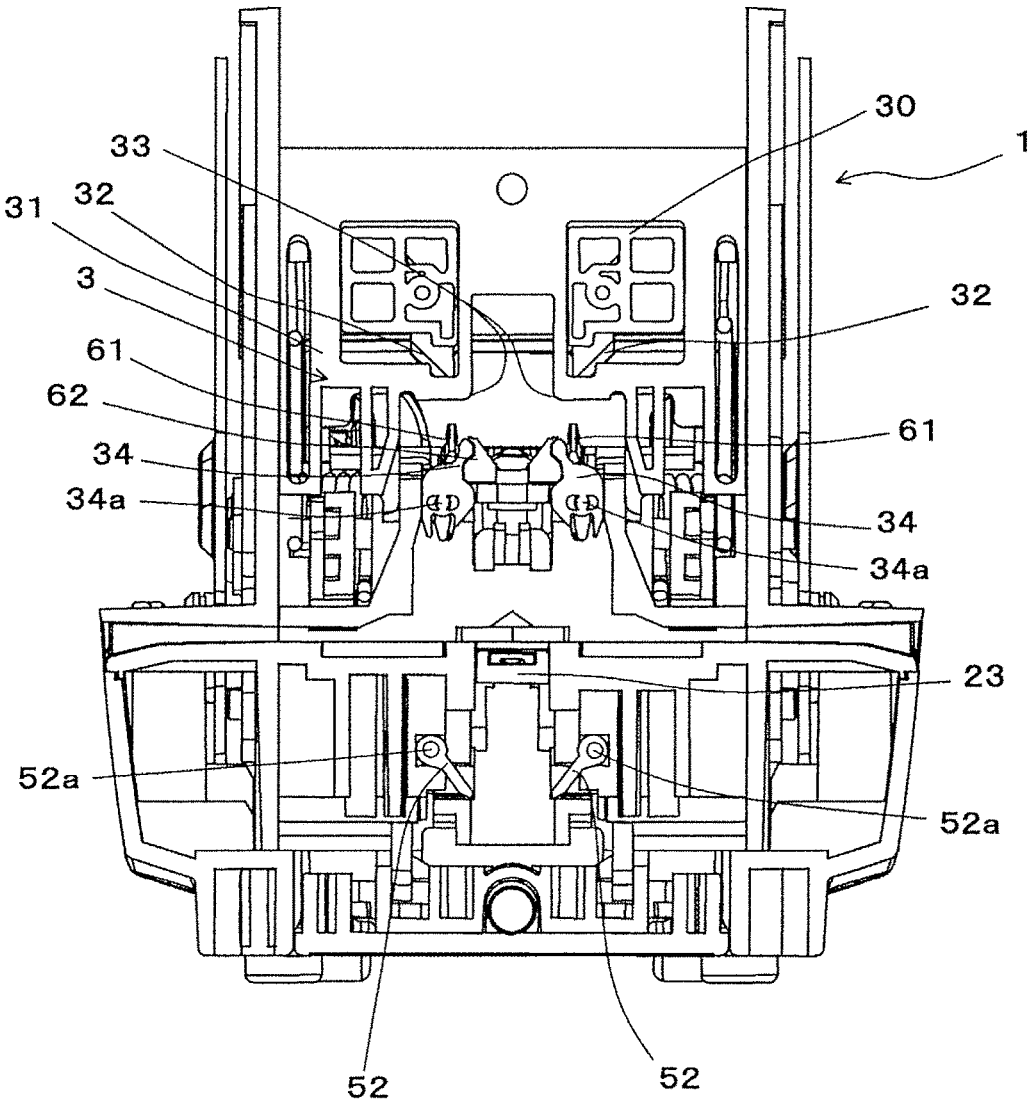
FIG. 7 is a forward sectional view illustrating one example of the internal configuration in a cutting/forming mechanism of the stapler according to this embodiment.

FIG. 4 is a perspective view illustrating one example of the stapler according to one embodiment when seen from a front. FIG. 5 is a perspective view illustrating one example of the stapler according to this embodiment when seen from a rear. FIG. 6 is a forward sectional view illustrating one example of the internal configuration in a penetrating mechanism of the stapler according to this embodiment. FIG. 7 is a forward sectional view illustrating one example of the internal configuration in a cutting/forming mechanism of the stapler according to this embodiment;

First, explaining an outline of the stapler 1 according to this embodiment, the stapler 1 binds the paper sheets P which are a workpiece, using a staple 10 made of a non-metal material which is a soft material. The staple 10 is supplied as a band-like staple-materials-connecting-body 10*a* integrally configured, as will be described later, and the staple-materials-connecting-body 10*a* is received in a staple cartridge 11, so that it is mounted in the stapler 1.

The stapler 1 includes a penetrating mechanism 2 configured to make a hole in the paper sheets P and to penetrate the staple 10 into the paper sheets P by an action of driving the staple 10 which is cut from the staple-materials-connecting-body 10*a* and formed.

Further, the stapler 1 includes a cutting/forming mechanism 3 configured to cut a staple material 10*m* from the staple-materials-connecting-body 10*a* and form the cut staple material 10*m* into a formed staple 10, in association with an operation of the penetrating mechanism 2 which drives the staple 10 and penetrates the paper sheets P.

Further, the stapler 1 includes a paper holding mechanism 4 configured to hold the paper sheets P to be penetrated by the penetrating mechanism 2, in association with the operation of the penetrating mechanism 2 which drives the staple 10 and penetrates the paper sheets P.

Further, the stapler 1 includes a bending mechanism 5 configured to bend the staple 10 penetrated the paper sheets P, in association with the operation of the penetrating mechanism 2 which drives the staple 10 and penetrates the paper sheets P.

Further, the stapler 1 includes a conveying mechanism 6 configured to convey the staples 10 cut from the staple-materials-connecting-body 10*a* and formed to the penetrating mechanism 2 which drives the staple 10, and convey the staple-materials-connecting-body 10*a* to the cutting/forming mechanism 3 from which the next staple 10 is conveyed to the penetrating mechanism 2.

Further, the stapler 1 includes an attaching/detaching mechanism 7A configured to convey the staple-materials-connecting-body 10*a* received in the staple cartridge 11 to a desired position, in association with the conveying mechanism 6, when the staple cartridge 11 is mounted in the stapler 1.

The stapler 1 includes a body section 8 provided with the penetrating mechanism 2, the cutting/forming mechanism 3, the paper holding mechanism 4, the bending mechanism 5, the conveying mechanism 6, and the attaching/detaching mechanism 7A which are described above. With the stapler 1, the respective above-described constituent elements is operated by a desired driving force, and the respective constituent elements is operated in an interlocking manner by operation of an operating handle 9 which is manipulated by a human power.

The body section 8 includes a paper placing base 80 in which the paper sheets P are placed, and a cartridge receiving portion 81 mounted with the staple cartridge 11. With the stapler 1, the paper placing base 80 is installed at one side, that is, a front side, of the body section 8, and the cartridge receiving portion 81 is installed at a rear side.

In the body section 8, the penetrating mechanism 2, the cutting/forming mechanism 3, and the paper holding mechanism 4 are installed over the paper placing base 80. The penetrating mechanism 2, the cutting/forming mechanism 3, and the paper holding mechanism 4 are disposed in order of the cutting/forming mechanism 3, the penetrating mechanism 2, and the paper holding mechanism 4 from a rear side in a conveyance direction of the staple-materials-connecting-body 10*a*.

The body section 8 is provided with guide grooves 82*a* for guiding movement of the penetrating mechanism 2, guide grooves 82*b* for guiding movement of the cutting/forming mechanism 3, and guide grooves 82*c* for guiding movement of the paper holding mechanism 4. The guide grooves 82*a* to 82*c* respectively extend in a vertical direction with respect to the paper sheets P placed in the paper placing base 80, and are provided parallel to each other.

Further, in the body section 8, the conveying mechanism 6 is installed at the rear of the penetrating mechanism 2, the cutting/forming mechanism 3, and the paper holding mechanism 4. The body section 8 is provided with a guide (not illustrated) for guiding movement of the conveying mechanism 6. In addition, in the body section 8, the bending mechanism 5 is installed under the paper placing base 80.

The operating handle 9 is rotatably supported by a coupling shaft portion 20*b*, which will be described later and serves as a fulcrum, of the penetrating mechanism 2, when a cam groove 91 is guided along the shaft 90 installed to the body 8. The operating handle 9 is installed in a vertically movable manner, with it being rotated around an imaginary fulcrum defined by a track of the cam groove 91 guided by the shaft 90 and a track of the coupling shaft portion 20*b*, and the rotation using the imaginary fulcrum as a fulcrum axis is transmitted to the penetrating mechanism 2. Further, the operating handle 9 includes a link 92 for transmitting the operation of the operating handle rotating around the imaginary fulcrum to the conveying mechanism 6 via the coupling shaft portion 20*b*.

Since a distance between a power point, to which the power is applied, and the imaginary fulcrum, and a distance between a point of the penetrating mechanism 2, on which the power acts, and the imaginary fulcrum are displaced by the shape of the cam groove 91, the load applied to the operating handle 9 is varied.

The cam groove 91 is provided with a first guide groove portion 91*a* which is guided by the shaft 90 at a timing at which the staple 10 starts to penetrate into the paper sheets P by the operation of the penetrating mechanism 2, a second guide groove portion 91*b* which is guided by the shaft 90 at a timing at which the staple 10 penetrates into the paper sheets P by the operation of the penetration mechanism 2, and a third guide groove portion 91*c* which is guided by the shaft 90 at a timing at which the staple 10 is bent by the operation of the bending mechanism 5.

In this embodiment, the shape of the cam groove is set so that an operating load of the operating handle 9, an example of an operating member, becomes light at the timing at which the staple 10 starts to penetrate into the paper sheets P by the operation of the penetrating mechanism 2, an example of a penetrating part, and at the timing at which the staple 10 is bent by the operation of the bending mechanism 5, an example of a bending part.

In the stapler 1, the operation of the operating handle 9 is transmitted to the penetrating mechanism 2, the cutting/forming mechanism 3, and the paper holding mechanism 4, so that the penetrating mechanism 2, the cutting/forming mechanism 3, and the paper holding mechanism 4 are guided by the guide grooves 82*a* to 82*c* to move in the vertical direction with respect to the paper sheets P placed in the paper placing base 80.

Accordingly, the stapler 1 performs the operation of the paper holding mechanism 4 to hold the paper sheets P placed in the paper placing base 80, as the operating handle 9 is operated. Also, in association with the operation of the paper holding mechanism 4 to hold the paper sheets P, the stapler performs the operation of the penetrating mechanism 2 to allow the staple 10 to penetrate the paper sheets P. Furthermore, in association with the operation of the penetrating mechanism 2 to allow the staple 10 to penetrate the paper sheets P, the stapler performs the operation of the cutting/forming mechanism 3 to cut and form the next staple 10.

Further, the stapler 1 performs the operation of the bending mechanism 5 to bend the staple 10 penetrating the paper sheets P, in association with the operation of the operating handle 9.

In the stapler 1, the operation of the operating handle 9 is transmitted to the conveying mechanism 6 via the link 92, and thus the conveying mechanism 6 is moved in a forward and backward direction along the conveyance direction of the staple-materials-connecting-body 10*a*. Accordingly, as the operating handle 9 is operated, the stapler 1 conveys the staple-materials-connecting-body 10*a* to the cutting/forming mechanism 3 by the conveying mechanism 6, and conveys the staple 10 located at the leading end, which is cut and formed from the staple-materials-connecting-body, 10*a* to the penetrating mechanism 2.

Figure 8:
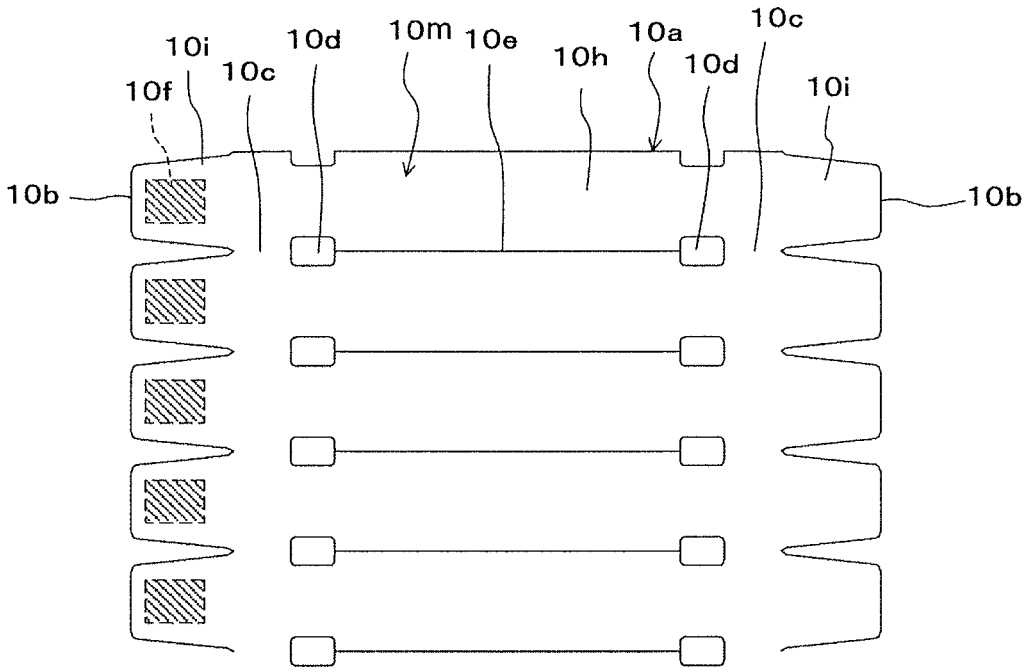
FIG. 8 is a plan view illustrating one example of a staple-materials-connecting-body.
Figure 9:
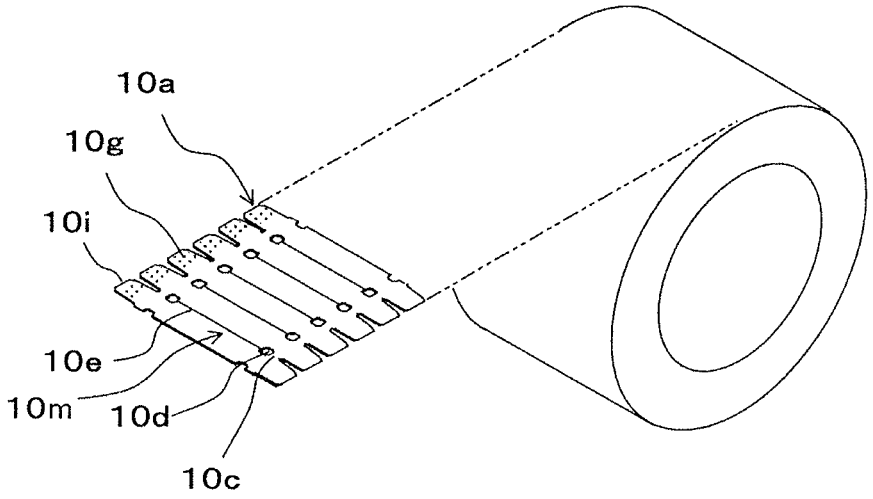
FIG. 9 is a perspective view illustrating one example of a receiving state of the staple-materials-connecting-body.
Figure 10:
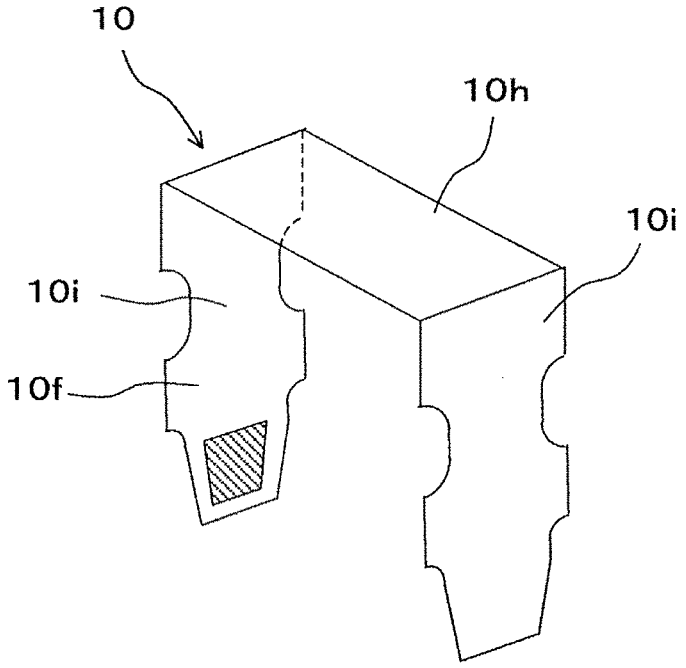
FIG. 10 is a perspective view illustrating one example of a formed staple.
Figure 11:
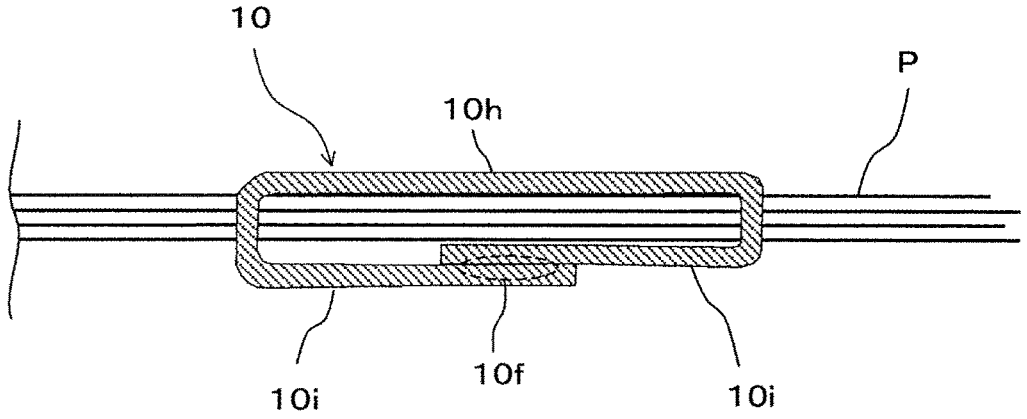
FIG. 11 is a cross-sectional view illustrating one example of a state in which paper sheets are stapled with the staple.

Exemplary configuration of staple and staple-materials-connecting-body FIG. 8 is a plan view illustrating one example of the staple-materials-connecting-body according to this embodiment. FIG. 9 is a perspective view illustrating one example of a receiving state of the staple-materials-connecting-body according to this embodiment. FIG. 10 is a perspective view illustrating one example of the formed staple according to the embodiment. FIG. 11 is a cross-sectional view illustrating one example of a state in which the paper sheets are stapled with the staple. Next, the configuration of the staple 10 and the staple-materials-connecting-body 10*a* according to this embodiment will be described with reference to each drawing.

The staple 10 is made of a non-metal material, which is a soft material, having a predetermined thickness. A staple material 10*m* before being formed to the staple 10 has an elongated straight shape, and both tip end portions 10*b* in its longitudinal direction are tapered toward its tip end. In this embodiment, the staple 10 and the staple material 10*m* is made of the paper, but may be made of resin film or sheet, instead of the paper.

The staple-materials-connecting-body 10*a* has a plurality of staple materials 10*m* arranged parallel to each other in the longitudinal direction, and each staple material 10*m* is connected to each other by a pair of connecting portions 10*c* provided in the inside of the tip end portions 10*b* near both end portions thereof in the longitudinal direction. In the staple-materials-connecting-body 10*a*, a portion outer than each connecting portion 10*c* in the longitudinal direction of each staple material is not provided with a portion connecting the staple materials 10*m* arranged parallel to each other, due to the tapered shape of the tip end portion 10*b*.

The staple-materials-connecting-body 10*a* is provided with a hole 10*d* adjacent to each connecting portion 10*c* at the inside of the one pair of the connecting portions 10*c* connecting the staple materials 10*m* arranged parallel to each other. The hole 10*d* has a predetermined length in the longitudinal direction and a short-side direction of the staple material 10*m*, and, in this embodiment, the hole is formed by an aperture of a substantially rectangular shape with rounded corners. Also, the hole 10*d* may be formed as a circular or oval aperture. The staple-materials-connecting-body 10*a* is not provided with a cut portion of the staples arranged parallel to each other between the connecting portion 10*c* and the hole 10*d*.

Further, the staple-materials-connecting-body 10*a* is provided with a slit 10*e* for separating the staple materials 10*m* arranged parallel to each other, between the respective holes 10*d*. The slit portion 10*e* is consecutively formed from one hole 10*d* to the other hole 10*d*, and thus the staple-materials-connecting-body 10*a* is not provided with a connecting portion of the staple materials 10 arranged parallel to each other, between the one hole 10*d* to the other hole 10*d*.

The staple-materials-connecting-body 10*a* is punched by pressing or stamping to have a predetermined shape of the tip end portions 10*b*, the connecting portions 10*c*, the holes 10*d*, and the slit portions 10*e*, which are described above.

The staple-materials-connecting-body 10*a* is provided with an adhesive portion 10*f* on one surface, that is, a reverse surface, of the one tip end portion 10*b* which is the end portion of each staple material 10*m* in the longitudinal direction. The adhesive portion 10*f* uses a property to obtain a desired adhesive force when the leg portion 10*i* of the staple 10 is bonded, in accordance with the material type of the staple 10.

When the staple-materials-connecting-body 10*a* is wound in a roll shape, as illustrated in FIG. 9, the staple materials 10*m* are overlapped, and thus the adhesive portion 10*f* located on the reverse surface of the one tip end portion 10*b* of the outer-peripheral staple material 10 comes into contact with the obverse surface of the one tip end portion 10*b* of the inner-peripheral staple material 10.

When the staple-materials-connecting-body 10*a* is wound in the roll shape, the other surface of the one tip end portion which at least comes into contact with the adhesive portion 10*f* is provided with a coated portion 10*g* made of silicon or the like, thereby preventing the staples from sticking in the staple-materials-connecting-body 10*a* which is wound.

Since the staple material 10*m* is cut and formed from the staple-materials-connecting-body 10*a* by the cutting/forming mechanism 3 illustrated in FIGS. 1 and 7, both end portions thereof in the longitudinal direction are bent by a predetermined length to be substantially parallel in a first direction, thereby the staple 10 in which a crown portion 10*h*, as illustrated in FIG. 10 and leg portions 10*i* at both end portions of the crown portion 10*h* are formed.

According to the staple 10 cut and formed from the staple-materials-connecting-body 10*a*, the one pair of leg portions 10*i* penetrate the paper sheets P by the penetrating mechanism 2, and the one pair of leg portions 10*i* penetrating the paper sheets P are bent in a second direction along the paper sheets P by the bending mechanism 5.

Since the reverse surface of the one tip end portion 10*b* of the staple 10 is provided with the adhesive portion 10*f*, an adhesive force 10*f* is provided on the rear surface of one leg portion 10*i* in the form of the crown portion 10*h* and the leg portion 10*i* which are formed. In this embodiment, the staple 10 has a bending position inside than the hole 10*d*, and a length of the leg portion 10*i* is equal to or more than a half of the length of the crown portion 10*h*. If the one pair of leg portions 10*i* are bent, the adhesive 10*f* is overlapped with the leg portion 10*i*.

Accordingly, as illustrated in FIG. 11, after the other leg portion 10*i* is bent in the second direction along the paper sheets P, the one leg portion 10*i* is bent in the second direction along the paper sheets P, and thus the one leg portion 10*i* is overlapped with the other leg portion 10*i*, so that the leg portion 10*i* are bonded at the adhesive portion 10*f*.

Figure 12:
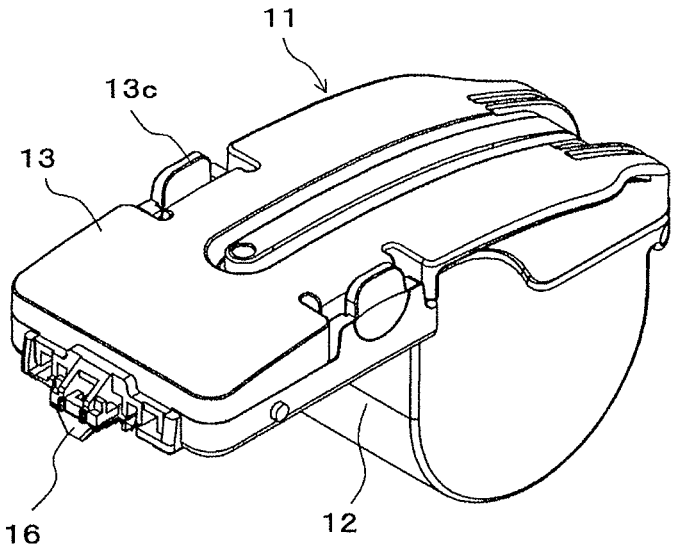
FIG. 12 is a perspective view illustrating one example of a staple cartridge.
Figure 13:
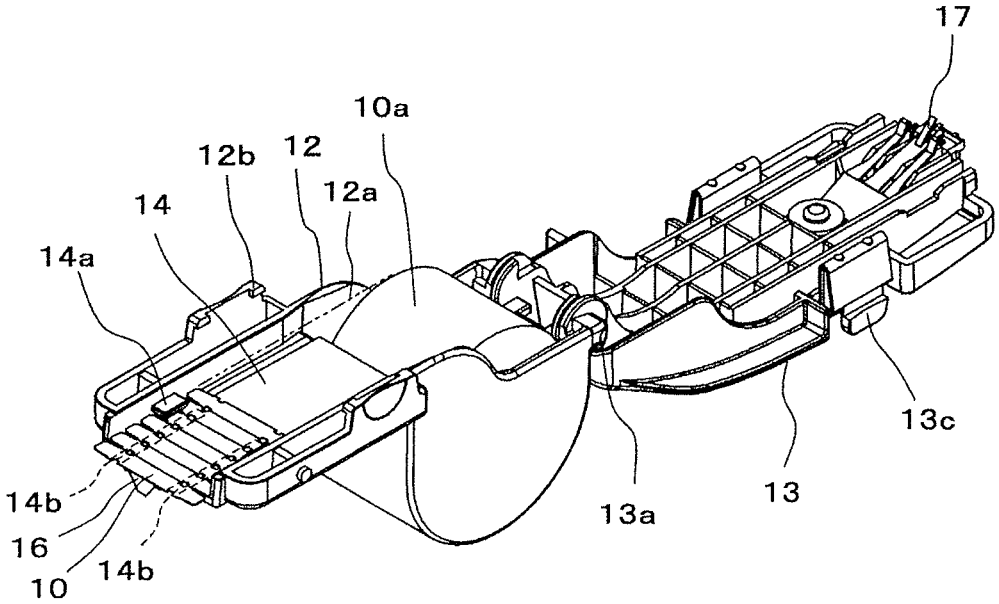
FIG. 13 is a perspective view illustrating one example of the staple cartridge.

Exemplary configuration of staple cartridge FIGS. 12 and 13 are perspective views illustrating one example of the staple cartridge. The configuration of the staple cartridge 11 will now be described with reference to each drawing. Herein, FIG. 12 shows the state in which the staple cartridge 11 is closed, while FIG. 13 shows the state in which the staple cartridge 11 is opened.

The staple cartridge 11 includes a cartridge body 12 and a cartridge cover 13 for covering the cartridge body 12. In the staple cartridge 11, the cartridge body 12 is closed by rotation of the cartridge body 13 around a shaft 13*a* provided at a rear end side thereof.

The cartridge body 12 has a staple receiving portion 12*a* for receiving the staple-materials-connecting-body 10*a* wound in the roll shape therein, and a staple conveying path 14, protruding forward from the staple receiving portion 12*a*, for conveying the staple 10*a*.

The staple conveying path 14 has a pair of guide convex portions 14*a* adjacent to a tip end side thereof, the guide convex portions having a flat bottom portion along the surface of the staple-materials-connecting-body 10*a* drawn from the staple receiving portion 12*a* and extending in a straight line to suppress the staple-materials-connecting-body 10*a* from lifting upward. Further, the staple conveying path 14 has a groove portion 14*b* through which a feed claw (will be described later) of the transport mechanism 6 protrudes into the staple conveying path 14.

The staple conveying path 14 is provided with a receiving table 16 for supporting a portion (corresponding to the crown portion 10*h*) of the staple 10 located at the leading end of the staple-materials-connecting-body 10*a* conveyed through the staple conveying path 14. The receiving table 16 is formed continuously from the staple conveying path 14, and protrudes forward from the tip end of the staple conveying path 14 by conforming to a width corresponding to an inner width of the crown portion 10*h* of the staple 10 and a length of one staple 10 in the short side direction, thereby supporting the staple 10 to be cut and formed by the cutting/forming mechanism 3.

The cartridge cover 13 is configured to cover the staple receiving portion 12*a* and the staple conveying path 14 of the cartridge body 12.

Accordingly, the front end position of the staple-materials-connecting-body 10*a* can be determined by opening the cartridge cover 13, accommodating the staple-materials-connecting-body 10*a* wound in the roll shape into the staple receiving portion 12*a* of the cartridge body 12, and placing the front end portion of the staple-materials-connecting-body 10*a* at a front end portion of the staple conveying path 14.

As the cartridge cover 13 is closed, the front end position of the staple-materials-connecting-body 10*a* is determined in such a way that the staple-materials-connecting-body 10*a* can be conveyed, and then the staple-materials-connecting-body is accommodated in the staple cartridge 11.

The cartridge cover 13 is provided with a staple holding portion 17 at a position opposite to the receiving table 16 when the cartridge body 12 is closed. The staple holding portion 17 is made of a thin sheet-like metallic spring material in the example to push the staple material 10*m*, located at the leading end which is conveyed to the receiving table 16, in a direction of the receiving table 16, thereby suppressing displacement of the staple 10 when the staple 10 is cut and formed by the cutting/forming mechanism 3. In the staple cartridge 11, the cartridge cover 13 is provided a lock portion 13*c* for openably locking the cartridge cover 13, and the cartridge body 12 is provided with a pawl portion 12*b* which is engaged with the lock portion 13*c*.

If the staple cartridge 11 is mounted onto the cartridge receiving portion 81 of the stapler 1, as illustrated in FIG. 1, the staple conveying path 14 functions as a conveying path of the stapler 1. Also, the receiving table 16 protrudes toward the cutting/forming mechanism 3 to function as a receiving table of the staple 10 cut and formed by the cutting/forming mechanism 3.

Exemplary Configuration of Penetrating Mechanism

Figure 14:
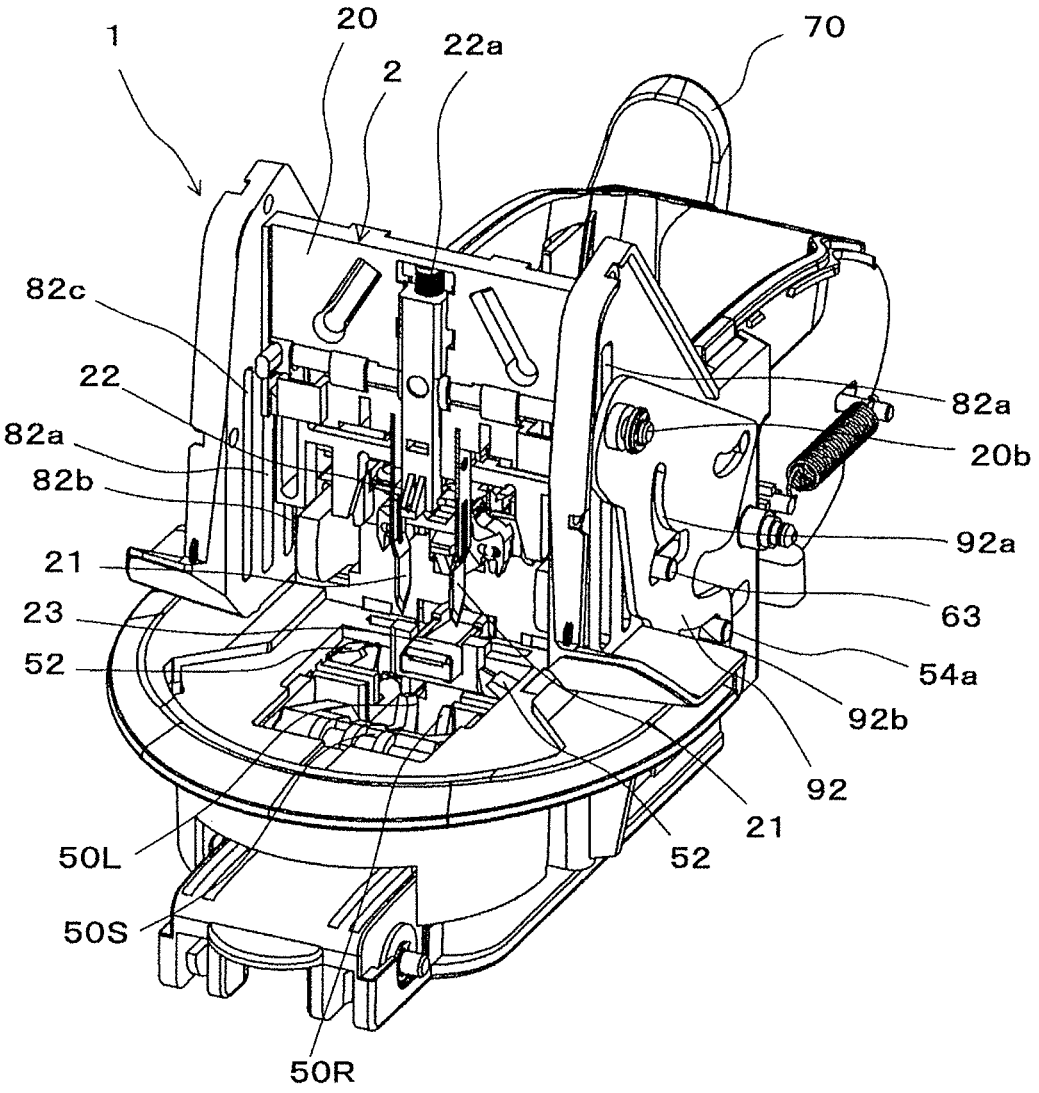
FIG. 14 is a perspective view illustrating one example of the internal configuration in a portion of the penetrating mechanism of the stapler according to this embodiment.
Figure 15:
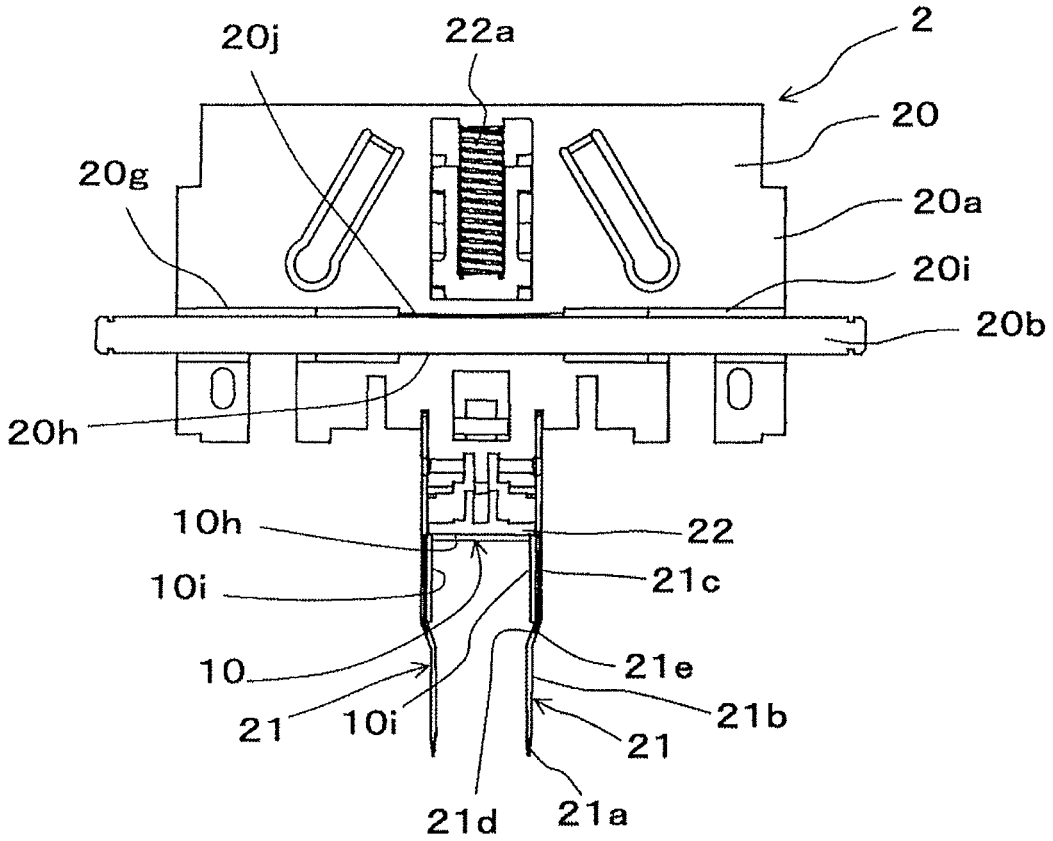
FIG. 15 is a front view illustrating one example of the penetrating mechanism.
Figure 16:
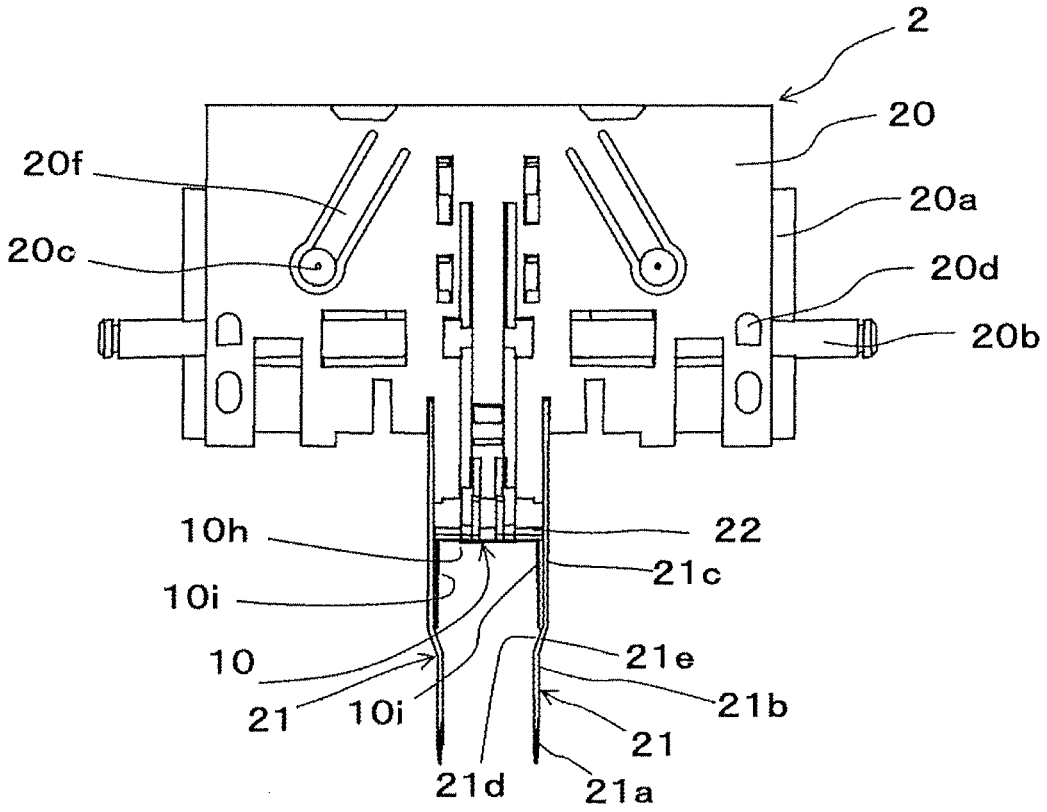
FIG. 16 is a rear view illustrating one example of the penetrating mechanism.
Figure 17:
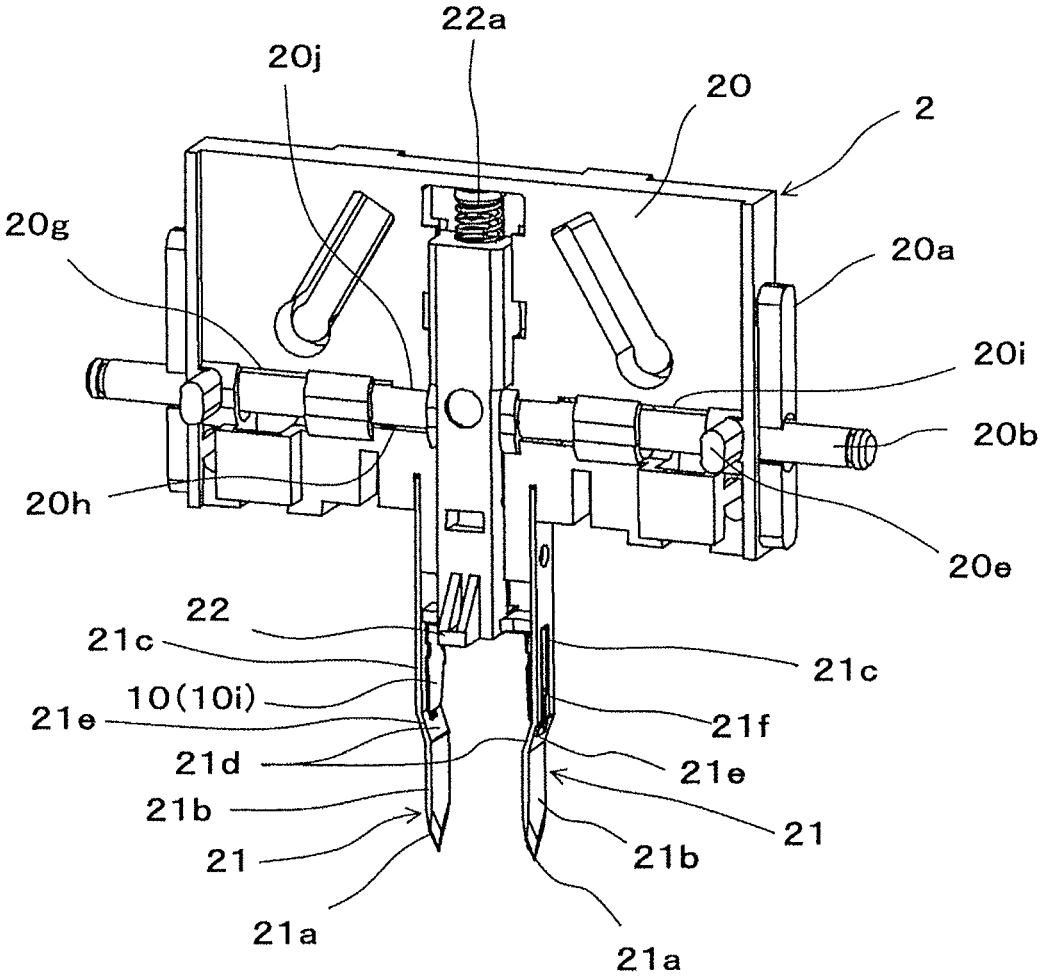
FIG. 17 is a perspective view illustrating one example of the penetrating mechanism.

FIG. 14 is a perspective view illustrating one example of the internal configuration in a portion of the penetrating mechanism of the stapler according to this embodiment. FIG. 15 is a front view illustrating one example of the penetrating mechanism. FIG. 16 is a rear view illustrating one example of the penetrating mechanism. FIG. 17 is a perspective view illustrating one example of the penetrating mechanism. The configuration of the penetrating mechanism will now be described with reference each drawing.

The penetrating mechanism 2 is one example of a penetrating part, and includes a penetrating mechanism body 20 transmitted with the operation of the operating handle 9, two sheets of cutting blades 21 for opening the holes in the paper sheets P by the operation of the penetrating mechanism body 20 and allowing the staple 10 to penetrate the paper sheets P, and a staple press-down portion 22 for driving the staple 10. The penetrating mechanism body 20 is operationally connected to the operating handle 9 to form an example of a connecting portion.

The penetrating mechanism body 20 has guide convex portions 20*a* for guiding the movement of the penetrating mechanism 2, a coupling shaft portion 20*b* connected with the operating handle 9, and a protruding pin 20*c* for transmitting the operation of the operating handle 9 to the cutting/forming mechanism 3. Also, the penetrating mechanism body 20 has a guide convex portion 20*d* for guiding the movement of the penetrating mechanism 2 and the cutting/forming mechanism 3, and a guide convex portion 20*e* for guiding the movement of the penetrating mechanism 2 and the paper holding mechanism 4.

The guide convex portions 20*a* protrude outwardly from both ends of the penetrating mechanism body 20 in a widthwise direction, and are engaged with the guide grooves 82*a* of the body section 8 which are provided in both sides of the body section 8 of the stapler 1 in the widthwise direction and are opened along the moving direction of the penetrating mechanism 2. The guide convex portions 20*a* are formed in an elliptical shape which is formed by connecting two semicircles with a straight line, to restrict a posture of the penetrating mechanism 2 in its rotating direction.

The coupling shaft portion 20*b* is inserted into a hole portion 20*g* provided in the penetrating mechanism body 20, protrudes from both ends of the penetrating mechanism body 20 in the widthwise direction to the outside of the guide convex portions 20*a*, and is engaged with the operating handle 9.

The penetrating mechanism body 20 is provided with a transmitting portion 20*h* formed by installing a convex portion, which protrudes from an inner surface of a hole 20*g*, at a position directly above the cutting blade 21 adjacent to the center of the hole 20*g* in the axial direction, and the transmitting portion is pressed by the coupling shaft portion 20*b*.

The transmitting portion 20*h* is configured to be brought into contact with the coupling shaft portion 20*b* even in the case where the coupling shaft portion 20*b* is inclined with respect to the penetrating mechanism body 20, and also is configured so that the force of the operating handle 9 pressing the coupling shaft portion 20*b* acts on the cutting blade 21 from directly above the cutting blade 21.

Further, the penetrating mechanism body 20 is provided with shaft retracting portions 20*i* at both sides of the transmitting portion 20*h* by widening the shape of the holes 20*g* adjacent to both sides of the transmitting portion 20*h* in the vertical direction relative to a diameter of the coupling shaft portion 20*b*.

The shaft retracting portions 20*i* are formed by providing a space, in which the coupling shaft portion 20*b* can move in the vertical direction, at both left and right sides of the transmitting portion 20*h* to allow the coupling shaft portion 20*b* to be inclined with respect to the penetrating mechanism body 20.

In addition, the penetrating mechanism body 20 is provided with a shaft holding portion 20*j* by forming a convex portion, which protrudes from the inner surface of the hole 20*g*, at the position opposite to the transmitting portion 20*h*. To allow the coupling shaft portion 20*b* to be inclined with respect to the penetrating mechanism body 20, the shaft holding portion 20*j* is configured so that a protruding height around its center is higher than that of both left and right sides.

The protruding pin 20*c* is configured to protrude from a rear surface, which is opposite to the cutting/forming mechanism 3, of the penetrating mechanism body 20 in a projecting/retracting manner. The protruding pin 20*c* is provided integrally with the penetrating mechanism body 20 made of a resin material via a support portion 20*f* in this example.

The protruding pin 20*c* is supported by the support portion 20*f* in a cantilever form, and is configured to be projected/retracted from/into the surface opposite to the cutting/forming mechanism 3 mainly by the resilient deformation of the support portion 20*f*. Accordingly, the protruding pin 20*c* which protrudes in a retractable manner can be configured, without installing a separate component such as a spring.

The guide convex portions 20*d* are formed by installing bosses at a rear surface of the penetrating mechanism body 20 opposite to the cutting/forming mechanism 3. The guide convex portions 20*e* are formed by installing bosses at a surface of the penetrating mechanism body 20 opposite to the paper holding mechanism 4.

The penetrating mechanism 2 includes two cutting blades 21 attached at an interval to a lower portion of the penetrating mechanism body 20. The two cutting blades 21 extend downward from the penetrating mechanism body 20 in a direction parallel to each other, and a tip end which is a lower end of each cutting blade 21 is formed with a blade portion 21*a*.

An interval of the two cutting blades 21 is narrow at the tip end provided with the blade portion 21*a*, and each cutting blade 21 is provided with a stepped portion formed to widen its outer width from the tip end to the rear end, that is, a base end, at an outer surface of the one pair of cutting blades 21, and a stepped portion formed to widen an inner width from the tip end to the base end.

That is, each cutting blade 21 is configured so that the interval of the two cutting blades 21 is equal to or slightly less than the inner width of the one pair of leg portions 10*i* which is the inner width of the crown portion 10*h* of the staple 10, in the range of the predetermined length at the tip end provided with the blade portion 21*a*, thereby forming a first penetrating portion 21*b*.

Also, each cutting blade 21 is configured so that the interval of the two cutting blades 21 is equal to or slightly more than the outer width of the one pair of leg portions 10*i* which is the outer width of the crown portion 10*h* of the staple 10, at the penetrating mechanism body 20, of which the upper portion rather than the first penetrating portion 21*b* becomes the base end, thereby forming a second penetrating portion 21*c*.

Each cutting blade 21 is bent in a substantial crank form at a predetermined intermediate position which becomes a boundary between the first penetrating portion 21*b* and the second penetrating portion 21*c*, and the first penetrating portion 21*b* and the second penetrating portion 21*c* extend in a substantially straight shape along the moving direction of the penetrating mechanism 2.

Accordingly, each cutting blade 21 is provided with a stepped portion, of which the inner width of the first penetrating portion 21*b* is slightly narrow, at the inside of the predetermined intermediate position which becomes the boundary between the first penetrating portion 21*b* and the second penetrating portion 21*c*, and a staple support portion

21*d* for supporting the leg portion 10*i* of the staple 10 is formed by the stepped portion formed at the inside opposite to each cutting blade 21.

Also, each cutting blade 21 is provided with a stepped portion, of which the outer width of the second penetrating portion 21*c* is wide, at the outside of the predetermined intermediate position which becomes the boundary between the first penetrating portion 21*b* and the second penetrating portion 21*c*, and a hole expansion portion 21*e* is formed by the stepped portion provided at the outside of each cutting blade 21 to outwardly expand the hole penetrating the paper sheets P by the penetrating operation of the cutting blade 21 with respect to the paper sheets P.

The staple support portion 21*d* has a gentle slope so that the inner surface shape of the cutting blade 21 is gradually narrowed from the second penetrating portion 21*c* to the first penetrating portion 21*b*. The staple support portion 21*d* is configured so that a variation in interval of the cutting blade 21 at the staple support portion 21*d* does not cause the cutting resistance to increase when the cutting blade 21 gets away from the paper sheets P.

Further, the hole expansion portion 21*e* has a gentle slope so that the outer surface shape of the cutting blade 21 is gradually widened from the first penetrating portion 21*b* to the second penetrating portion 21*c*. The hole expansion portion 21*e* is configured so that a variation in interval of the cutting blade 21 at the hole expansion portion 21*e* does not cause the penetrating resistance to increase when the cutting blade 21 penetrates the paper sheets P.

At the tip end of the first penetrating portion 21*b* rather than the staple support portion 21*d*, the inner surfaces of the one pair of cutting blades 21 extend in a straight shape in an insertion/withdrawal direction of the cutting blade 21, so that the inner surface of the cutting blade 21 is not provided with a stepped portion at the tip end rather than the staple support portion 21*d*. Also, at the tip end of the first penetrating portion 21*b* rather than the hole expansion portion 21*e*, the outer surfaces of the one pair of cutting blades 21 extend in a straight shape in the insertion/withdrawal direction of the cutting blade 21, so that the outer surface of the cutting blade 21 is not provided with a stepped portion at the tip end rather than the hole expansion portion 21*e*.

At the tip end of the second penetrating portion 21*c* rather than the staple support portion 21*d*, the inner surfaces of the one pair of cutting blades 21 extend in the straight shape in the insertion/withdrawal direction of the cutting blade 21, so that the inner surface of the cutting blade 21 is not provided with a stepped portion at the base end rather than the staple support portion 21*d*. Also, at the base end of the second penetrating portion 21*c* rather than the hole expansion portion 21*e*, the outer surfaces of the one pair of cutting blades 21 extend in the straight shape in the insertion/withdrawal direction of the cutting blade 21, so that the outer surface of the cutting blade 21 is not provided with a stepped portion at the base end rather than the hole expansion portion 21*e*.

Each cutting blade 21 is provided with ejecting holes 21*f* which penetrate front and back surfaces of the second penetrating portion 21*c*, and an ejecting member (will be described later) for bending the leg portions of the staple 10 penetrating the paper sheets P protrudes from the ejecting holes.

The staple press-down portion 22 is installed between the two cutting blades 21 provided in the width of the crown portion 10*h* of the staple 10. The staple press-down portion 22 is configured to move along the moving direction of the penetrating mechanism body 20, and is supported by the penetrating mechanism body 20 in the state in which it is urged downwardly by a spring 22*a*.

In the stapler 1, if the penetrating mechanism 2 moves down to a predetermined position, the bending mechanism 5 is operated to start the bending of the leg portions 10*i* of the staple 10 penetrating the paper sheets P. In order to bend the leg portions 10*i* of the staple 10 at a constant timing irrespective of the difference in the number of paper sheets P to be stapled, the difference in the number of the paper sheets P is absorbed by the movement of the staple press-down portion 22, and the penetrating 2 is configured to move down to the predetermined position.

Figure 18:
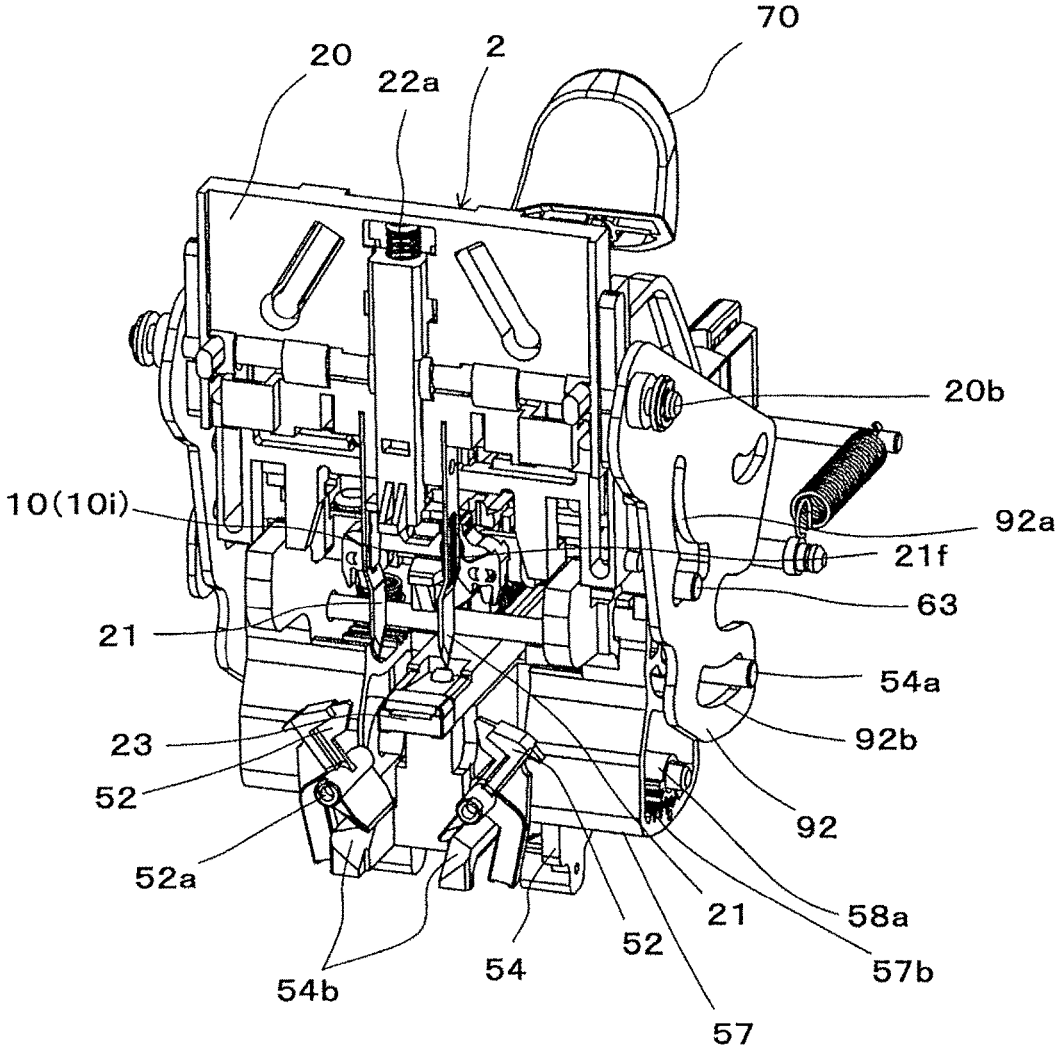
FIG. 18 is a perspective view illustrating one example of a cutting blade guide.

Exemplary configuration of cutting blade guide FIG. 18 is a perspective view illustrating one example of the cutting blade guide. The configuration of the cutting blade guide will now be described with reference to the drawing. As described above, the cutting blade 21 is formed so that the first penetrating portion 21*b* of the tip end is offset inwardly with respect to the second penetrating portion 21*c* supported by the penetrating mechanism body 20.

For this reason, in the process in which the blade portion 21*a* of the cutting blade 21 penetrates the paper sheets P by the lowering movement of the penetrating mechanism 2, the force applied to the cutting blade 21 by the penetrating mechanism body 20 acts on the second penetrating portion 21*c*, so that a force is applied to the cutting blade 21 to be inclined inwardly.

The cutting blade guide 23 is projected or retracted between the one pair of cutting blades 21. As illustrated in FIG. 1 and so forth, the cutting blade guide 23 is provided under the paper placing base 80, and is installed to be projected or retracted between the one pair of cutting blades 21 penetrating the paper sheets P, while being urged by the spring 23*a*.

Although the mechanism for operating the cutting blade guide 23 will be described later, in the process in which the cutting blade 21 of the penetrating mechanism 2 penetrates the paper sheets P by the operation of the operating handle 9 and the leg portions 10*i* of the staple 10 penetrate the paper sheets P, the butting blade guide is projected between the one pair of cutting blades 21 to suppress the cutting blades 21 from being falling down. In the process of stapling the leg portions 10*i* of the staple 10 by the bending mechanism 5, the cutting blade guide is retracted between the one pair of cutting blades 21.

Exemplary Operation of Penetrating Mechanism

FIGS. 19 to 25 are operation chart illustrating an example of the operation of the penetrating mechanism. The inserting/withdrawing process of the cutting blade 21 with respect to the paper sheets P will be described with reference to each drawing.

Figure 19:
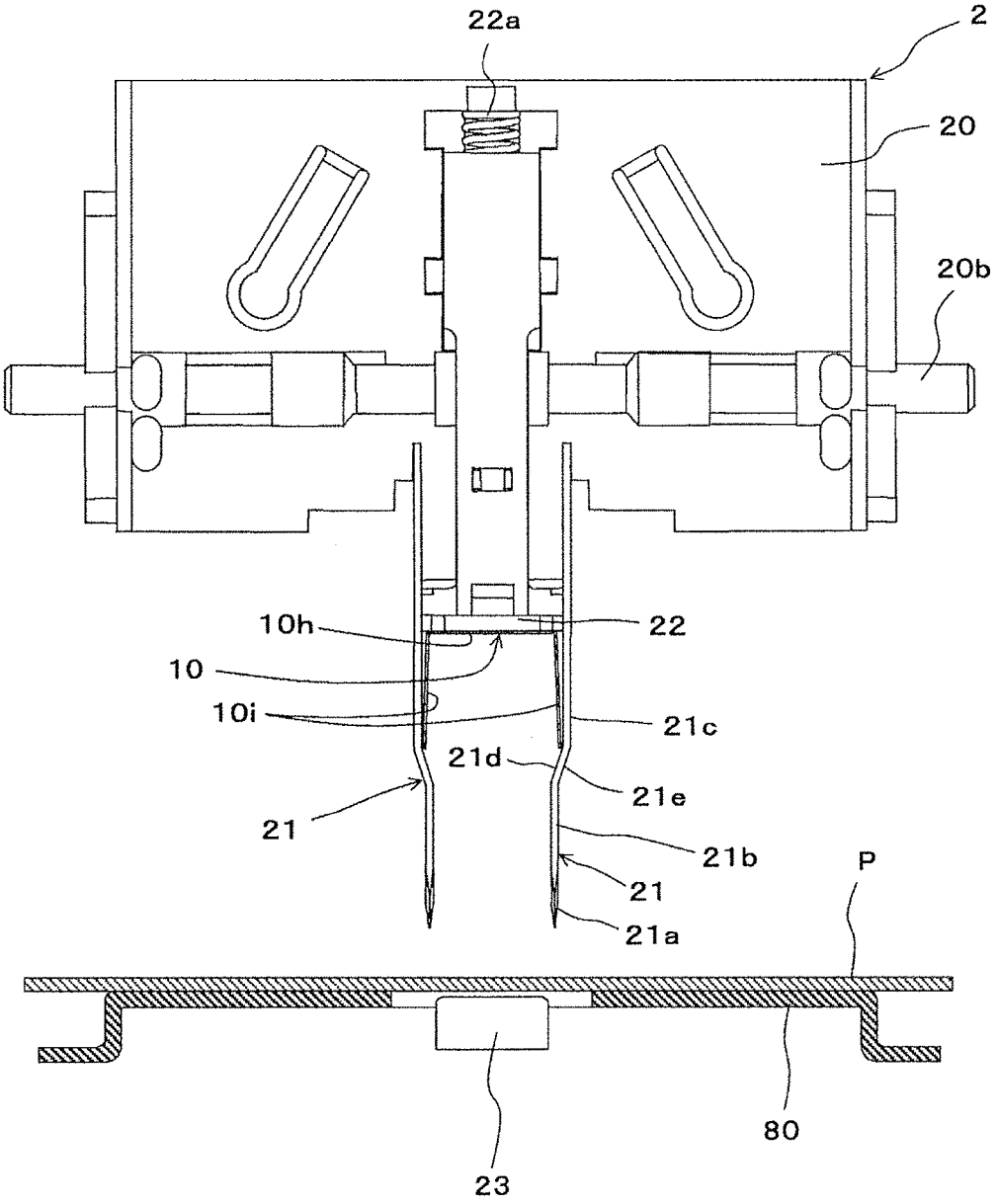
FIG. 19 is an operation chart illustrating an exemplary operation of the penetrating mechanism.

In a standby state, as illustrated in FIG. 19, in the state in which the crown portion 10*h* of the staple 10 is pushed down by the staple press-down portion 22 between the one pair of cutting blades 21, the leg portions 10*i* of the staple 10 are supported by the staple support portion 21*d*.

If the operating handle 9 illustrated in FIG. 1 or the like is pushed, the coupling shaft portion 20*b* engaged with the operating handle 9 is pushed. If the coupling shaft portion 20*b* is pushed, the transmitting portion 20*h* of the penetrating mechanism body 20 is pressed against the coupling shaft portion 20*b*, and thus the penetrating mechanism body 20 is moved downwardly.

Figure 25:
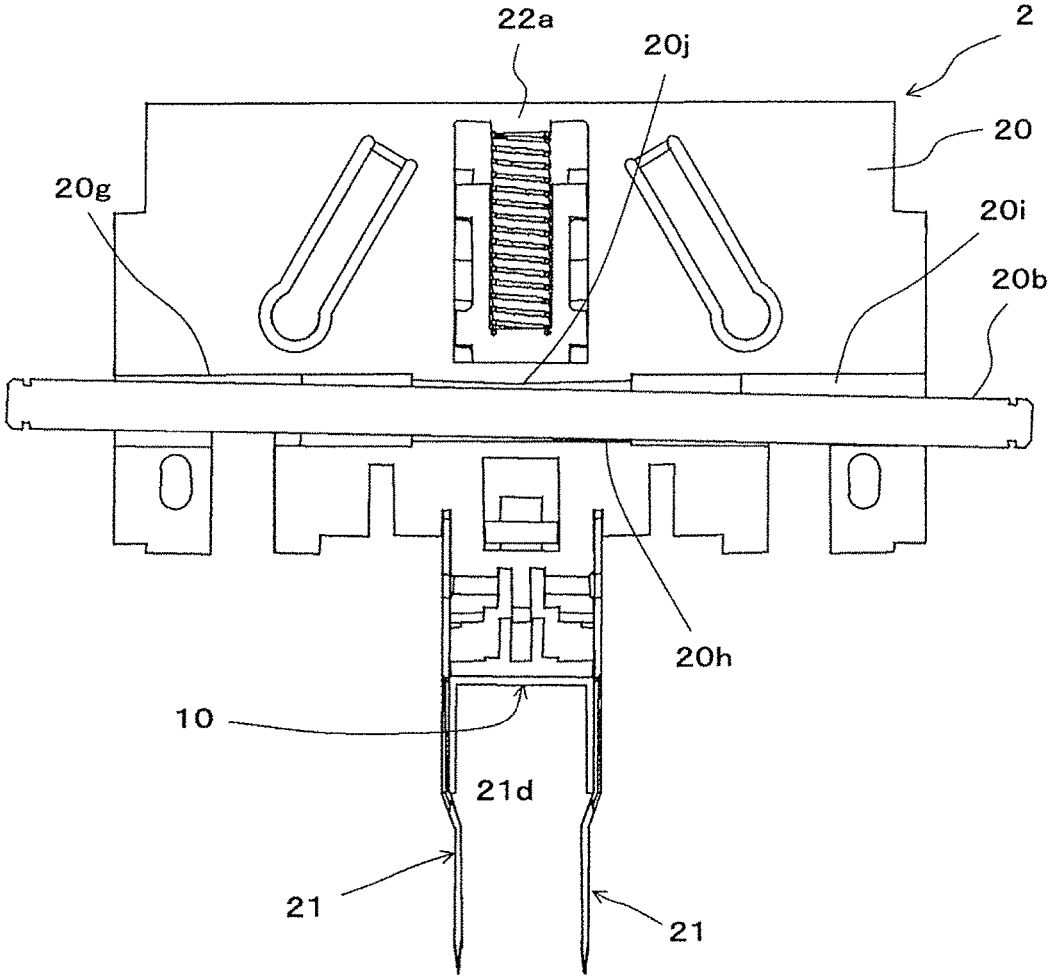
FIG. 25 is an operation chart illustrating an exemplary operation of the penetrating mechanism.

Since the operating handle 9 is operated by a person, there is a case where a biased force is applied. If the operating handle 9 is applied by the biased force, the operating handle 9 is inclined, and thus, as illustrated in FIG. 25, the coupling shaft portion 20*b* connected with the operating handle 9 is also inclined.

The penetrating mechanism body 20 is provided with the shaft retracting portions 20*i* by vertically widening the shape of the holes 20*g*, to which the coupling shaft portion 20*b* is inserted, relative to the diameter of the coupling shaft portion 20*b*, thereby inclining the coupling shaft portion 20*b* to the penetrating mechanism body 20.

Further, the penetrating mechanism body 20 is provided with the transmitting portion 20*h* at the position directly above the cutting blade 21, and thus the coupling shaft portion 20*b* comes into contact with the transmitting portion 20*h* even in the case where the transmitting portion is inclined with respect to the penetrating mechanism body 20. The force of the operating handle 9 pressing the coupling shaft portion 20*b* is applied to the cutting blade 21 from directly above the cutting blade 21.

Accordingly, in the case where the coupling shaft portion 20*b* is inclined by application of the biased force to the operating handle 9, the penetrating mechanism body 20 provided with the cutting blades 21 is moved downwardly, without being inclined by the guidance of the guide groove 82*a* of the body section 8. Further, the force pushing the operating handle 9 is applied to the cutting blades 21 from directly above the cutting blades 21. In this embodiment, the inner surface of the hole 20*g* is provided with the convex portion to form the transmitting portion 20*h* and the shaft retracting portions 20*i*, but the convex portion may be formed integrally with or separately from the outer circumference of the connecting shaft portion 20*b* to form the transmitting portion and the shaft retracting portions.

Figure 20:
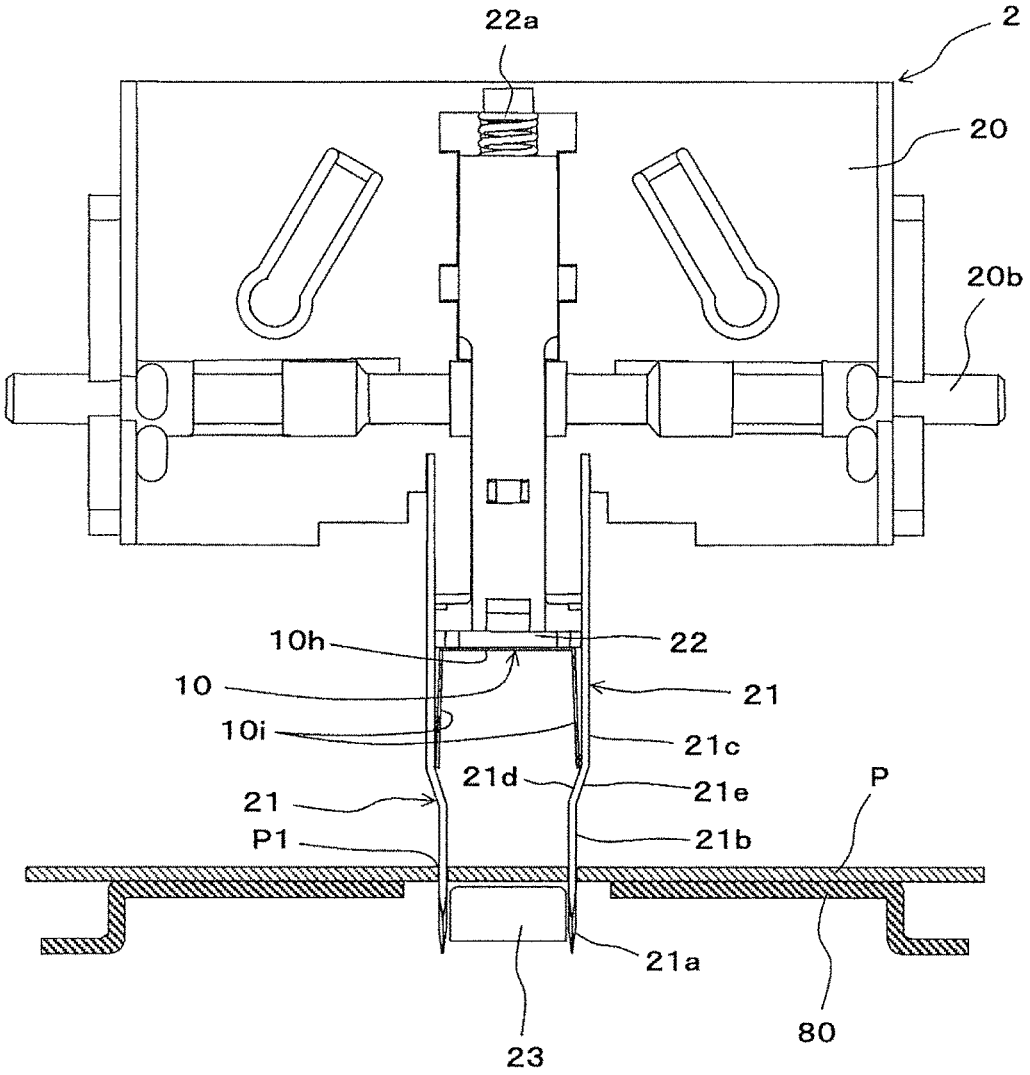
FIG. 20 is an operation chart illustrating an exemplary operation of the penetrating mechanism.

When the penetrating mechanism 2 is moved down by the operation of the operating handle 9 illustrated in FIG. 1 and so forth, and the blades portion 21*a* of the cutting blades 21 reach the paper sheets P placed in the paper placing base 80, the cutting blades 21 start penetrating the paper sheets P, and as illustrated in FIG. 20, holes P1 are opened in the paper sheets P.

According to the cutting blades 21, the first penetrating portions 21*b* having the narrow width of the one pair of cutting blades 21 first penetrate the paper sheets P. As described above, in the process in which the blade portion 21*a* of the cutting blade 21 penetrates the paper sheets, the force applied to the cutting blade 21 by the penetrating mechanism body 20 acts on the second penetrating portion 21*c* which is offset outwardly with respect to the first penetrating portion 21*b*, so that the cutting blade 21 is about to be inclined inwardly.

In this way, since the cutting blade guide 23 protrudes between the one pair of cutting blades 21 penetrating the paper sheets P, each cutting blade 21 is prevented from being inclined inwardly by the penetrating operation of the cutting blades 21 to the paper sheets P, so that the cutting blades 21 penetrates in a direction substantially perpendicular to the paper sheets P.

Figure 21:
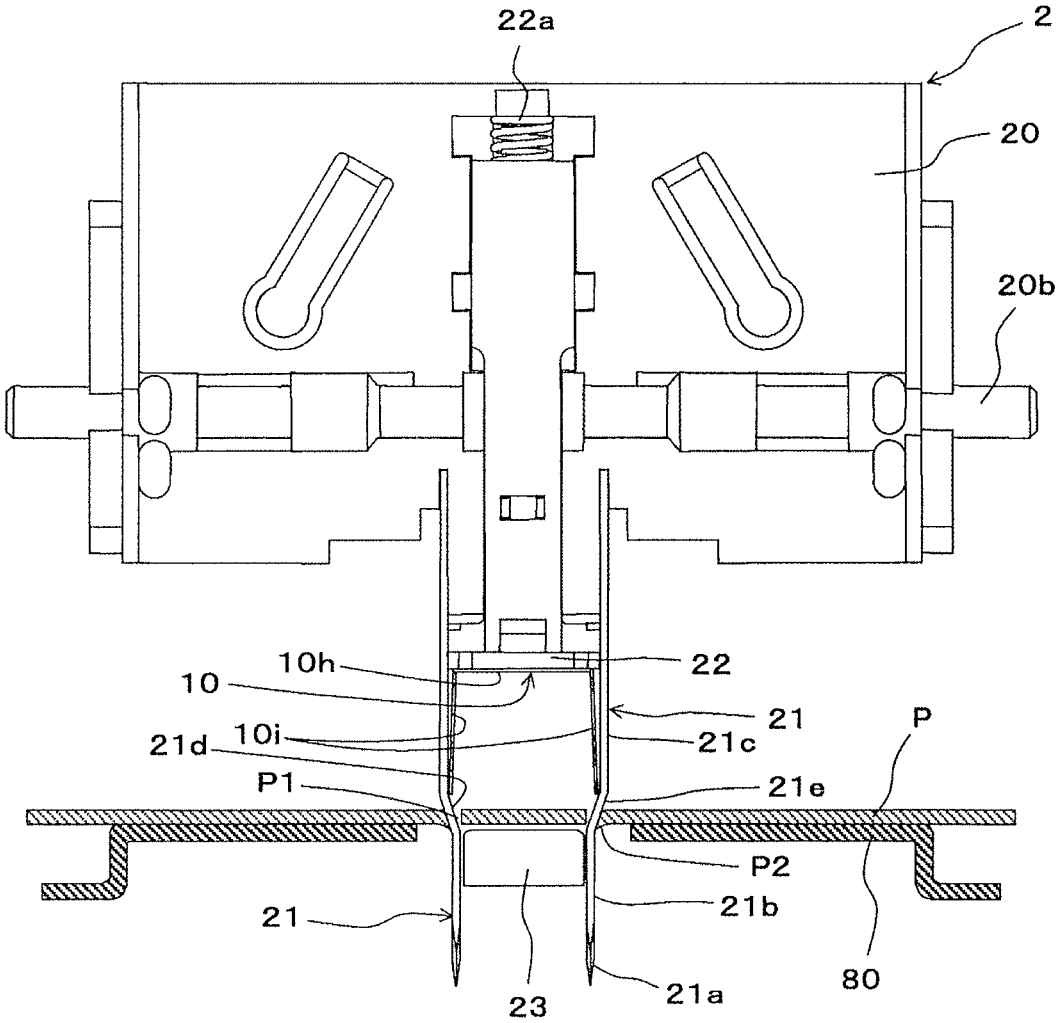
FIG. 21 is an operation chart illustrating an exemplary operation of the penetrating mechanism.

If the penetrating mechanism 2 is further moved down, as illustrated in FIG. 21, the hole expansion portion 21*e* of the cutting blade 21 reaches the paper sheets P. The hole expansion portion 21*e* has the gentle slope so that the outer surface shape of the cutting blade 21 is gradually widened from the first penetrating portion 21*b* to the second penetrating portion 21*c*. Therefore, when the hole expansion portion 21*e* of the cutting blade 21 penetrates the paper sheets P by the lowering movement of the penetrating mechanism 2, the burr P2 is formed at the outside of the hole P1 of the paper sheets P to face downward, so that the hole P1 is widened in an outward direction.

According to the penetrating mechanism 2, in the state in which the crown portion 10*h* of the staple 10 is pushed down by the staple press-down portion 22 between the one pair of cutting blades 21, the leg portion 10*i* of the staple 10 are supported by the staple support portion 21*d*. The staple support portion 21*d* is formed at the inner portion of the hole expansion portion 21*e* in the respective cutting blades 21 by the shape of the cutting blades 21 forming the hole expansion portion 21*e*.

In this way, when the hole expansion portion 21*e* of the cutting blade 21 penetrates the paper sheets P by the lowering movement of the penetrating mechanism 2, the leg portions 10*i* of the staple 10 supported by the staple support portion 21*d* penetrate the hole P1 of the paper sheets P.

Figure 22:
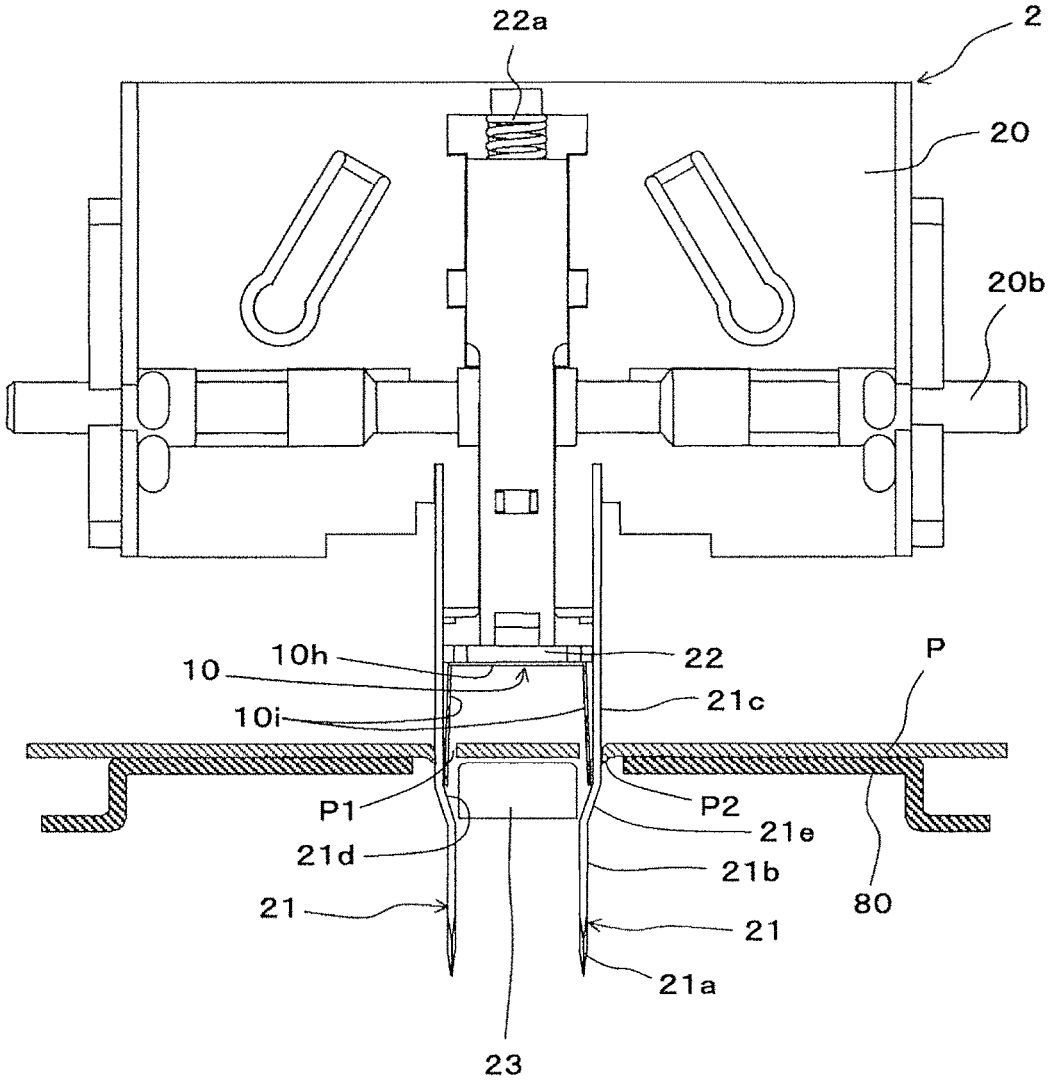
FIG. 22 is an operation chart illustrating an exemplary operation of the penetrating mechanism.

If the penetrating mechanism 2 is further lowered, as illustrated in FIG. 22, the second penetrating portions 21*c* of the cutting blades 21 penetrate the hole P1 of the paper sheets P, and the leg portions 10*i* of the staple 10 supported inside the second penetrating portions 21*c* penetrate the hole P1 of the paper sheets P.

In the process in which the second penetrating portions 21*c* penetrate the hole P1 of the paper sheets P, the force acting on the cutting blade 21 by the penetrating mechanism body 20 coincides with the second penetrating portion 21*c*, the force is not applied to the cutting blade 21 to be inclined inwardly. Therefore, the cutting blade guide 23 is configured to be retracted in the process in which the second penetrating portion 21*c* of the cutting blade 21 penetrates the hole P1 of the paper sheets P.

As described above, since the interval of the two cutting blades 21 is substantially equal to the inner width of the one pair of leg portions 10*i* of the staple 10 which are formed by the first penetrating portion 21*b*, the hole p1 of the paper sheets P formed by the first penetrating portion 21*b* substantially coincides with the position of the leg portion 10*i* of the staple 10.

The burr P2 is formed at the outside of the hole P1 of the paper sheets P to face downward by the stepped portion of the hole expansion portion 21*e* outside each cutting blade 21, so that the hole P1 is widened in the outward direction by the interval through which the overlapped cutting blade 21 and leg portion 10*i* of the staple 10 can pass.

The hole expansion portion 21*e* has the gentle slope so that the outer surface shape of the cutting blade 21 is gradually widened from the first penetrating portion 21*b* to the second penetrating portion 21*c*. Therefore, in the process in which the cutting blade 21 penetrates the paper sheets P, the increase in resistance is suppressed when the hole expansion portion 21*e* of the cutting blade 21 passes the hole P1 of the paper sheets P.

Accordingly, the force required to move the penetrating mechanism 2 down is small, and thus an operating load to push the operating handle 9 down is decreased.

Figure 23:
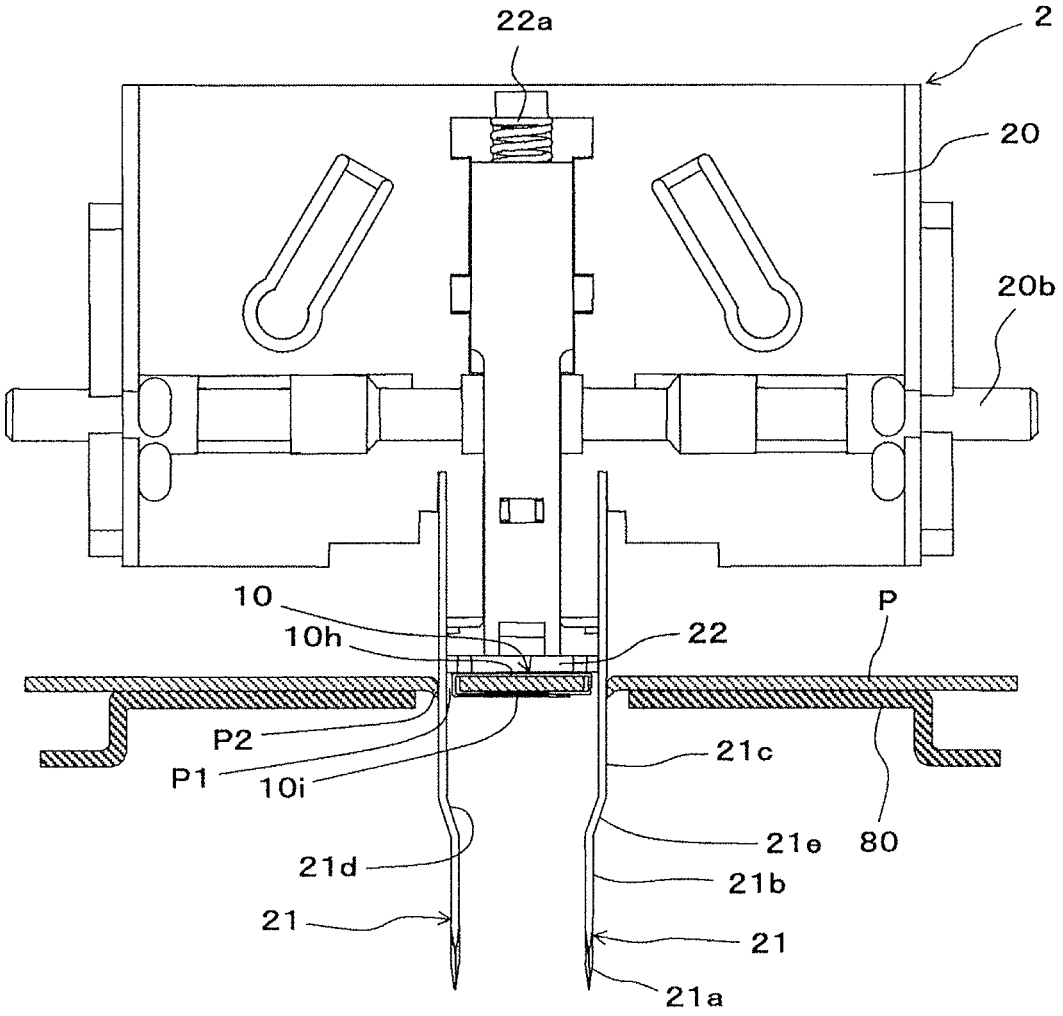
FIG. 23 is an operation chart illustrating an exemplary operation of the penetrating mechanism.

After the penetrating mechanism 2 is further lowered and the crown portion 10*h* of the staple 10 arrives at the paper sheets P, the leg portions 10*i* of the staple 10 are bent inwardly by the operation of the bending mechanism 5 which will be described later, and as illustrated in FIG. 23, the one pair of leg portions 10*i* are bonded.

Since the holes P1 formed in the paper sheets P by the cutting blades 21 are widened outwardly by the hole expansion portions 21*e* so that the overlapped cutting blades 21 and the leg portions 10*i* of the staple 10 can pass the holes, the burr is not formed in the hole P1. Accordingly, when the leg portions 10*i* of the staple 10 are bent inwardly, there is no convex portion to deform the leg portion 10*i*, and thus the appearance of the staple 10 stapling the paper sheets can be improved.

Figure 24:
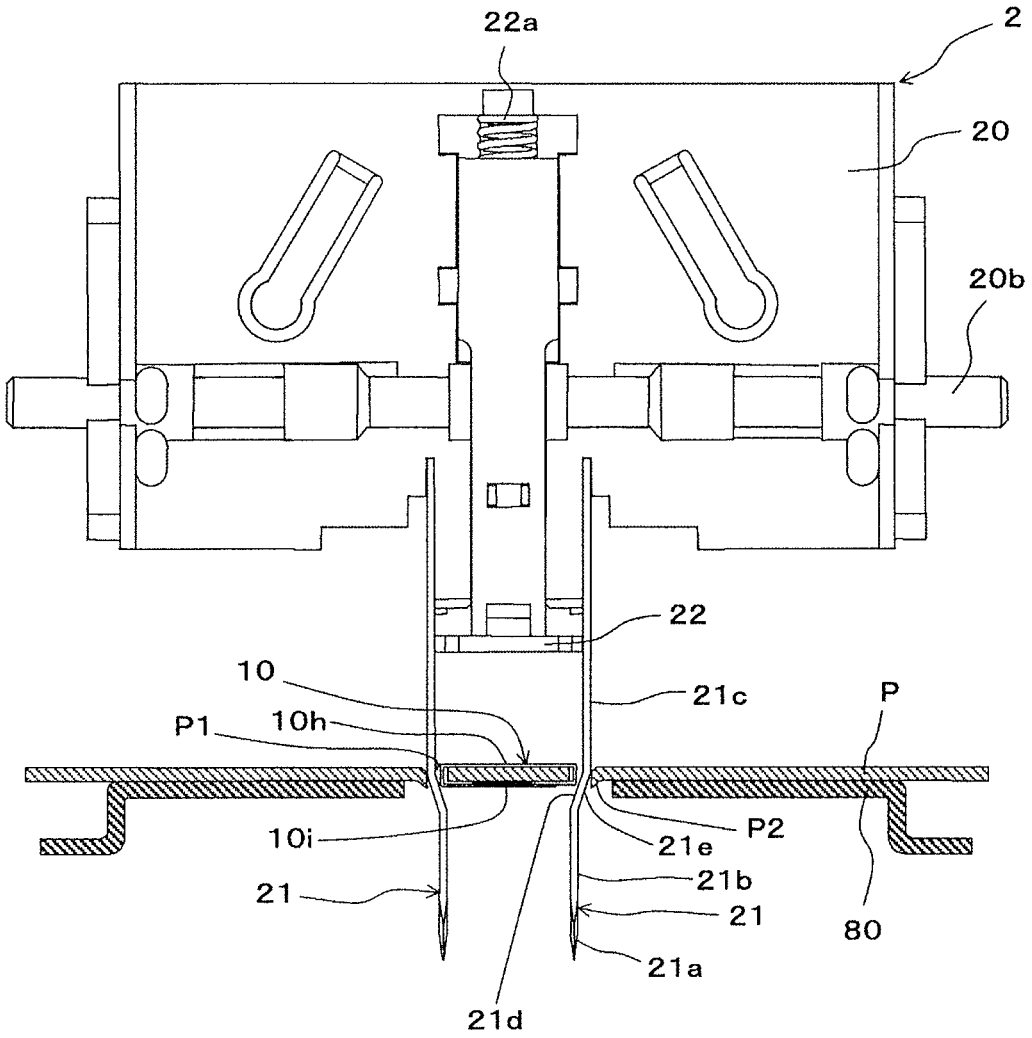
FIG. 24 is an operation chart illustrating an exemplary operation of the penetrating mechanism.

After the paper sheets P are stapled by the staple 10, if the penetrating mechanism 2 is moved up by upward returning of the operation handle 9, and as illustrated in FIG. 24, the staple support portion 21*d* of the cutting blade 21 arrives at the back surface of the paper sheets P.

The staple support portion 21*d* has the gentle slope so that the inner surface shape of the cutting blade 21 is gradually narrowed from the second penetrating portion 21*c* to the first penetrating portion 21*b*. Also, the hole P1 through which the staple 10 stapling the paper sheets P passes is widened outwardly.

When the staple support portion 21*d* is withdrawn from the paper sheets P, the force acts on the cutting blade 21 to widen the blade 21 outwardly. However, since the hole P1 formed by the cutting blade 21 is shaped to be widened outwardly, the resistance is suppressed when the staple support portion 21*d* of the cutting blade 21 passes the hole P1 of the paper sheets P in the process in which the cutting blade 21 is withdrawn from the paper sheets P.

Accordingly, the force required to move the penetrating mechanism 2 up is small, and thus an operating load to return the operating handle 9 is decreased.

Figure 26:
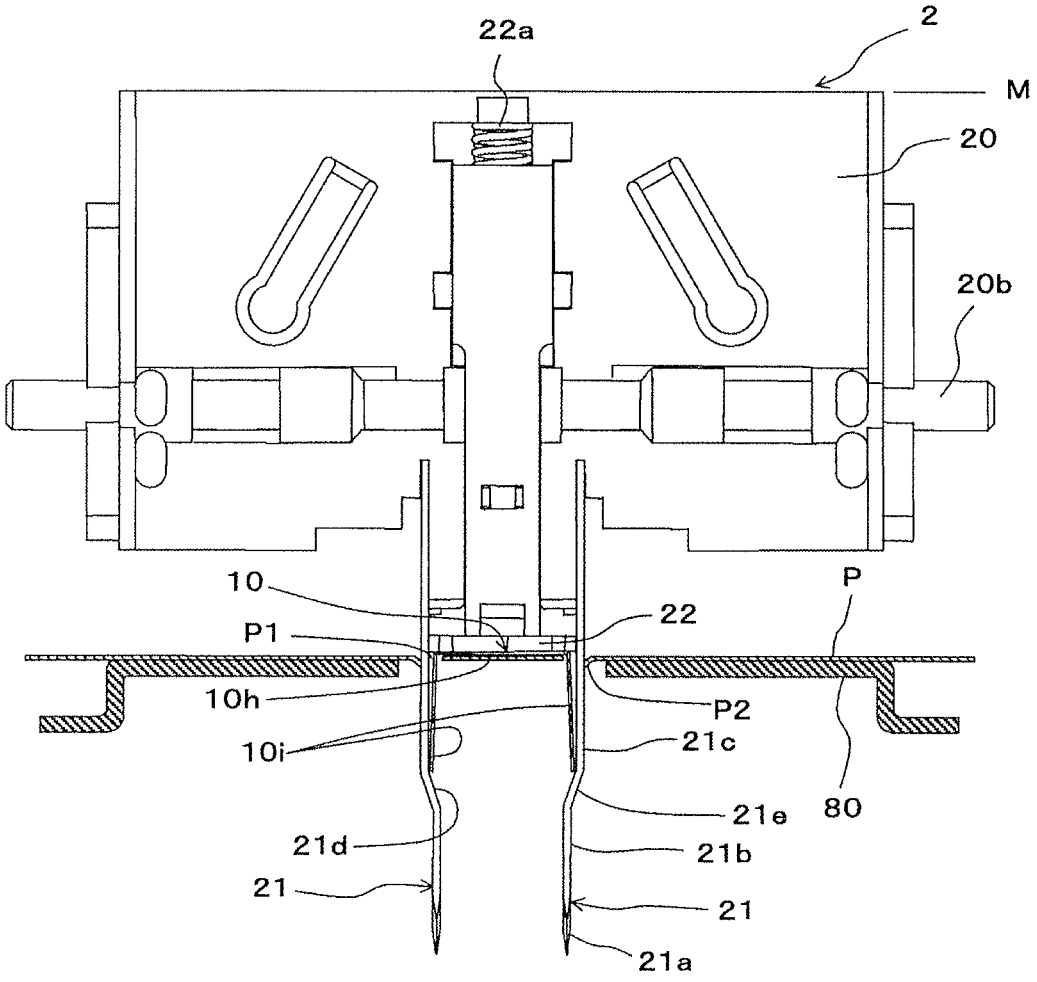
FIG. 26 is an operation chart illustrating an exemplary operation of the penetrating mechanism according to a difference in the number of paper sheets.
Figure 27:
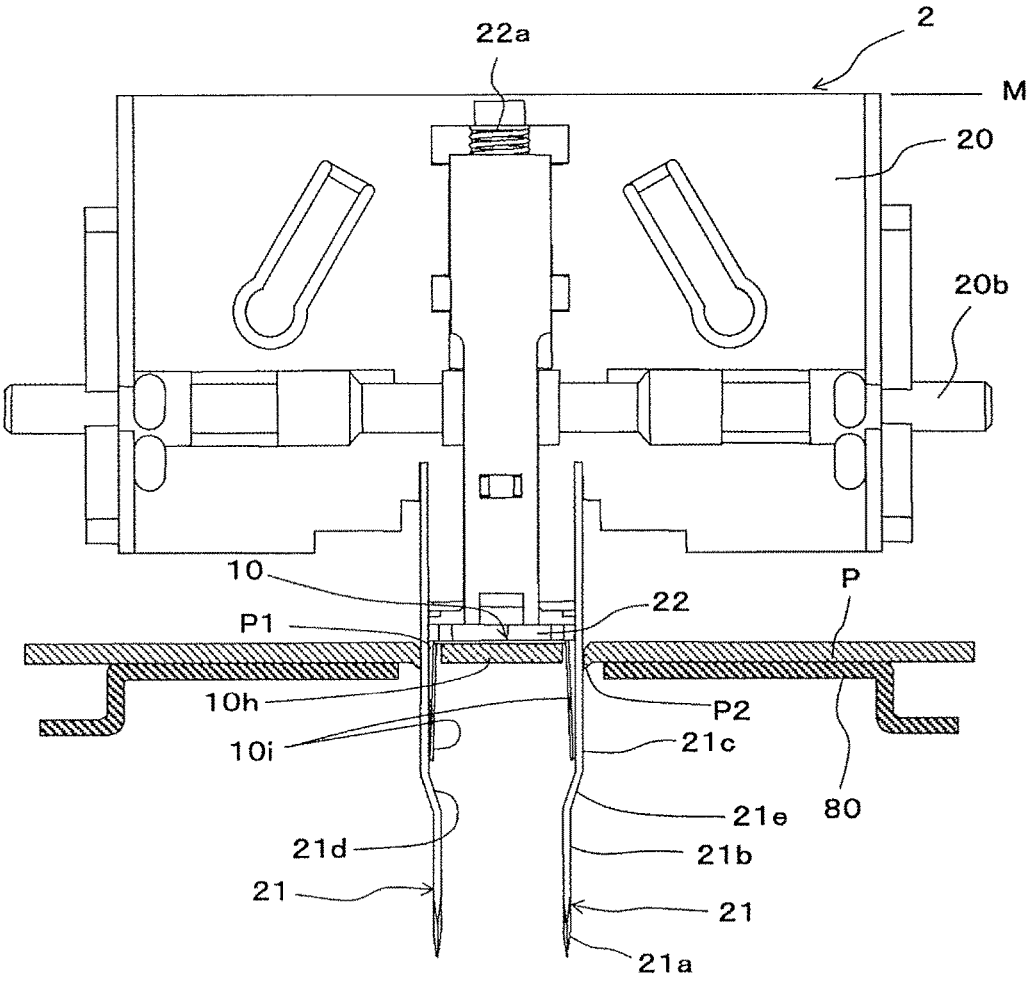
FIG. 27 is an operation chart illustrating an exemplary operation of the penetrating mechanism according to the difference in the number of paper sheets.

FIGS. 26 and 27 are operation charts illustrating an exemplary operation of the penetrating mechanism according to the difference in the number of the paper sheets. The stapler 1 is configured to bind the paper sheets P from n=2 sheets, which is the minimum number of sheets, to the predetermined maximum number of sheets N, for example, N=15 sheets.

After the penetrating mechanism 2 is lowered and the crown portion 10*h* of the staple 10 arrives at the paper sheets P, the operation of the betiding mechanism 5 starts, and thus the leg portions 10*i* of the staple 10 are bent. The lifting movement of the penetrating mechanism 2 and the operation of the bending mechanism 5 are associated, so that the position of the penetrating mechanism 2 to start the operation of the bending mechanism 5 is referred to as a bending mechanism operating position M.

As illustrated in FIG. 26, in the state in which the paper sheets P having the minimum number of stapled sheets n is placed in the paper placing base 80, when the penetrating mechanism 2 is lowered to the bending mechanism operating position M, the staple press-down portion 22 comes into contact with the crown portion 10*h* of the staple 10 at a predetermined lower end position, and thus the crown portion 10*h* presses the paper sheets P.

Meanwhile, as illustrated in FIG. 27, in the state in which the paper sheets P having the maximum number of stapled sheets N are placed in the paper placing base 80, when the penetrating mechanism 2 is lowered to the bending mechanism operating position M, the staple press-down portion 22 compresses the spring 22*a*, and then the spring 22*a* is pushed up to a predetermined upper end position. The staple press-down portion 22 comes into contact with the crown portion 10*h* of the staple 10, and thus the crown portion 10*h* presses the paper sheets P.

In this way, in the penetrating mechanism 2 which pushes down the staple 10 to penetrate the paper sheets P, the staple press-down portion 22 pushing down the crown portion 10*h* of the staple 10 is able to move in the vertical direction in accordance with the moving direction of the penetrating mechanism 2, and is urged downwardly by the spring 22*a*, thereby maintaining the bending mechanism operating position M at a constant height, irrespective of the number of the paper sheets P.

In the case where the staple press-down portion 22 is stationary, the operating position of the bending mechanism is set to the minimum number of paper sheets, and then the maximum number of paper sheets is stapled, the penetrating mechanism is not lowered to the bending mechanism operating position, so that the bending mechanism probably is not operated. Also, in the case where the bending mechanism operating position is set to the maximum number of sheets of paper sheets and then the minimum number of paper sheets is stapled, the crown portion of the staple is not sufficiently pressed.

Whereas, since the staple press-down portion 22 is operated, the penetrating mechanism is lowered to the bending mechanism operating position M, irrespective of the number of paper sheets, and thus the crown portion 10*h* of the staple 10 is sufficiently pressed to operate the bending mechanism 5.

Exemplary Configuration of Cutting/Forming Mechanism

Figure 28:
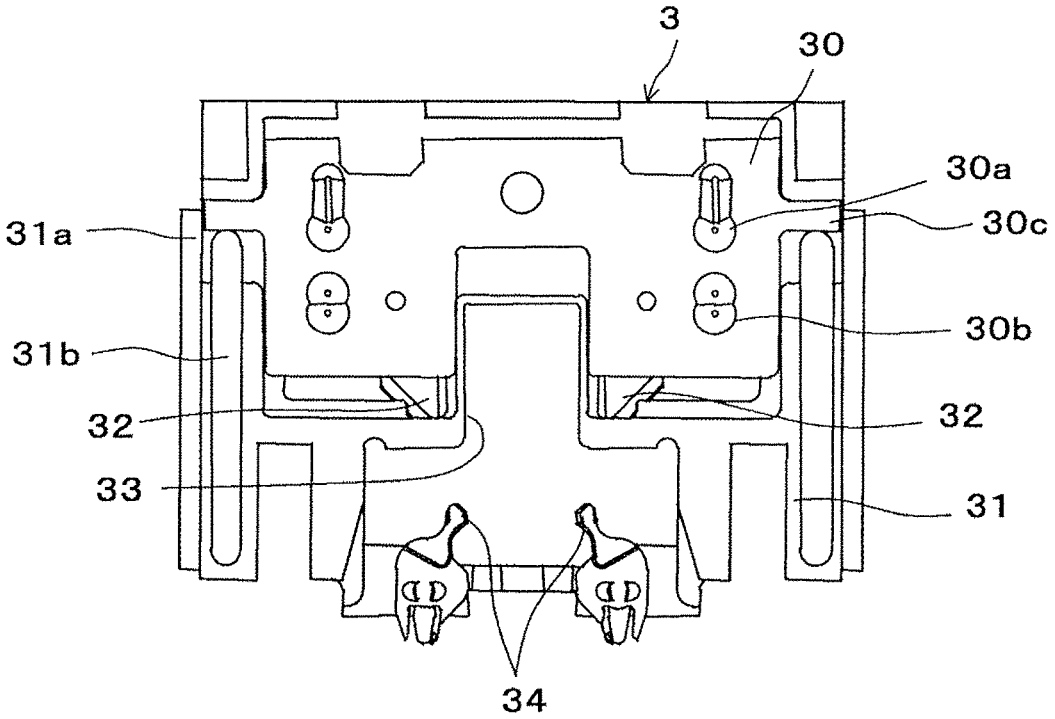
FIG. 28 is a front view illustrating one example of the cutting/forming mechanism.
Figure 29:
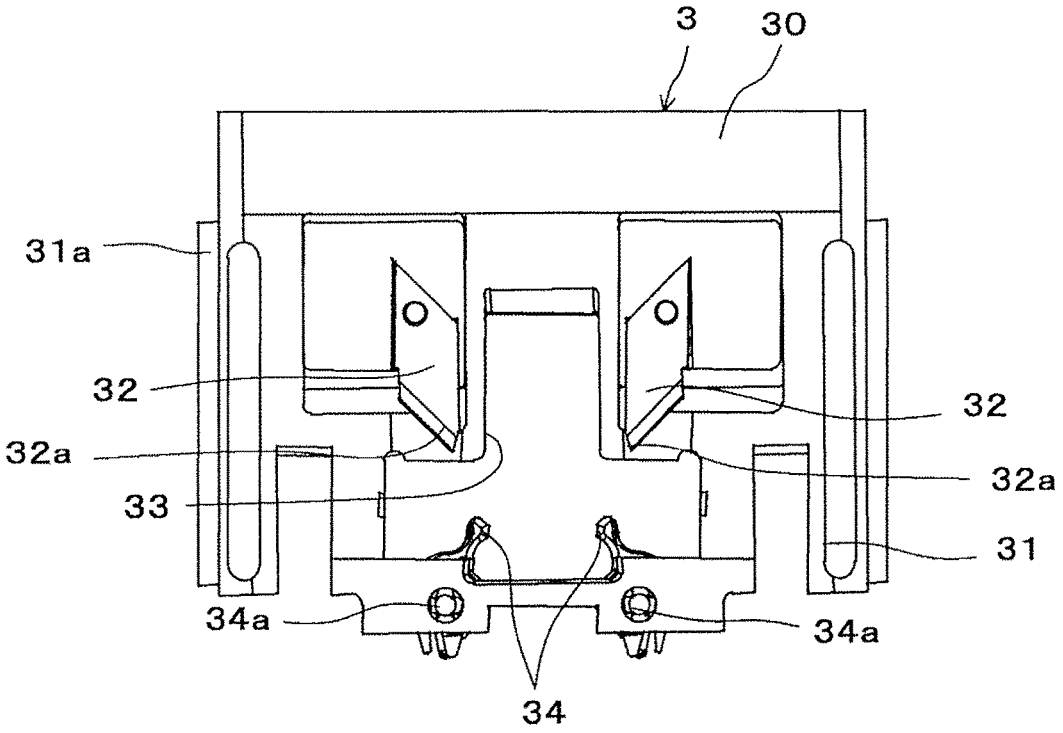
FIG. 29 is a rear view illustrating one example of the cutting/forming mechanism.
Figure 30:
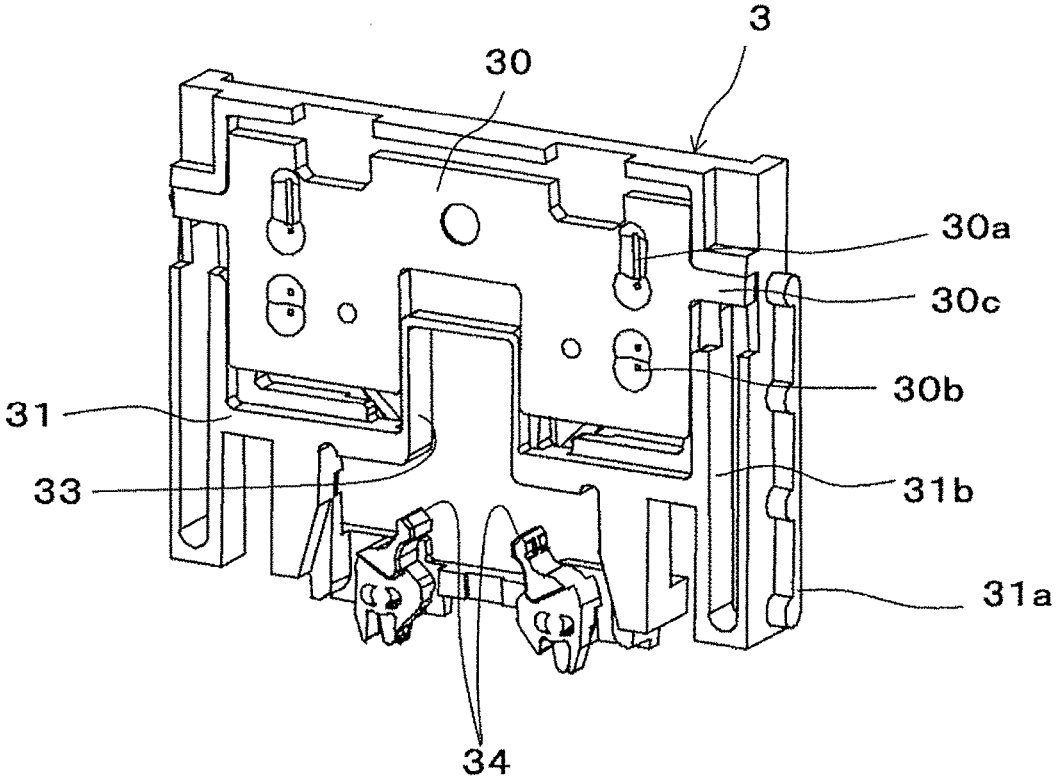
FIG. 30 is a perspective view of the cutting/forming mechanism when seen from a front.
Figure 31:
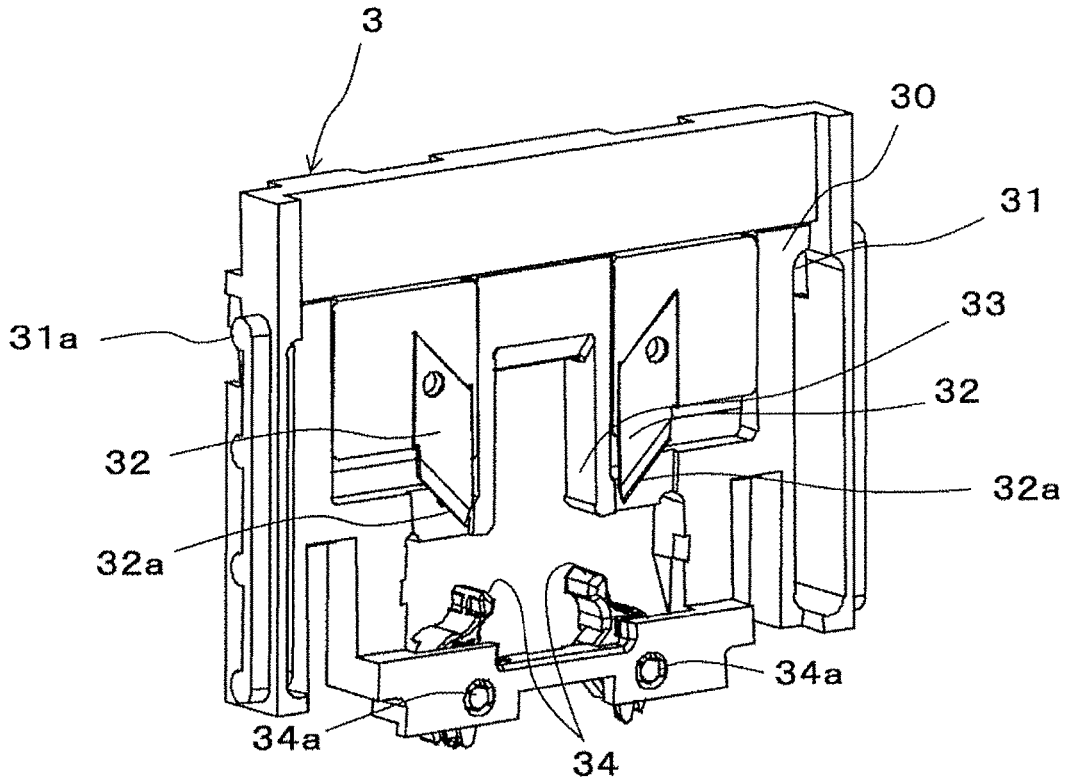
FIG. 31 is a perspective view of the cutting/forming mechanism when seen from a rear.

FIG. 28 is a front view illustrating one example of the cutting/forming mechanism. FIG. 29 is a rear view illustrating one example of the cutting/forming mechanism. FIG. 30 is a perspective view of the cutting/forming mechanism when seen from a front. FIG. 31 is a perspective view of the cutting/forming mechanism when seen from a rear. The configuration of the cutting/forming mechanism 3 will now be described with reference to each drawing.

The cutting/forming mechanism 3 is one example of a cutting/forming part, and includes a cutter plate 30 for cutting the staple-materials-connecting-body 10*a*, and a forming plate 31 for forming the staple material 10 cut by the cutter plate 30 to be the formed staple 10.

The cutter plate 30 has two cutting blades 32, and first groove portions 30*a*, second groove portions 30*b* and convex portions 30*c* which are transmitted with a driving force from the penetrating mechanism 2. The cutter plate 30 is attached to the forming plate 31 in a vertically movable manner.

The cutting blade 32 is one example of a connecting portion cutting blade, and each cutting blade 32 is provided with a blade portion 32*a* which is inclined to its tip end becoming the tip end. Each cutting blade 32 is attached to the cutter plate 30 in a state in which the inclined blade portions 32*a* are faced outwardly.

In each cutting blade 32, an interval between blade edges of the inclined blade portions 32*a* conforms to an interval between the one pair of holes 10*d* of the staple-materials-connecting-body 10*a*. Further, a length of the blade portion 32*a* is set to be longer than that of the connecting portion 10*c* of the staple-materials-connecting-body 10*a*.

In the cutting/forming mechanism 3, the cutting blade 32 is positioned at the rear side of the forming plate 31, and at the retracted position in which the cutter plate 30 is raised with respect to the forming plate 31, the cutting blade 32 is retracted from the forming plate 31, so that the cutting blade 32 is not exposed. At the cutting position in which the cutter plate 30 is lowered with respect to the forming plate 31, the cutting blade 32 protrudes from the forming plate 31.

The first groove portion 30*a* and the second groove portion 30*b* are installed at a predetermined interval in a vertical direction along the moving direction of the penetrating mechanism 2 and the cutting/shaping mechanism 3. The convex portions 30*c* protrude outwardly from both ends of the cutter plate 30 in the widthwise direction.

The first groove portion 30*a* and the second groove portion 30*b* are formed in a desired shape so that the protruding pin 20*c* provided on the penetrating mechanism 2 is fitted into the groove portions. A lower end side of the first groove 30*a* is formed deeply as compared to an upper end side thereof. In the state in which the protruding pin 20*c* is positioned at the lower end side of the first groove portion 30*a*, substantially the entire protruding pin 20*c* is fitted into the first groove portion 30*a*. Further, in the state in which the protruding pin 20*c* is positioned at the upper end side of the first groove portion 30*a*, a portion of the protruding pin 20*c* is fitted into the first groove portion 30*a*.

The second groove portion 30*b* is configured to have the same depth as that of the lower end side of the first groove portion 30*a*, so that substantially the entire protruding pin 20*c* is fitted into the second groove portion 30*b*.

The forming plate 31 has a staple forming portion 33 for forming the staple 10, and opening retaining members 34 for maintaining the shape of the staple 10 formed by the staple forming portion 33. Also, the forming plate 31 has guide convex portions 31*a* for guiding the movement of the cutting/forming mechanism 3, and guide groove portions 31*b* for guiding the movement of the penetrating mechanism 2 and the cutting/shaping mechanism 3.

The staple forming portion 33 is formed in such a way that a length of a depth direction is substantially equal to a width of a short-side direction of the staple 10. The staple forming portion 33 is provided with a convex opening formed by combining an opening which is wider that the width of the staple of a substantially straight type in the longitudinal direction, and an opening which is slightly wider than the outer width of the crown portion 10*h* of the staple 10. The receiving table 16 of the staple cartridge 11 illustrated in FIG. 12 or the like protrudes into the opening of the staple forming portion 33 when the staple cartridge 11 is mounted onto the stapler 1.

The forming plate 31 is provided with one pair of opening retaining members 34 opposite to each other below the staple forming portion 33. The opening retaining members 34 are attached to the forming plate 31 in such a way that they are rotatable around a shaft 34*a*. In association with the vertical movement of the cutting/forming mechanism 3, the opening retaining members 34 are rotated between a position which they are opposite to each other at an interval substantially equal to the outer width of the one pair of leg portions 10*i* of the staple 10 formed by the staple forming portion 33, and a position in which they are opposite to each other at an interval wider than the outer width of the one pair of leg portions 10*i* of the staple 10 formed by the staple forming portion 33.

The guide convex portions 31*a* protrude outwardly from both ends of the forming plate 31 in the widthwise direction, and are engaged with the guide grooves 82*b* which are provided at both sides of the body section 8 of the stapler 1 in the widthwise direction and opened along the moving direction of the cutting/forming mechanism 3. The guide convex portions 31*a* are formed in an elliptical shape which is formed by connecting two semicircles with a straight line, to restrict a posture of the cutting/forming mechanism 3 from being changed in its rotating direction.

The guide groove portions 31*b* are formed by installing grooves, along which the guide convex portions 20*d* provided on the penetrating mechanism 2 are movable, on the surface of the forming plate 31, which is opposite to the penetrating mechanism 2, along the moving direction of the penetrating mechanism 2 and the cutting/forming mechanism 3. The convex portions 30*c* provided on the cutter plate 30 protrude into the guide groove portions 31*b*. The guide convex portions 20*d* provided on the penetrating mechanism 2 abut against the convex portions 30*c*, and thus the cutter plate 30 is pushed up with respect to the forming plate 31 by the lifting movement of the penetrating mechanism 2.

Exemplary Operation of Cutting/Forming Mechanism

FIGS. 32 to 36 are operation charts illustrating the exemplary operation of the cutting/forming mechanism. The process of cutting the staple material 10*m* from the staple-materials-connecting-body 10*a* and forming the staple 10 will now be described with reference to each drawing.

As illustrated in FIG. 1 and so forth, as the staple cartridge 11 is mounted in the cartridge receiving portion 81 of the stapler 1, the receiving table 16 protrudes the staple forming portion 33 of the cutting/forming mechanism 3.

Figure 32:
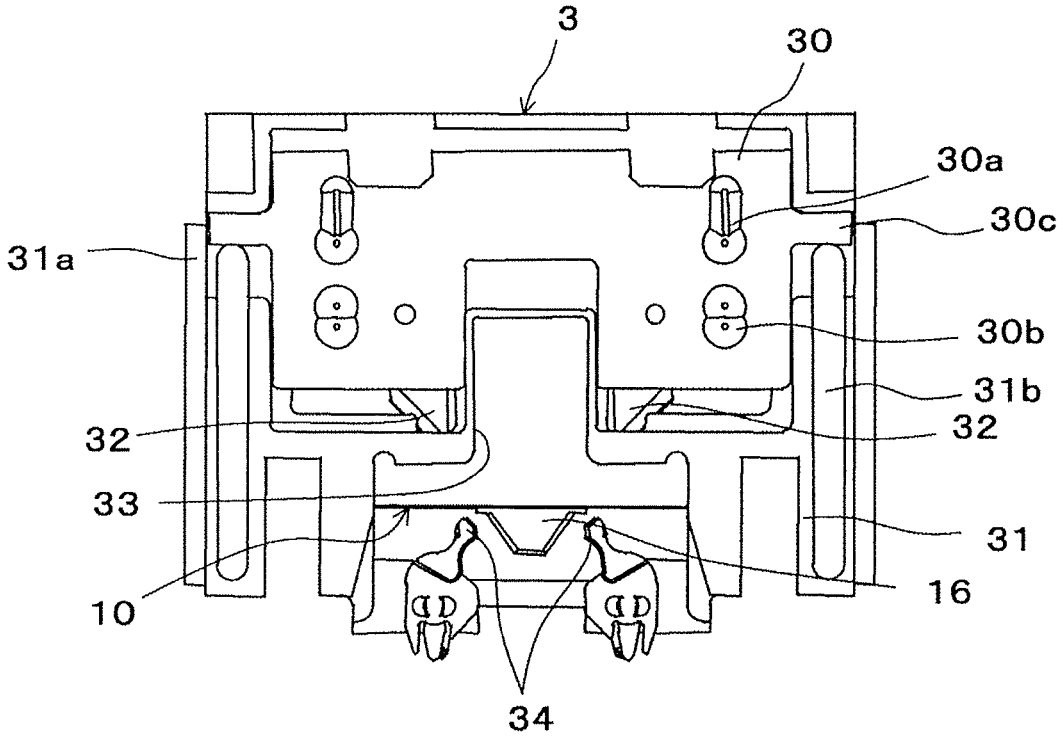
FIG. 32 is an operation chart illustrating an exemplary operation of the cutting/forming mechanism.

In the standby state, as illustrated in FIG. 32, the cutter plate 30 is positioned at the retracted position lifted with respect to the forming plate 31, and the cutting blade 32 is retracted from the forming plate 31, so that the cutting blade 32 is not exposed to the staple forming portion 33.

Further, the staple-materials-connecting-body 10*a* is conveyed to the cutting/forming mechanism 3, and the non-cut staple material 10*m* located at the leading end of the staple-materials-connecting-body 10*a* is supported on the receiving table 16 of the staple cartridge 11 by the staple holding portion 17 in the held state.

In the standby state of the cutting/forming mechanism 3, since the cutting blade 32 is not exposed to the staple forming portion 33, as illustrated in FIG. 6, even though the staple cartridge 11 is disengaged from the stapler 1, the cutting blade 32 is not exposed, thereby securing the high safety.

In the cutting/forming mechanism 3, the lowering movement of the penetrating mechanism 2 which is moved down by the operation of the operating handle 9 illustrated in FIG. 1 and so forth is transmitted to the cutter plate 30 by engagement of the protruding pin 20*c* provided on the penetrating mechanism 2 and the first groove portion 30*a* provided on the cutter plate 30.

Figure 33:
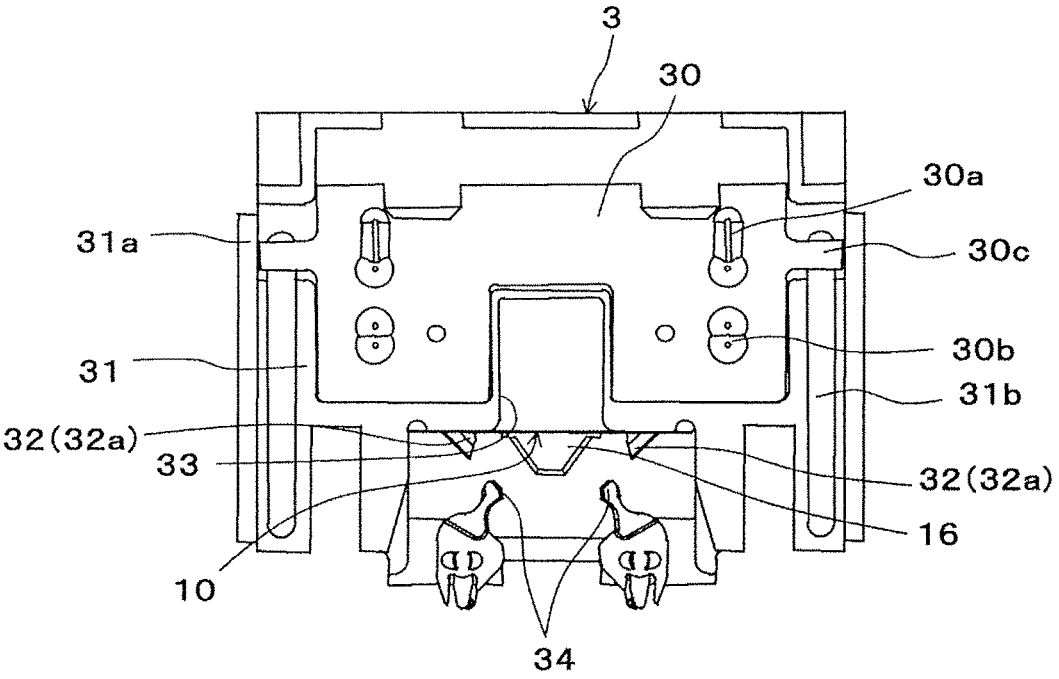
FIG. 33 is an operation chart illustrating an exemplary operation of the cutting/forming mechanism.

Accordingly, the cutter plate 30 is moved to the cutting position lowered with respect to the forming plate 31, and as illustrated in FIG. 33, the cutting blade 32 protrudes from the staple forming portion 33 of the forming plate 31. When the cutting blade 32 protrudes into the staple forming portion 33, the connecting portion 10*c* between the non-cut staple material 10*m* located at the leading end and the next staple material 10*m* is cut by the cutting blade 32 at the staple-materials-connecting-body 10*a* supported by the receiving table 16.

Figure 37A:
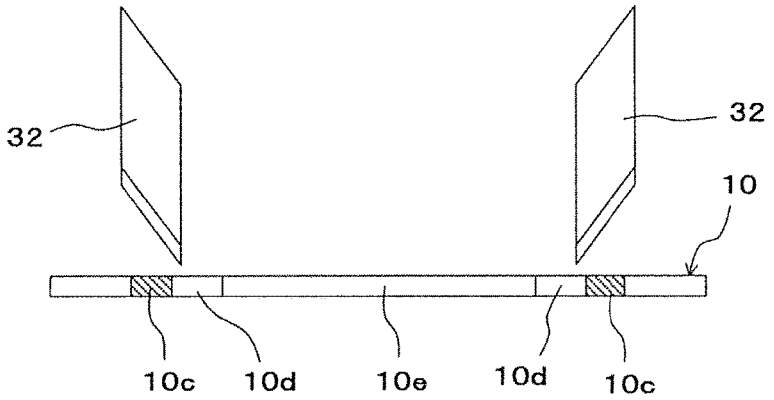
FIGS. 37(*a*) to 37(*c*) illustrate an operation of cutting the staple-materials-connecting-body.
Figure 37B:
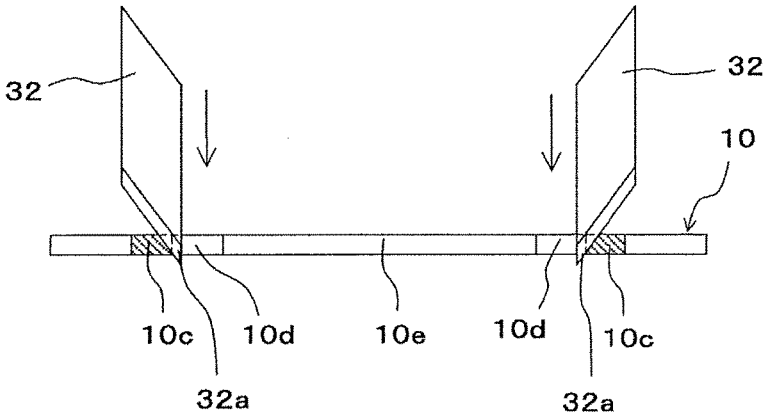
Figure 37C:
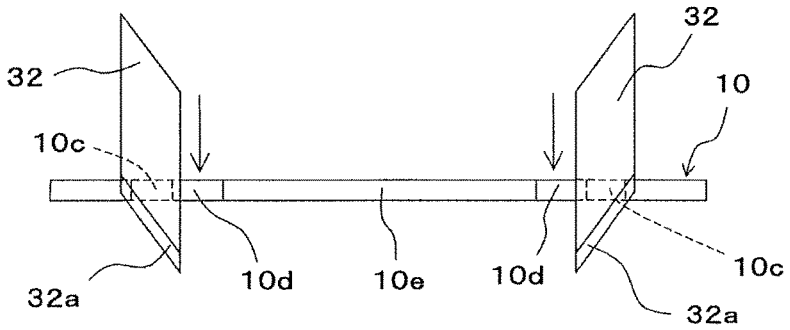

FIG. 37 is an operation chart illustrating the operation of cutting the staple-materials-connecting-body, and shows the cutting of the staple-materials-connecting-body 10*a* by the cutting blade 32 in time series. As illustrated in FIGS. 37(*a*) to 37(*c*), as the one pair of left and right cutting blades 32 are lowered with respect to the staple-materials-connecting-body 10*a*, the blade portion 32*a* of the tip end of each cutting blade 32 is inserted into the hole 10*d*, and thus each connecting portion 10*c* is cut in the hole 10*d*.

As the blade portions 32*a* each inclined outwardly are pushed to the one pair of left and right connecting portions 10*c*, the force is respectively applied the staple material 10*m* to be cut and the next staple material 10*m* in an opposite direction from the inside to the outside along the longitudinal direction, thereby cutting the connecting portion 10*c*. The inner portion of the connecting portions 10*c* between the holes 10*d* is cut by the slit portion 10*e* in advance, and it is not necessary to cut the center portion of the staple material 10*m* which becomes a portion of the leg portion 10*i* and the crown portion 10*h*.

Accordingly, it is not necessary to support the staple material 10*m* to be cut and the next staple material 10*m* in the wide range, and it is possible to cut the staple material 10*m* with high precision by the simple configuration of holding the staple with the staple holding portion 17.

Figure 34:
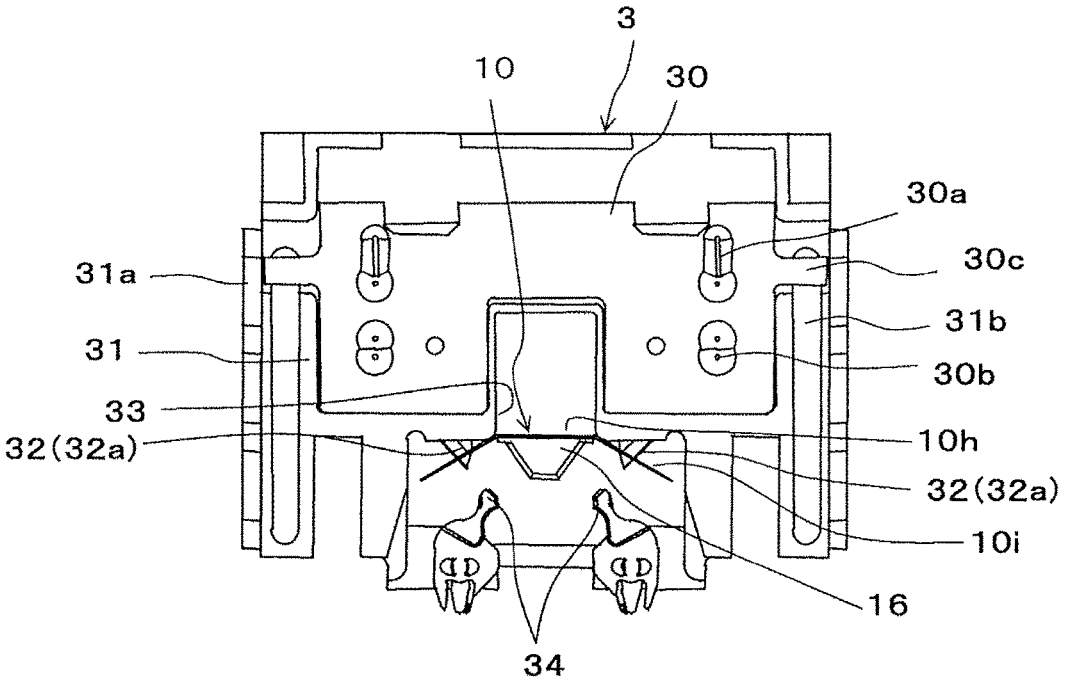
FIG. 34 is an operation chart illustrating an exemplary operation of the cutting/forming mechanism.

If the cutter plate 30 is moved to the cutting position, in association with the lowering movement of the penetrating mechanism 2, the forming plate 31 is lowered together with the cutter plate 30. If the forming plate 31 is lowered, the portion, corresponding to the crown portion 10*h*, of the cut staple material 10*m* located at the leading end, is supported by the receiving table 16, and as illustrated in FIG. 34, the portions corresponding to the leg portions 10*i* start bending in the first direction.

Figure 35:
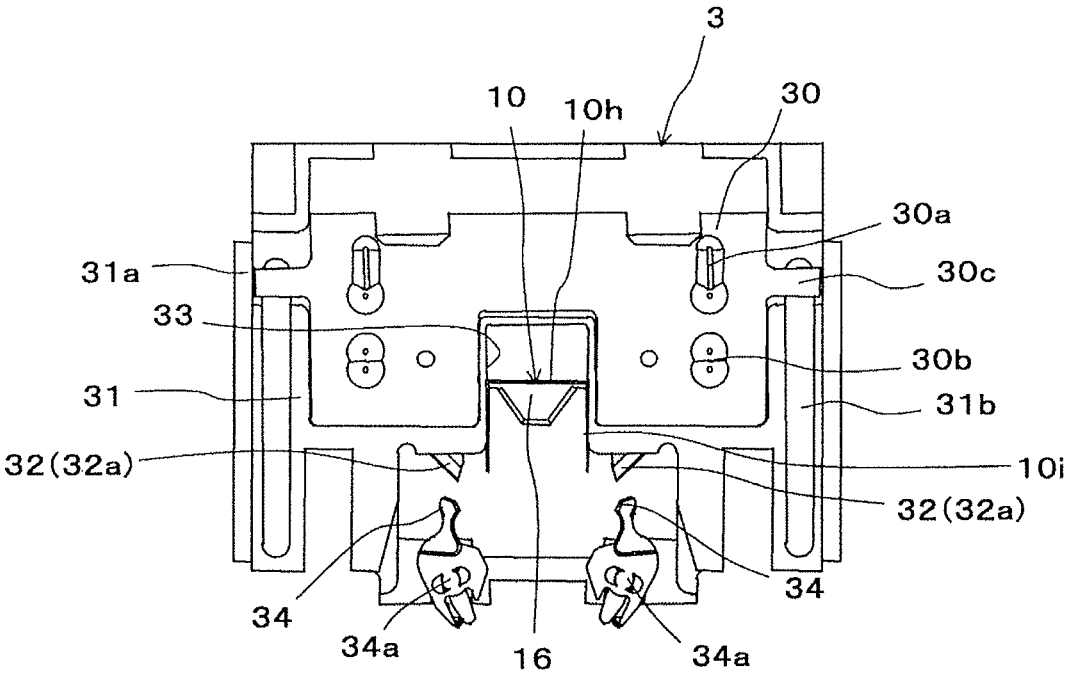
FIG. 35 is an operation chart illustrating an exemplary operation of the cutting/forming mechanism.

If the forming plate 31 is further lowered, as illustrated in FIG. 35, the staple material 10*m* located at the leading end is bent in the first direction so that the one pair of leg portions 10*i* are substantially parallel to each other, thereby forming the crown portion 10*h* and the leg portions 10*i*. Thus, the staple 10 having the crown portion 10*h* and bent leg portions 10*i* is formed. Also, as the forming plate 31 is lowered, in association with the bending operation of the leg portions 10*i* of the staple material 10*m* in the first direction, the opening retaining members 34 are rotated around the shaft 34*a* to be opened.

After the forming of the staple 10 by the cutting/forming mechanism 3 is completed, the penetrating mechanism 2 is further lowered while the cutting/forming mechanism 3 is stationary, and thus the protruding pin 20*c* provided on the penetrating mechanism 2 is away from the first groove portion 30*a* provided on the cutter plate 30 and is engaged into the second groove portion 30*b*.

In the cutting/forming mechanism 3, the movement of the penetrating mechanism 2 which is moved up by the upward returning movement of the operating handle 9 is transmitted to the cutter plate 30 by the engagement of the protruding pin 20*c* provided on the penetrating mechanism 2 and the second groove portion 30*b* provided on the cutter plate 30.

Accordingly, after the cutter plate 30 is moved to the retracted position lifted with respect to the forming plate 31, the forming plate 31 is lifted together with the cutter plate 30. If the forming plate 31 is lifted, the formed staple 10 is withdrawn from the staple forming portion 33. Also, as the forming plate 31 is lifted, the opening retaining members 34 are rotated around the shaft 34*a* to be closed.

As the forming plate 31 is lifted, the leg portions 10*i* may be deformed in the opening direction by the resilience of the material of the staple 10 while the formed staple 10 is withdrawn from the staple forming portion 33. If the interval between the opening retaining members 34 is constant, the opening retaining members collide with the leg portions 10*i* deformed in the opening direction, as the forming plate 31 is lifted.

Figure 36:
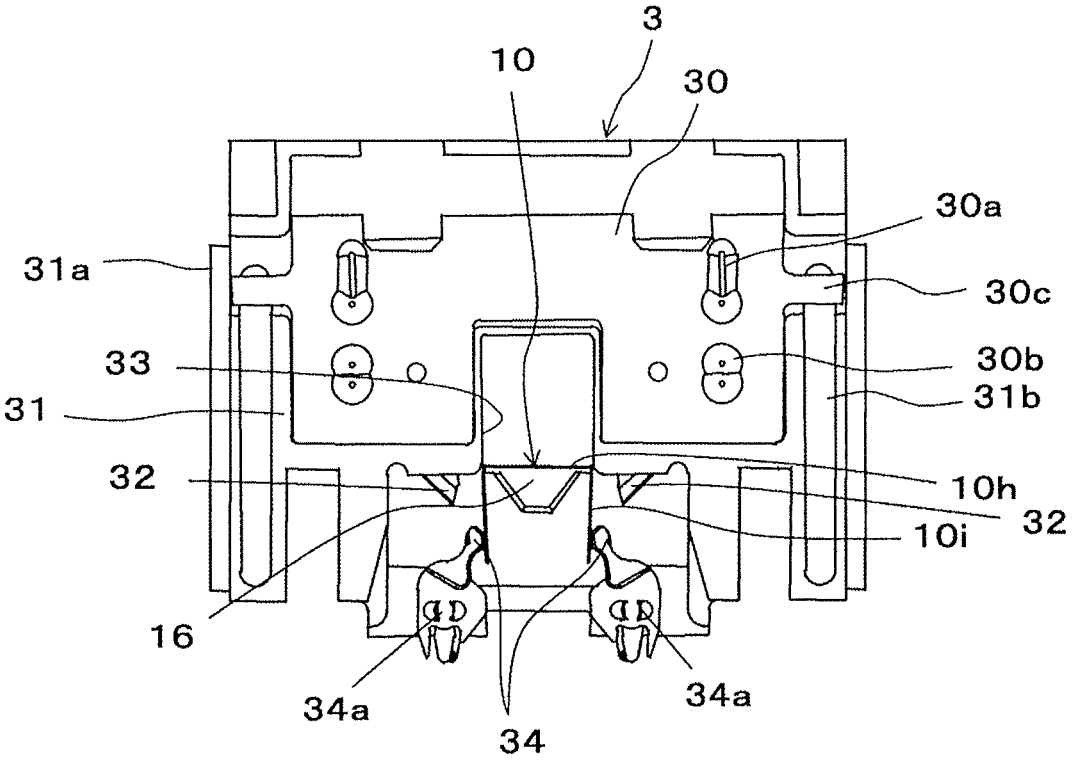
FIG. 36 is an operation chart illustrating an exemplary operation of the cutting/forming mechanism.

Since the opening retaining members 34 are able to be opened or closed by the lifting movement of the forming plate 31, as illustrated in FIG. 36, when the forming plate 31 is lifted and the formed staple 10 is withdrawn from the staple forming portion 33, the opening retaining members 34 are lifted in the open state to the outsides of the one pair of leg portions 10*i*, and thus the opening retaining members 34 are closed, so that the leg portions 10*i* are maintained in the state being bent in the first direction.

Accordingly, there is no operation failure due to that the opening retaining members 34 collide with the leg portions 10*i* of the staple 10 by the lifting movement of the forming plate 31. The staple 10 formed in the desired shape by the cutting/forming mechanism 3 can be conveyed to the penetrating mechanism 2.

Exemplary Configuration of Paper Holding Mechanism

The configuration of the paper holding mechanism 4 will now be described with reference to each drawing. The paper holding mechanism 4 is one example of a paper holding part, and includes a paper holding plate 40 for holding the paper sheets P placed in the paper placing base 80 illustrated in FIG. 1 and so forth, and a spring 41 for biasing the paper holding plate 40. Also, the paper holding mechanism 4 includes guide convex portions 42*a* for guiding the movement of the paper holding plate 40, and guide groove portions 42*b* for guiding the movement of the penetrating mechanism 2 and the paper holding mechanism 4.

The guide convex portions 42*a* protrude outwardly from both ends of the paper holding plate 40 in the widthwise direction, and are engaged with the guide grooves 82*c* which are provided at both sides of the body section 8 of the stapler 1 in the widthwise direction and opened along the moving direction of the paper holding mechanism 4. The guide convex portions 42*a* are formed in an elliptical shape which is formed by connecting two semicircles with a straight line, to restrict a posture of the paper holding mechanism 4 from being changed in its rotating direction.

The guide groove portions 42*b* are formed by installing grooves, along which the guide convex portions 20*e* provided on the penetrating mechanism 2 are movable, on the rear surface of the paper holding plate 40, which is opposite to the penetrating mechanism 2, along the moving direction of the penetrating mechanism 2 and the paper holding mechanism 4.

In the paper holding mechanism 4, the guide convex portions 20*e* of the penetrating mechanism 2 abut against the guide groove portions 42*b* to restrict the movement of the paper holding plate 40, and in association with the lowering movement of the penetrating mechanism 2, the paper holding plate 40 is urged downwardly by the spring 41, and thus protrudes into the paper placing base 80 to hold the paper sheets P.

The guide convex portions 20*e* of the penetrating mechanism 2 abut against the guide groove portions 42*b* by the lifting movement of the penetrating mechanism 2, and the paper holding plate 40 is pushed up by the lifting movement of the penetrating mechanism 2, and thus is retracted from the paper placing base 80.

Exemplary Configuration of Bending Mechanism

Figure 38A:
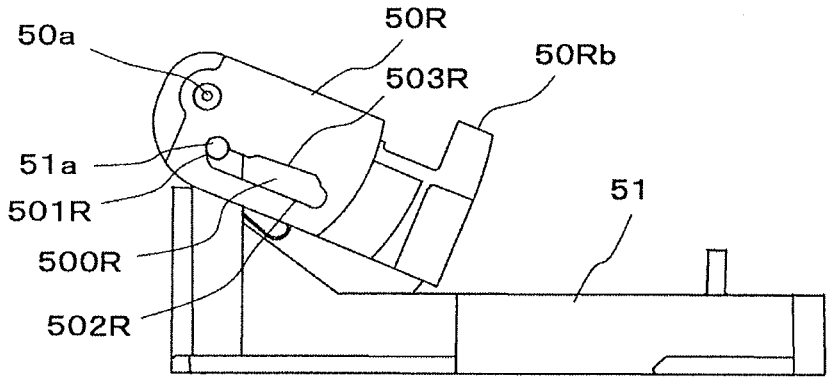
FIGS. 38(*a*) to 38(*b*) illustrate an example of a bending mechanism.
Figure 38B:
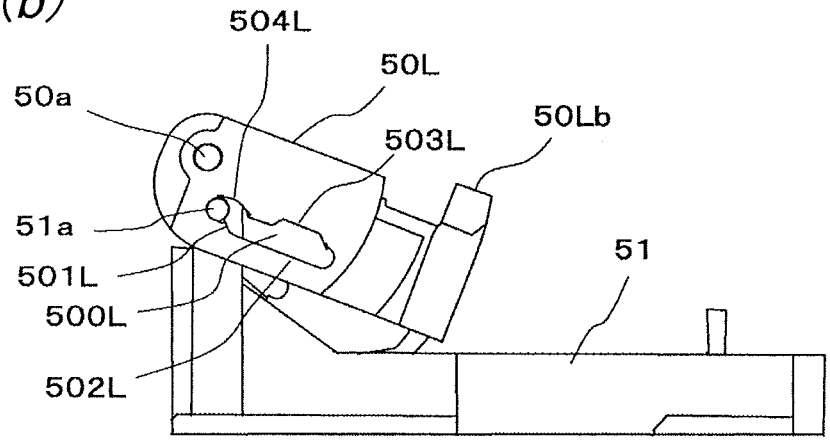
Figure 38C:
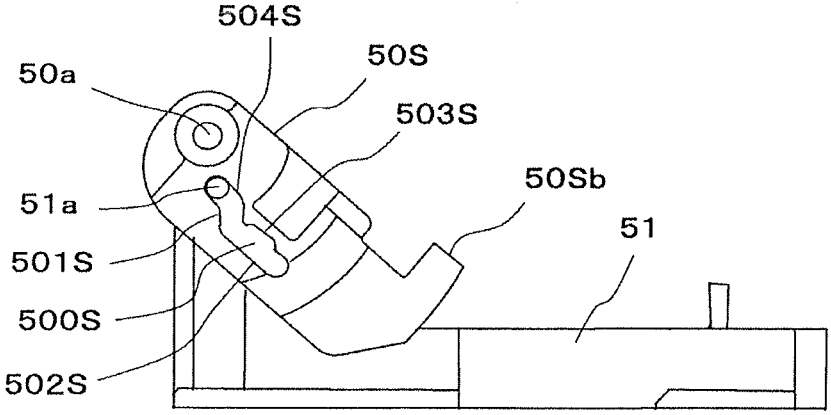
Figure 39A:
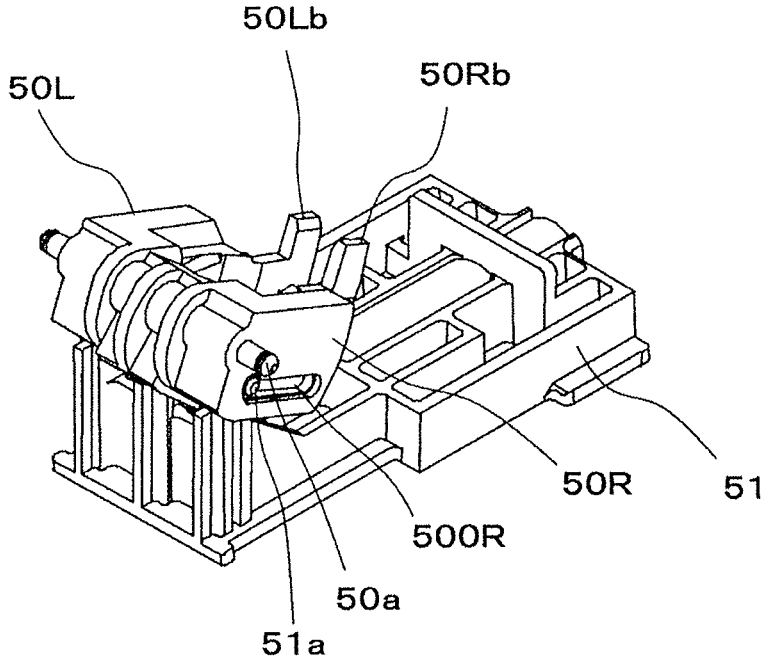
FIGS. 39(*a*) and 39(*b*) are perspective views illustrating an example of the bending mechanism.
Figure 39B:
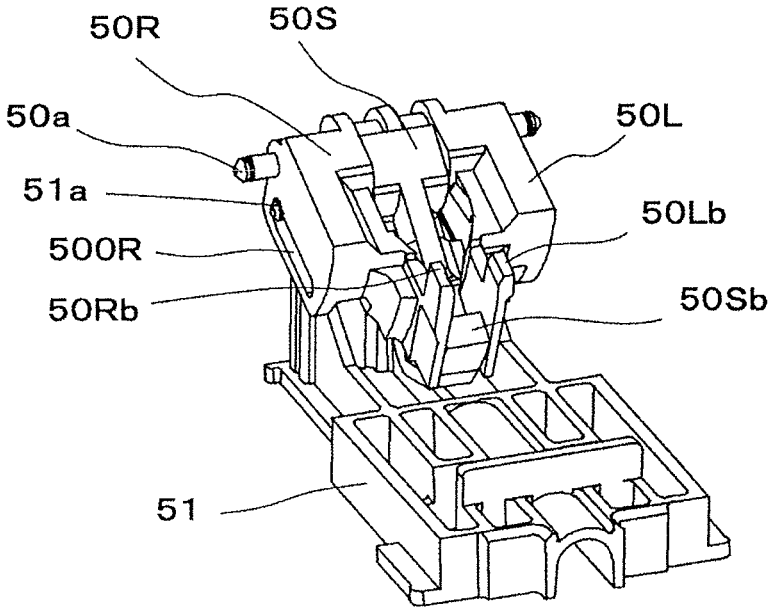

FIG. 38 is a side view illustrating one example of the bending mechanism, and FIGS. 39(*a*) and 39(*b*) are perspective views illustrating one example of the bending mechanism. The configuration of the bending mechanism 5 for bending the leg portions 10*i* of the staple 10 penetrating the paper sheets P will now be described with reference to each drawing.

The bending mechanism 5 is one example of a bending part, and includes a bending member for bending a pair of leg portions 10*i* of the staple 10 penetrating the paper sheets P, that is, a first bending member 50R for bending one leg portion 10*i* of the staple 10 penetrating the paper sheets P, a second bending member 50L for bending the other leg portion 10*i* of the staple 10 penetrating the paper sheets P, and a bonding member 50S for bonding the one leg portion 10*i* and the other leg portion 10*i*.

The first bending member 50R has one end portion along an extending direction which is rotatably supported on the shaft 50*a* installed to the body. Further, the first bending member 50R has a bending portion 50Rb, for bending the leg portion 10*i* of the staple 10, at the other end portion along the extending direction. Therefore, as the first bending member 50R is rotated around the shaft 50*a* as a fulcrum, the bending portion 50Rb is moved vertically.

The second bending member 50L has one end portion along the extending direction which is rotatably supported on the shaft 50*a* coaxially with the first bending member 50R. Further, the second bending member 50L has a bending portion 50Lb, for bending the leg portion 10*i* of the staple 10, at the other end portion along the extending direction. Therefore, as the second bending member 50L is rotated around the shaft 50*a* as a fulcrum, the bending portion 50Lb is moved vertically.

The bonding member 50S has one end portion along the extending direction which is rotatably supported on the shaft 50*a* coaxially with the first bending member 50R and the second bending member 50L. Further, the bonding member 50S has a bending portion 50Sb, for bonding one leg portion 10*i* and the other leg portion 10*i* of the staple 10, at the other end portion along the extending direction. Therefore, as the bonding member 50S is rotated around the shaft 50*a* as a fulcrum, the bonding portion 50Sb is moved vertically.

The bending mechanism 5 includes a push-up member 51 for pushing up the first bending member 50R, the second bending member 50L, and the bonding member 50S. The push-up member 51 is one example of a driving force transmitting section, and is attached to the body section 8 in a state in which it is able to be slid in a forward/rearward direction. By the horizontal movement of the push-up member 51 with respect to the body section 8, the first bending member 50R, the second bending member 50L, and the bonding member 50S are pushed up.

The first bending member 50R is provided with a cam groove 500R for receiving the shaft 51*a* installed to the push-up member 51, and the cam groove 500R converts the horizontal movement of the push-up member 51 into rotation of the first bending member 50R, as illustrated in FIG. 38(*a*).

As one example of a driving force transmitting portion, the cam groove 500R has a rotation groove portion 501R for rotating the first bending member 50R by the movement of the shaft 51*a* caused by the horizontal movement of the push-up member 51, and a holding groove portion 502R for holding the first bending member 50R in a desired direction against the movement of the shaft 51*a* of the push-up member 51.

The rotation groove portion 501R is formed as a groove having a desired width, through which the shaft 51*a* of the push-up member 51 passes, and inclined in the extension direction of the first bending member 50R. The holding groove portion 502R is formed as a groove having a desired width, through which the shaft 51*a* of the push-up member 51 passes, and shaped along the extension direction of the first bending member 50R. A retraction portion 503R is formed by widening the width of the holding portion 502R except for both end portions thereof along the extension direction.

Specifically, the cam groove 500R is provided with the rotation groove portion 501R formed at one end side of the first bending member 50R, and the holding groove portion 502R formed to be consecutive from the rotation groove portion 501R, so that the cam groove extends from one end side of the first bending member 50R to the other end side thereof.

The second bending member 50L is provided with a cam groove 500L for receiving the shaft 51*a* of the push-up member 51, and the cam groove 500L converts the horizontal movement of the push-up member 51 into rotation of the second bending member 50L, as illustrated in FIG. 38(*b*).

As one example of the driving force transmitting portion, the cam groove 500L has a standby groove portion 504L for retaining the second bending member 50L in a desired direction against the movement of the shaft 51*a* of the push-up member 51, a rotation groove portion 501L for rotating the second bending member 50L by the movement of the shaft 51*a* of the push-up member 51, and a holding groove portion 502L for holding the second bending member 50L in a desired direction against the movement of the shaft 51*a* of the push-up member 51.

The standby groove portion 504L is formed as a groove having a desired width, through which the shaft 51*a* of the push-up member 51 passes, and shaped along the extension direction of the second bending member 50L. The rotation groove portion 501L is formed as a groove having a desired width, through which the shaft 51*a* of the push-up member 51 passes, and inclined in the extension direction of the second bending member 50L.

The holding groove portion 502L is formed as a groove having a desired width, through which the shaft 51*a* of the push-up member 51 passes, and shaped along the extension direction of the second bending member 50L. A retraction portion 503L is formed by widening the width of the holding portion 502L except for both end portions thereof along the extension direction.

Specifically, the cam groove 500L is provided with the standby groove portion 504L formed at one end side of the second bending member 50L, and the rotation groove portion 501L formed to be consecutive from the rotation groove portion 501L, so that the cam groove extends from one end side of the second bending member 50L to the other end side thereof.

The bonding member 50S is provided with a cam groove 500S for receiving the shaft 51*a* of the push-up member 51, and the cam groove 500S converts the horizontal movement of the push-up member 51 into rotation of the bonding member 50S, as illustrated in FIG. 38(*c*).

As one example of the driving force transmitting portion, the cam groove 500S has a standby groove portion 504S for retaining the bonding member 50S in a desired direction against the movement of the shaft 51*a* of the push-up member 51, a rotation groove portion 501S for rotating the bonding member 50S by the movement of the shaft 51*a* of the push-up member 51, and a holding groove portion 502S for holding the bonding member 50S in a desired direction against the movement of the shaft 51*a* of the push-up member 51.

The standby groove portion 504S is formed as a groove having a desired width, through which the shaft 51*a* of the push-up member 51 passes, and shaped along the extension direction of the bonding member 50S. The rotation groove portion 501S is formed as a groove having a desired width, through which the shaft 51*a* of the push-up member 51 passes, and inclined in the extension direction of the bonding member 50S.

The holding groove portion 502S is formed as a groove having a desired width, through which the shaft 51*a* of the push-up member 51 passes, and shaped along the extension direction of the bonding member 50S. A retraction portion 503S is formed by widening the width of the holding portion 502S except for both end portions thereof along the extension direction.

Specifically, the cam groove 500S is provided with the standby groove portion 504S formed at one end side of the bonding member 50S, and the rotation groove portion 501S formed to be consecutive from the standby groove portion 504S, so that the cam groove extends from one end side of the bonding member 50S to the other end side thereof.

According to the bending mechanism 5, when the stapler 1 is seen from the front, the first bending member 50R is disposed at the right side of the bonding member 50S, and the second bending member 50L is disposed at the left side. The first bending member 50R, the second bending member 50L, and the bonding member 50S are coaxially supported by the shaft 50*a*.

Further, according to the bending mechanism 5, the cam groove 500R of the first bending member 50R, the cam groove 500L of the second bending member 50L, and the cam groove 500S of the bonding member SOS are overlapped with each other in an arrangement direction of the first bending member 50R, the second bending member 50L, and the bonding member 50S, and the shaft 51*a* of the push-up member 51 comes in each cam groove.

The bending mechanism 5 operates the first bending member 50R, the second bending member 50L, and the bonding member 50S at different timing according to the movement of the push-up member 51.

In this embodiment, first, the bending mechanism 5 rotates the first bending member 50R to bend one leg portion 10*i* of the staple 10 by the first bending member 50R. Next, the bending mechanism stops the rotation of the first bending member 50R, and simultaneously increases a rotation amount of the second bending member 50L to bend the other leg portion 10*i* of the staple 10 by the second bending member 50L.

Subsequent, the bending mechanism stops the rotation of the second bending member 50L, and simultaneously increases a rotation amount of the bonding member 50S to bond the one leg portion 10*i* and the other leg portion 10*i* of the staple 10 by the bonding member 50S.

For this reason, the cam groove 500R of the first bending member 50R is not provided with the standby groove portion. By contrast, the cam groove 500L of the second bending member 50L is provided with the standby groove portion 504L, and the cam groove 500S of the bonding member 50S is provided with the standby groove portion 504S.

According to the bending mechanism 5, therefore, the shaft 51*a* of the push-up member 51 passes through the standby groove 504L of the cam groove 500L of the second bending member 50L at a timing at which the shaft 51*a* of the push-up member 51 passes through the rotation groove portion 501R of the cam groove 500R of the first bending member 50R.

The rotation amount of the second bending member 50L is suppressed to be decreased at the timing of starting the rotation of the first bending member 50R by making the rotation amounts of the first bending member 50R and the second bending member 50L different.

The standby groove portion 504S of the cam groove 500S of the bonding member 40S is formed to be longer than the standby groove portion 504L of the cam groove 500L of the second bending member 50L.

Accordingly, at the timing at which the shaft 51*a* of the push-up member 51 passes through the rotation groove portion 501L of the cam groove 500L in the second bending member 50L, the shaft 51*a* passes though the standby groove portion 504S of the cam groove 500S in the bonding member 50S.

As the rotation amounts of the second member 50L and the bonding member 50S are set to be different from each other, the rotation amount of the bonding member 50S is suppressed to be decreased at the timing at which the rotation amount of the second bending member 50L is increased.

Further, the holding groove portion 502R of the cam groove 500R of the first bending member 50R is formed to be longer than the holding groove portion 502L of the cam groove 500L of the second bending member 50L.

Accordingly, at the timing at which the shaft 51*a* of the push-up member 51 passes through the holding groove portion 502R of the cam groove 500R in the first bending member 50R, the shaft 51*a* passes though the rotation groove portion 501L of the cam groove 500L in the second bending member 50L.

The rotation amount of the second member 50L is increased at the timing at which the rotation of the first bending member 50R is stopped.

Further, the holding groove portion 502L of the cam groove 500L of the second bending member 50L is formed to be longer than the holding groove portion 502S of the cam groove 500S of the bonding member 50S.

Accordingly, at the timing at which the shaft 51*a* of the push-up member 51 passes through the holding groove portion 502L of the cam groove 500L in the second bending member 50L, the shaft 51*a* passes though the rotation groove portion 501S of the cam groove 500S in the bonding member 50S.

The rotation amount of the bonding member 50S is increased at the timing at which the rotation of the second bending member 50L is stopped.

The bending mechanism 5 transmits the movement of the operating handle 9 to the push-up member 51 which operates the first bending member 50R, the second bending member 50L and the bonding member 50S.

Figure 40:
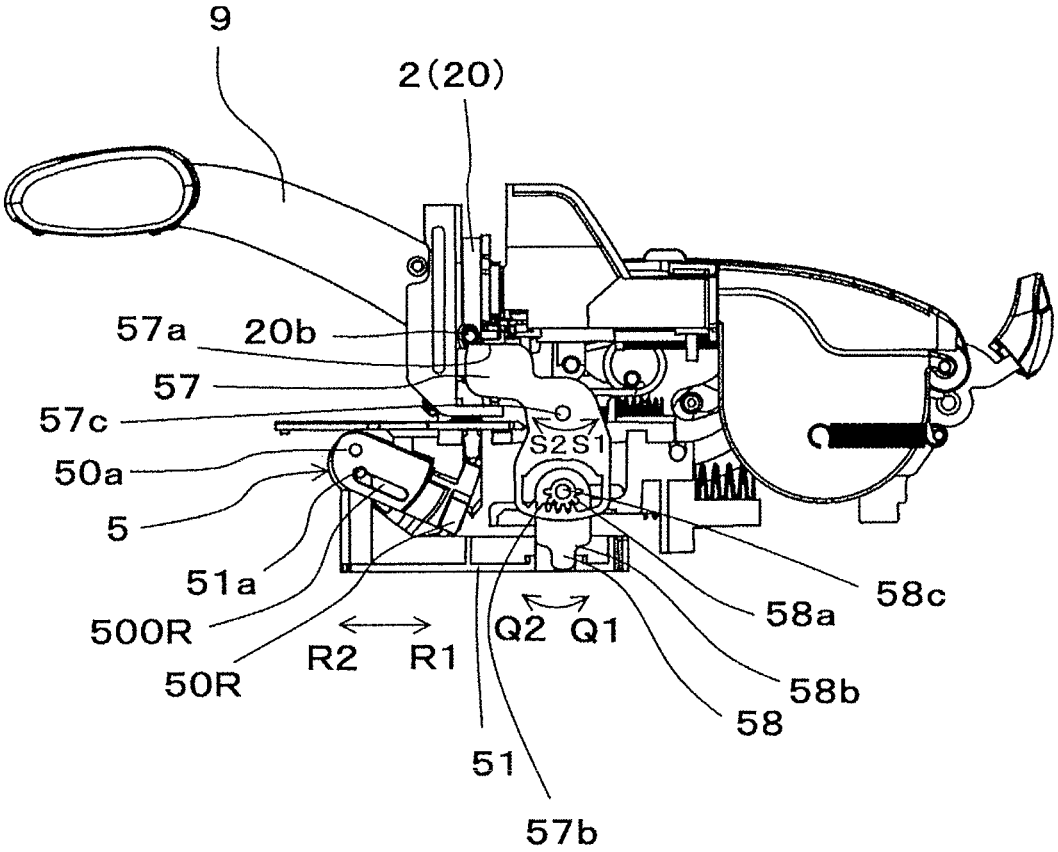
FIG. 40 is a side view illustrating one example of a driving force transmission mechanism of the bending mechanism.

FIG. 40 is a side view illustrating one example of the driving force transmitting mechanism of the bending mechanism. The bending mechanism 5 includes a clincher cam 57 for transmitting the movement of the operating handle 9 to the push-up member 51, and a clincher lever 58.

The clincher cam 57 is one example of a driving force transmitting section, and has a pressing portion 57*a* which is pressed against the coupling shaft portion 20*b* of the penetrating mechanism body 20 connected with the operating handle 9, and a gear cam 57*b* for rotating the clincher lever 58. The clincher cam 57 is attached to the body section 8 so that it is rotatable around a shaft portion 57*c* as a fulcrum.

The clincher lever 58 is one example of the driving force transmitting section, and has a gear 58*a* meshed with the gear cam 57*b* of the clincher cam 57, and an engaging portion 58*b* locked to the push-up member 51. The clincher lever 58 is attached to the body section 8 so that it is rotatable around a shaft portion 58*c*, which is coaxial with the gear 58*a*, as a fulcrum.

With the clincher cam 57, if the penetrating mechanism body 20 is moved down to a desired position by pushing down the operating handle 9, the pressing portion 57*a* is pressed against the coupling shaft portion 20*b*. If the pressing portion 57*a* is pressed against the coupling shaft portion 20*b*, the clincher cam 57 is rotated in a direction indicated by the arrow S1 around the shaft portion 57*c* as the fulcrum.

The gear 58*a* is rotated by displacement of the gear cam 57*b* which is caused by the rotation of the clincher cam 57 around the shaft portion 57*c* as the fulcrum, and the clincher lever 59 is rotated in a direction indicated by the arrow Q1 around the shaft portion 58*c* as the fulcrum.

If the clincher lever 59 is rotated in the direction indicated by the arrow Q1 around the shaft portion 58*c* as the fulcrum, the push-up member 51 is pressed against the engaging portion 58*b* of the clincher lever 58, and is retracted in the direction of the arrow R1 while compressing the spring 51*b*. As the push-up member 51 is retracted in the direction of the arrow R1, the first bending member 50R, the second bending member 50L, and the bonding member 50S are operated at a desired timing.

If the operating handle 9 is pushed up, the push-up member 51 is moved forward in the direction of the arrow R2 by pressurization of the spring 51*b*, and thus the first bending member 50R, the second bending member 50L, and the bonding member 50S are returned to the initial position. Further, the clincher lever 58 is rotated in the direction of the arrow Q2 around the shaft portion 58*c* as the fulcrum.

If the clincher lever 58 is rotated in the direction of the arrow Q2 around the shaft portion 58*c* as the fulcrum, the gear 58*a* is meshed with the gear cam 57*b*, and the clincher cam 57 is rotated in the direction of the arrow S2 around the shaft portion 57*c* as the fulcrum.

The bending mechanism 5 is configured so that, in the process in which the first bending member 50R and the second bending member 50L are pushed up, an interval between the first bending member 50R and the second bending member 50L is widened outwardly, and then is narrowed inwardly.

Also, the bending mechanism 5 includes ejecting members 52 performing the operation of inwardly bending the leg portions 10*i* of the staple 10 penetrating the paper sheets P, before the first bending member 50R and the second bending member 50L start the operation of bending the leg portions 10*i* of the staple 10.

The ejecting members 52 are urged by a spring not shown in the drawings in accordance with its rotating movement around the shaft 52*a*, and thus protrude inwardly from the ejecting hole 21*f* provided in the cutting blade 21 to inwardly bend the leg portions 10*i* of the staple 10 supported by the cutting blades 21.

Also, the bending mechanism 5 includes an ejecting member operating mechanism 53 for operating the ejecting member 52, in association with the operation of the penetrating mechanism 2 lifted by operation of the operating handle 9.

The ejecting member operating mechanism 53 has a slide member 54 transmitted with the operation of the operating handle 9, and a spring 55*a* for urging the slide member 54.

The slide member 54 has a pin 54*a* engaged with the link 92 to which the operation of the operating handle 9 is transmitted, a guide portion 54*b* for operating the ejecting member 52, and an operating convex portion 54*c* for operating cutting blade guide 23, and is attached to the body section 8 in a horizontally sliding manner. The slide member 54 constitutes a guide driving part for operating the cutting blade guide 23 in association with the operation of the penetrating mechanism 2.

As illustrated in FIG. 3, the link 92 connected to the operating handle 9 is provided with an elongated slot 92*b* to which the pin 54*a* of the slide member 54 is engaged. In the displacement of the link 92 caused by the operating handle 9 which is pushed down and then is rotated, the driving force is not transmitted to the pin 54*a* due to the shape of the elongated slot 92*b*, until the operating handle 9 is pushed down to the predetermined position. As a result, the slide member 54 is not displaced.

If the operating handle 9 is pushed down to the predetermined position, the pin 54*a* is pushed backward, and thus the slide member 54 is moved backward. Also, in the displacement of the link 92 caused by the operating handle 9 which is pushed up and then is rotated, the slide member 54 is urged by the spring 55*a* and thus is moved forward.

The guide portion 54*b* has a guide surface abutting against the ejecting member 52, as illustrated in FIG. 18, to open or close the ejecting member 52 in accordance with the sliding movement of the slide member 54. The operating convex portion 54*c* abuts against the cutting blade guide 23, as illustrated in FIG. 1 and so forth, to move the cutting blade guide 23 forward and backward in accordance with the sliding movement of the slide member 54.

The operation of the operating handle 9 is transmitted to the ejecting member operating mechanism 53 via the link 92, and the penetrating mechanism 2 penetrates the paper sheets P by the operation of the operating handle 9. Simultaneously, the slide member 54 is moved backward in accordance with the operation of the cutting/forming mechanism 3 cutting and forming the next staple material 10*m*.

As the slide member 54 is moved back, the ejecting member 52 is guided by the guide surface of the guide portion 54*b* and thus is rotated in the closing direction. And, the ejecting member 52 protrudes into the ejecting hole 21*f* of the cutting blade 21 lowered to the predetermined position. Also, as the slide member 54 is moved back, the cutting blade guide 23 is pushed down and moved backward by the operating convex portion 54*c*, and thus is retracted between the cutting blades 21.

If the operating handle 9 is pushed up, the slide member 54 urged by the spring 55*a* is moved forward. If the slide member 54 is moved forward, the ejecting member 52 is guided by the guide surface of the guide portion 54*b*, and is rotated in the open direction to move back outwardly from the ejecting hole 21*f* of the cutting blade 21. Also, as the slide member 54 is moved forward, the cutting blade guide 23 is moved forward while being urged by the spring 23*a*, so that the cutting blade guide protrudes between the cutting blades 21.

Exemplary Operation of Bending Mechanism

Figure 41A:
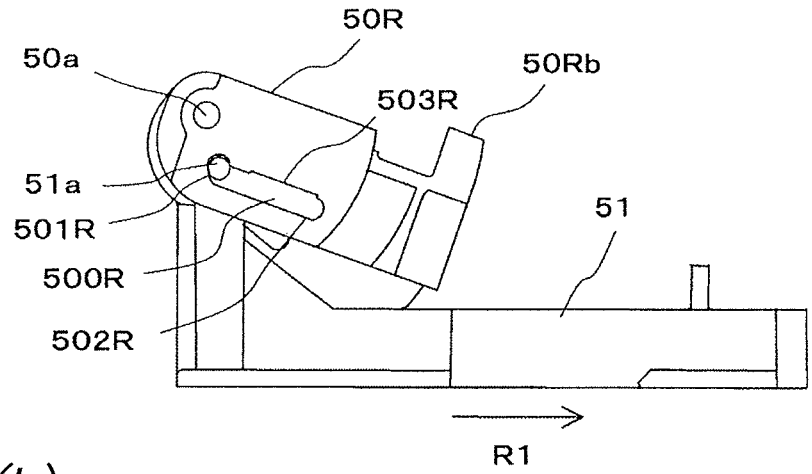
FIGS. 41(*a*) to 41(*c*) illustrate an exemplary operation of the bending mechanism.
Figure 41B:
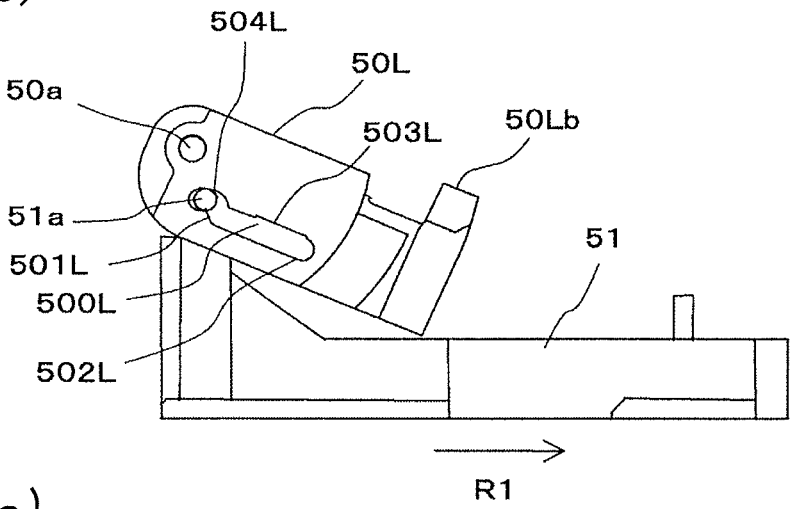
Figure 41C:
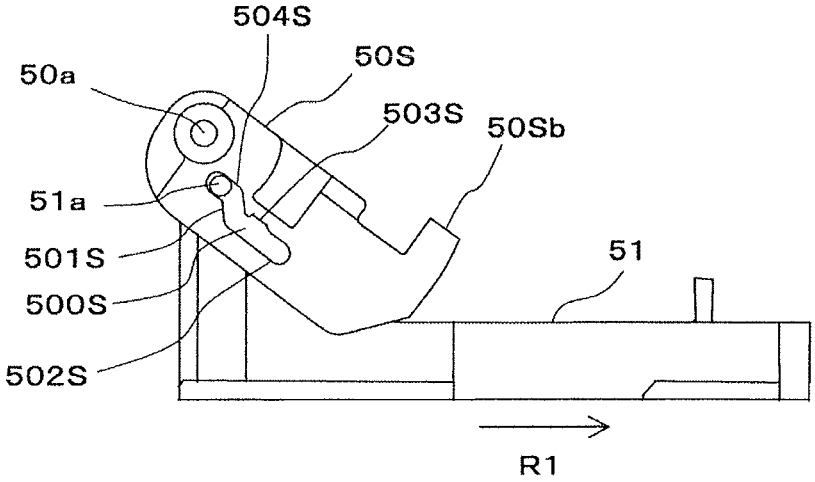

FIGS. 41(*a*) to 45(*e*) are operation charts illustrating the exemplary operation of the bending mechanism, and the operation of the first bending member 50R, the second bending member 50L, and the bonding member 50S which bend the leg portions 10*i* of the staple 10 will now be described with reference to each drawing.

In the state in which the first bending member 50R, the second bending member 50L, and the bonding member 50S are respectively at the initial position, the shaft 51*a* of the push-up member 51 is located in the rotation groove portion 501R in the first bending member 50R.

Further, the shaft 51*a* of the push-up member 51 is located at the standby groove portion 504L of the cam groove 500L in the second bending member 50L. In addition, the shaft 51*a* of the push-up member 51 is located at the standby groove portion 504S of the cam groove 500S in the bonding member 50S.

If the push-up member 51 starts to retract in the direction of the arrow R1, the shaft 51*a* of the push-up member 51 passes through the rotation groove portion 501R of the cam groove 500R in the first bending member 50R, as illustrated in FIG. 41(*a*), and thus the first bending member 50R starts to rotate around the shaft 50*a* as the fulcrum.

If the first bending member 50R starts to rotate, as illustrated in FIG. 45(*a*), the bending portion 50Rb starts to move upward, and as described later, one leg portion 10*i* of the staple 10 which is bent inwardly by the ejecting member 52 is bent by the first bending member 50R.

Further, if the push-up member 51 starts to retract in the direction of the arrow R1, the shaft 51*a* of the push-up member 51 passes through the standby groove portion 504L of the cam groove 500L in the second bending member 50L, as illustrated in FIG. 41(*b*), and thus the second bending member 50L starts to rotate with the small rotation amount, as compared with the first bending member 50R.

At the timing of starting the bending of the one leg portion 10*i* of the staple 10 by the first bending member 50R, since the rotation amount of the second bending member 50L is small, the operation of bending the other leg portion 10*i* of the staple 10 by the second bending member 50L is not performed.

Further, if the push-up member 51 starts to retract in the direction of the arrow R1, the shaft 51*a* of the push-up member 51 passes through the standby groove portion 504S of the cam groove 500S in the second bonding member 50S, as illustrated in FIG. 41(*c*), and thus the bonding member 50S starts to rotate with the small rotation amount, as compared with the first bending member 50R.

At the timing of starting the bending of the other leg portion 10*i* of the staple 10 by the first bending member 50R, since the rotation amount of the bonding member 50S is small, the operation of bonding the leg portions 10*i* of the staple 10 by the bonding member 50S is not performed.

Figure 42A:
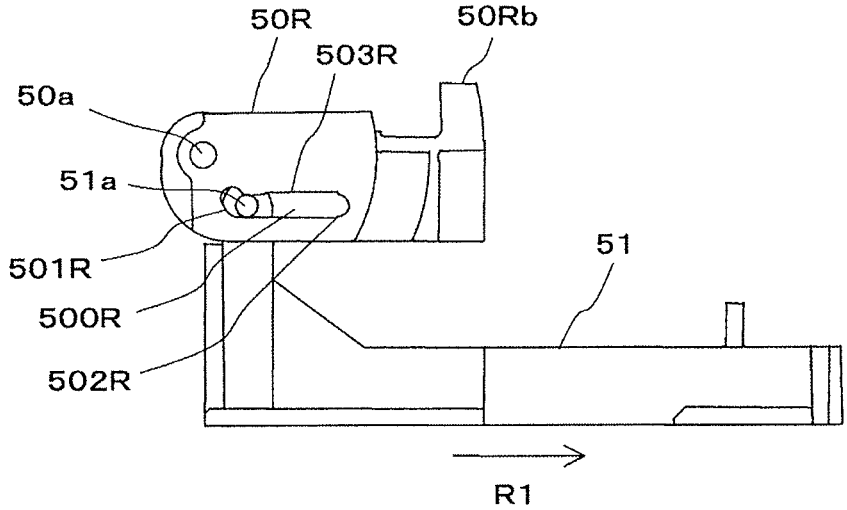
FIGS. 42(*a*) to 42(*c*) illustrate an exemplary operation of the bending mechanism.
Figure 42B:
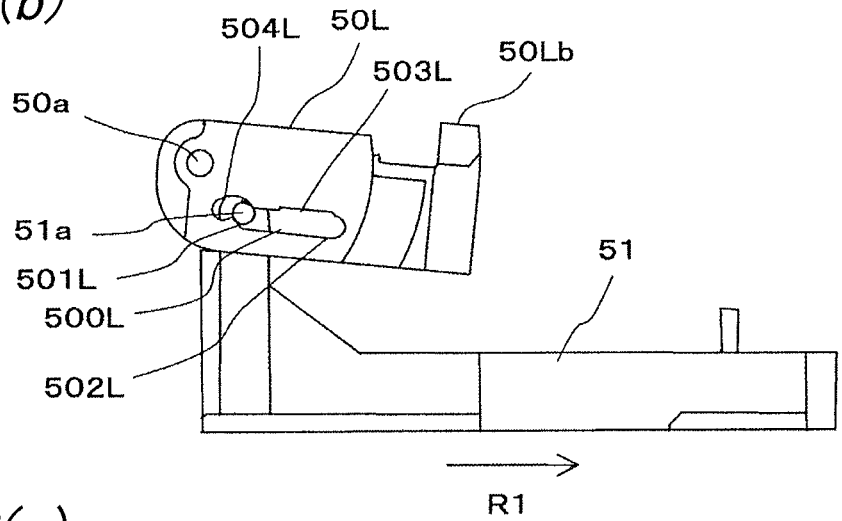
Figure 42C:
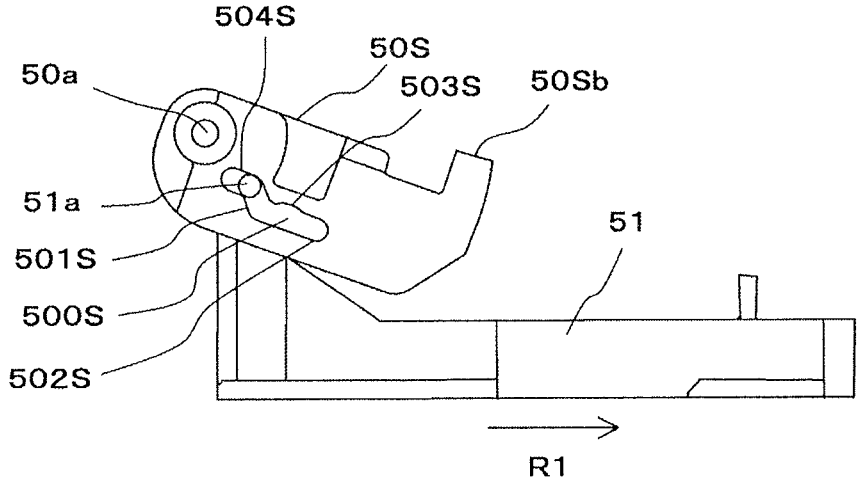

The push-up member 51 is retracted in the direction of the arrow R1, and, as illustrated in FIG. 42(*a*), the shaft 51*a* of the push-up member 51 comes in the holding groove portion 502R from the rotation groove portion 501R of the cam groove 500R in the first bending member 50R, the first bending member 50R is positioned in the substantially horizontal direction, and thus the rotation is stopped.

If the first bending member 50R is positioned in the substantially horizontal direction and thus the rotation is stopped, as illustrated in FIG. 45(*b*), the one leg portion 10*i* of the staple 10 is pressed by the bending portion 50Rb, so that the operation of bending the one leg portion 10*i* of the staple 10 by the first bending member 50R is completed.

At the timing at which the shaft 51*a* of the push-up member 51 comes in the holding groove portion 502R of the cam groove 500R in the first bending member 50R, as illustrated in FIG. 42(*b*), the shaft 51*a* of the push-up member 51 comes in the rotation groove portion 501R from the standby groove portion 504L of the cam groove 51*a*, and thus the rotation amount of the second bending member 50L is increased.

If the rotation amount of the second bending amount 50L is increased, as illustrated in FIG. 45(*c*), an amount of increase of the bending portion 50Lb is increased, and thus the other leg portion 10*i* of the staple 10 which is bent inwardly by the ejecting member 52 is bent by the second bending member 50L.

At the timing at which the shaft 51*a* of the push-up member 51 comes in the holding groove portion 502R of the cam groove 500R in the first bending member 50R, as illustrated in FIG. 42(*c*), the shaft 51*a* of the push-up member 51 passes through the standby groove portion 504S of the cam groove 500S, and thus the rotation amount of the bonding member 50S is suppressed to be small.

Figure 43A:
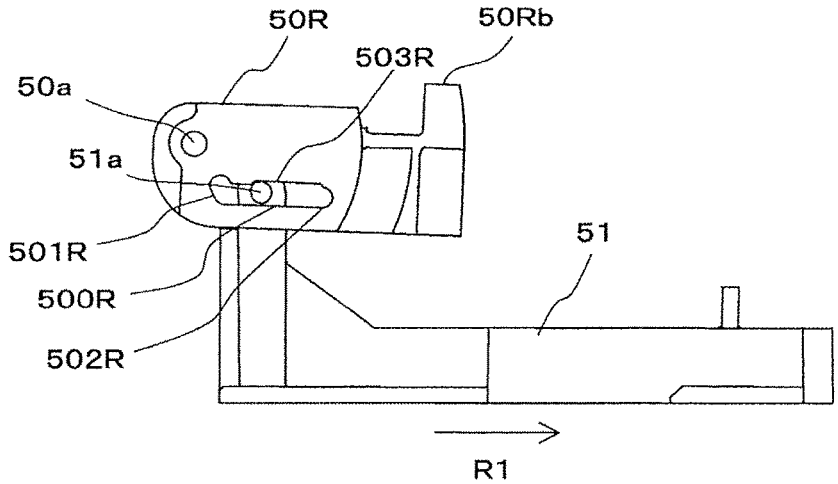
FIGS. 43(*a*) to 43(*c*) illustrate an exemplary operation of the bending mechanism.
Figure 43B:
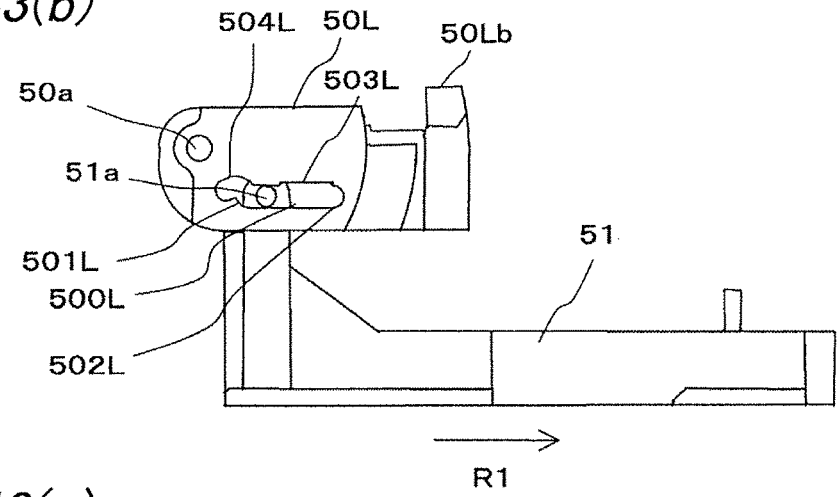
Figure 43C:
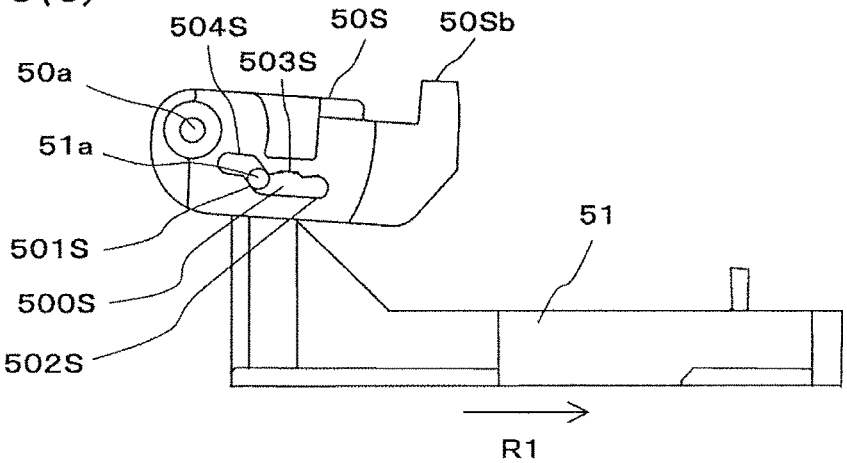

If the push-up member 51 is retracted in the direction of the arrow R1, and the shaft 51*a* of the push-up member 51 comes in the standby groove portion 502L from the rotation groove portion 501L of the cam groove 500L in the second bending member 50L, as illustrated in FIG. 43(*b*), the second bending member 50L is positioned in the substantially horizontal direction, and thus the rotation is stopped.

If the second bending member 50L is positioned in the substantially horizontal direction and thus the rotation is stopped, as illustrated in FIG. 45(*d*), the other leg portion 10*i* overlapped with the one leg portion 10*i* of the staple 10 is pressed by the bending portion 50Lb, so that the operation of bending the other leg portion 10*i* of the staple 10 by the second bending member 50L is completed.

At the timing at which the shaft 51*a* of the push-up member 51 comes in the holding groove portion 502L of the cam groove 500L in the second bending member 50L, as illustrated in FIG. 43(*a*), the shaft 51*a* of the push-up member 51 passes through the holding groove portion 502R of the cam groove 500R in the first bending member 50R, and thus the first bending member 50R is held in the state in which the rotation is stopped.

According to the cam groove 500R of the first bending member 50R, since the holding groove portion 502R is formed with the retraction portion 503R, if the shaft 51*a* of the push-up member 51 passes through the retraction portion 503R, the first bending member 50R can be vertically displaced with a desired amount.

In the state in which the leg portions 10*i* of the staple 10 are pressed by the first bending member 50R, the reaction force applied from the leg portion 10*i* of the staple 10 becomes a sliding resistance between the shaft 51*a* of the push-up member 51 and the cam groove 500R of the first bending member 50R, which comes to a load with respect to the force moving the push-up member 51. Since the push-up member 51 is retracted by the force pushing down the operating handle 9, the increase of the load applied to the push-up member 51 lead to the increase in operating load.

Accordingly, as the first bending member 50R is vertically displaced while the bending state of the leg portions 10*i* of the staple is maintained, the first bending member 50R can be retracted so that the reaction force applied from the leg portions 10*i* of the staple 10 is released. The sliding resistance between the cam groove 500R of the first bending member 50R and the shaft 51*a* of the push-up member 51 is decreased, and thus the operating load is lowered.

At the timing at which the shaft 51*a* of the push-up member 51 comes in the holding groove portion 502L of the cam groove 500L in the second bending member 50L, as illustrated in FIG. 43(*c*), the shaft 51*a* of the push-up member 51 comes in the rotation groove portion 501S from the standby groove portion 504S of the cam groove 500S, and thus the rotation amount of the bonding member 50S is increased.

Figure 44A:
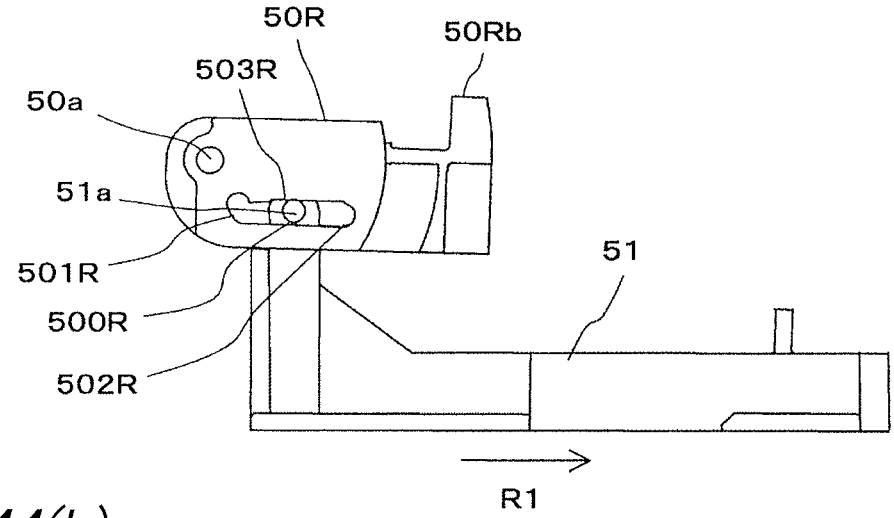
FIGS. 44(*a*) to 44(*c*) illustrate an exemplary operation of the bending mechanism.
Figure 44B:
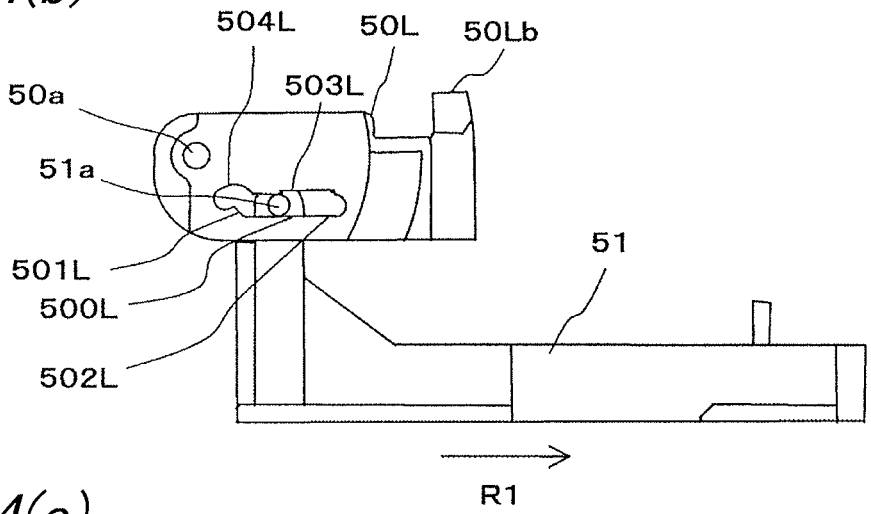
Figure 44C:
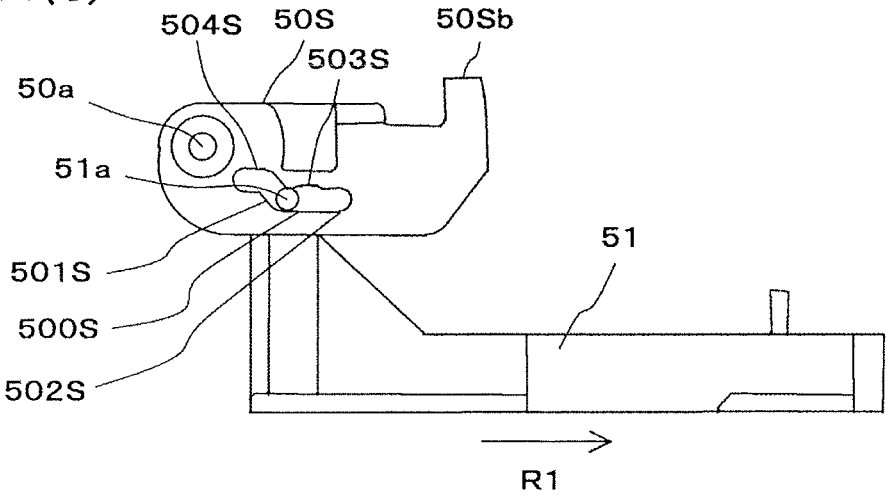
Figure 45A:
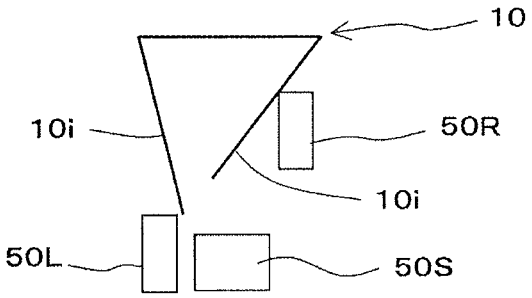
FIGS. 45(*a*) to 45(*e*) illustrate an exemplary operation of the bending mechanism.
Figure 45B:
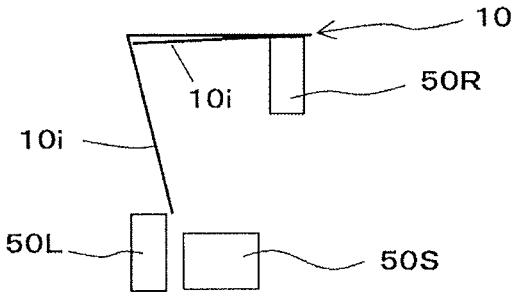
Figure 45C:
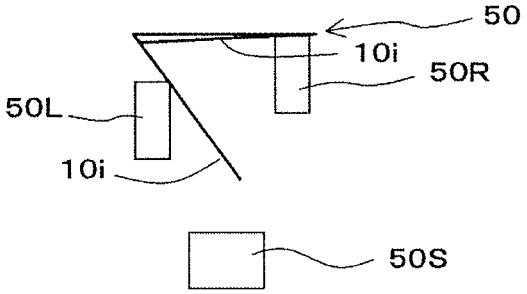
Figure 45D:
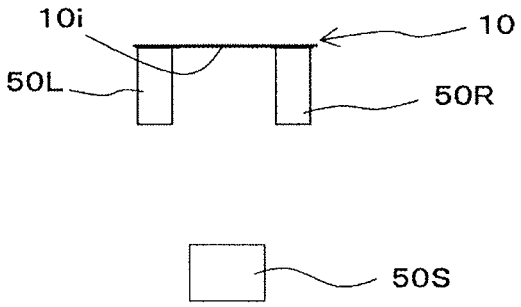
Figure 45E:
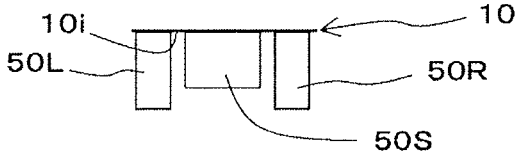

If the push-up member 51 is retracted in the direction of the arrow R1, and the shaft 51*a* of the push-up member 51 comes in the holding groove portion 502S from the rotation groove portion 501S of the cam groove 500S in the bonding member 50S, as illustrated in FIG. 44(*c*), the bonding member 50S is positioned in the substantially horizontal direction, and thus the rotation is stopped.

If the bonding member 50S is positioned in the substantially horizontal direction and thus the rotation is stopped, as illustrated in FIG. 45(*e*), the one leg portion 10*i* and the other leg portion 10*i* of the staple 10 which are bent by the first bending member 50R and the second bending member 50L and are overlapped with each other are bonded to each other by the bonding member 50S, and thus the operation of bending and bonding the leg portions 10*i* of the staple 10 is completed.

At the timing at which the shaft 51*a* of the push-up member 51 comes in the holding groove portion 502S of the cam groove 500S in the bonding member 50S, as illustrated in FIG. 44(*a*), the shaft 51*a* of the push-up member 51 passes through the holding groove portion 502R of the cam groove 500 R in the first bending member 50R, and thus the first bending member 50R is held in the state in which the rotation is stopped.

At the timing at which the shaft 51*a* of the push-up member 51 comes in the holding groove portion 502S of the cam groove 500S in the bonding member 50S, as illustrated in FIG. 44(*b*), the shaft 51*a* of the push-up member 51 passes through the holding groove portion 502L of the cam groove 500L in the second bending member 50L, and thus the second bending member 50L is held in the state in which the rotation is stopped.

According to the cam groove 500L of the second bending member 50L, since the holding groove portion 502L is formed with the retraction portion 503L, if the shaft 51*a* of the push-up member 51 passes through the retraction portion 503L, the second bending member 50L can be vertically displaced with a desired amount. Therefore, the load at the retracting operation of the push-up member 51 is decreased.

In addition, according to the cam groove 500S of the bonding member 50S, since the holding groove portion 502*s* is formed with the retraction portion 503S, if the operating handle 9 is pushed to the position where the shaft 51*a* of the push-up member 51 passes through the retraction portion 503S, the bonding member 50S can be vertically displaced with a desired amount.

Therefore, the load applied to the operating handle 9 becomes light at the timing at which the stapling of the paper sheets by the staple 10 is finished, and thus the operator can recognize that the operation of stapling the paper sheets is completed.

If the number of paper sheets is few, the push-up member 51 is further retracted in the direction of the arrow R1, and the shaft 51*a* of the push-up member 51 gets out of the retraction portion 503R of the cam groove 500R in the first bending member 50R, and then reaches a termination of the holding groove portion 502R, so that the first bending member 50R is moved upward with a desired amount to press the one leg portion 10*i* of the staple 10.

Further, the push-up member 51 is further retracted in the direction of the arrow R1, and the shaft 51*a* of the push-up member 51 gets out of the retraction portion 503L of the cam groove 500L in the second bending member 50L, and then reaches a termination of the holding groove portion 502L, so that the second bending member 50L is moved upward with a desired amount to press the other leg portion 10*i* of the staple 10.

In addition, the push-up member 51 is further retracted in the direction of the arrow R1, and the shaft 51*a* of the push-up member 51 gets out of the retraction portion 503S of the cam groove 500S in the bonding member 50S, and then reaches a termination of the holding groove portion 502S, so that the bending member 50S is moved upward with a desired amount to press the one leg portion 10*i* and the other leg portion 10*i* of the staple 10 which are overlapped with each other. Accordingly, it is possible to extend the time pressing the leg portions 10*i* of the staple 10 by the bonding member 50S, irrespective of the number of paper sheets P, thereby reliably bonding the leg portions 10*i*.

The stapler using the stapler made of the metal material displaces the stapling table by use of the configuration in which the force pushing down the operating handle is directly applied to the staple, or the force pushing down the operating handle, to bend the leg portions of the staple. In the configuration in which the stapling table is displaced by the raising/lowering movement, as the number of paper sheets P is increased, the stapling movement tends to become unstable.

Since the stapler 1 of this embodiment uses the staple 10 made of the soft material, such as paper, the force required to bend the leg portions 10*i* is weak, as compared with the metal staple. For this reason, since the force of the operating handle 9 is transmitted to the bending mechanism 5 using the driving force transmitting section of the cam mechanism, such as the clincher cam 57 and the clincher lever 58, the first bending member 50R, the second bending member 50L, and the bonding member 50S can be operated, without increasing the operating load of the operating handle 9.

Since each of the first bending member 50R, the second bending member 50L, and the bonding member 50S can be independently operated by the force of the operating handle 9, the movement of each member becomes stable, thereby reliably performing the stapling movement. Further, since the operating load can be varied by the shape of the cam, it is possible to prevent the increase in operating load, and the operator can recognize the stapling completion of the paper sheets using the change of the operating load, thereby improving the user's usability.

Exemplary Configuration of Conveying Mechanism

The conveying mechanism 6 for conveying the staple-materials-connecting-body and the staple 10 cut and formed from the staple-materials-connecting-body 10*a* will now be described with reference to each drawing.

The conveying mechanism 6 is one example of a conveying part, and includes a pusher 60 for conveying the staple-materials-connecting-body and the staple 10 cut and formed from the staple-materials-connecting-body 10*a*, and a spring 60*a* for urging the pusher 60 forward.

The pusher 60 has a feed claw 61 which is engaged with the hole 10*d* of the staple-materials-connecting-body 10*a* to convey the staple-materials-connecting-body 10*a*, a staple pushing portion 62 for extruding the staple 10 cut and formed from the staple-materials-connecting-body 10*a*, and a pin 63 engaging with the link 92 to which the operation of the operating handle 9 is transmitted.

The link 92 connected with the operating handle 9 is provided with an elongated slot 92*a* to which the pin 63 of the pusher 60 is engaged. In the displacement of the link 92 caused by the operating handle 9 which is pushed down and then is rotated, the pin 63 is pushed backward, and thus the pusher 60 is moved backward. Also, in the displacement of the link 92 caused by the operating handle 9 which is pushed up and then is rotated, the pusher 60 is urged by the spring 60*a* and thus is moved forward.

The pusher 60 is made of a resin material in this example, and is formed integrally with the feed claw 61 and the staple pushing portion 62. The feed claw 61 is provided on the upper surface of the pusher 60, and is installed at two left and right positions corresponding to the one pair of holes 10*d* of the staple-materials-connecting-body 10*a*, as illustrated in FIG. 6. As illustrated in FIG. 1, if the staple cartridge 11 is mounted in the cartridge receiving portion 81 of the stapler 1, the feed claw 61 protrudes from the groove portion 14*b* formed on the bottom surface of the staple conveying path 14.

In the feed claw 61, a front surface along the conveying direction of the staple-materials-connecting-body 10*a* is substantially vertically formed as an engaging surface 61*a*, and a rear surface is formed in an inclined surface as a non-engaging surface 61*b*. The feed claw 61 is formed integrally with the pusher 60 by a support portion 61*c* extending backward from the rear surface thereof.

Since the pusher 60 is made of the resin material, the support portion 61*c* of the feed claw 61 can be resiliently deformed, and the shape of the feed claw 61 forms an evacuation part for appearing and disappearing the feed claw 61 through the hole 10*d* of the staple-materials-connecting-body 10*a* by the horizontal movement of the pusher 60.

That is, as the pusher 60 is moved forward, the engaging surface 61*a* of the feed claw 61 is engaged with the hole 10*d* of the staple-materials-connecting-body 10*a* to convey the staple-materials-connecting-body 10*a* forward. As the pusher 60 is moved backward, the shape of the inclined surface of the non-engaging surface 61*b* of the feed claw 61 generates the force to push the feed claw 61 down, and thus the feed claw 61 is moved backward from the hole 10*d* of the staple-materials-connecting-body 10*a* by the resilient deformation of the support portion 61*c*, so that the staple-materials-connecting-body 10*a* is maintained in the stationary state.

The staple pushing portion 62 is provided on the front surface of the pusher 60, and as illustrated in FIG. 10, is configured to push the so-called U-shaped formed staple 10 of which the leg portions 10*i* are formed at both ends of the crown portion 10*h*.

The staple pushing portion 62 protrudes into the cutting/forming mechanism 3 by the forward movement of the pusher 60 to convey the formed staple 10 to the penetrating mechanism 2. Since the feed claw 61 and the staple pushing portion 62 are formed integrally with the pusher 60, in accordance with the forward movement of the pusher 60, the staple-materials-connecting-body 10*a* is conveyed to the cutting/forming mechanism 3, and simultaneously, the staple 10 located at the leading end which is cut and formed from the staple-materials-connecting-body 10*a* is conveyed to the penetrating mechanism 2.

Exemplary Configuration of Attaching/Detaching Mechanism

Figure 46:
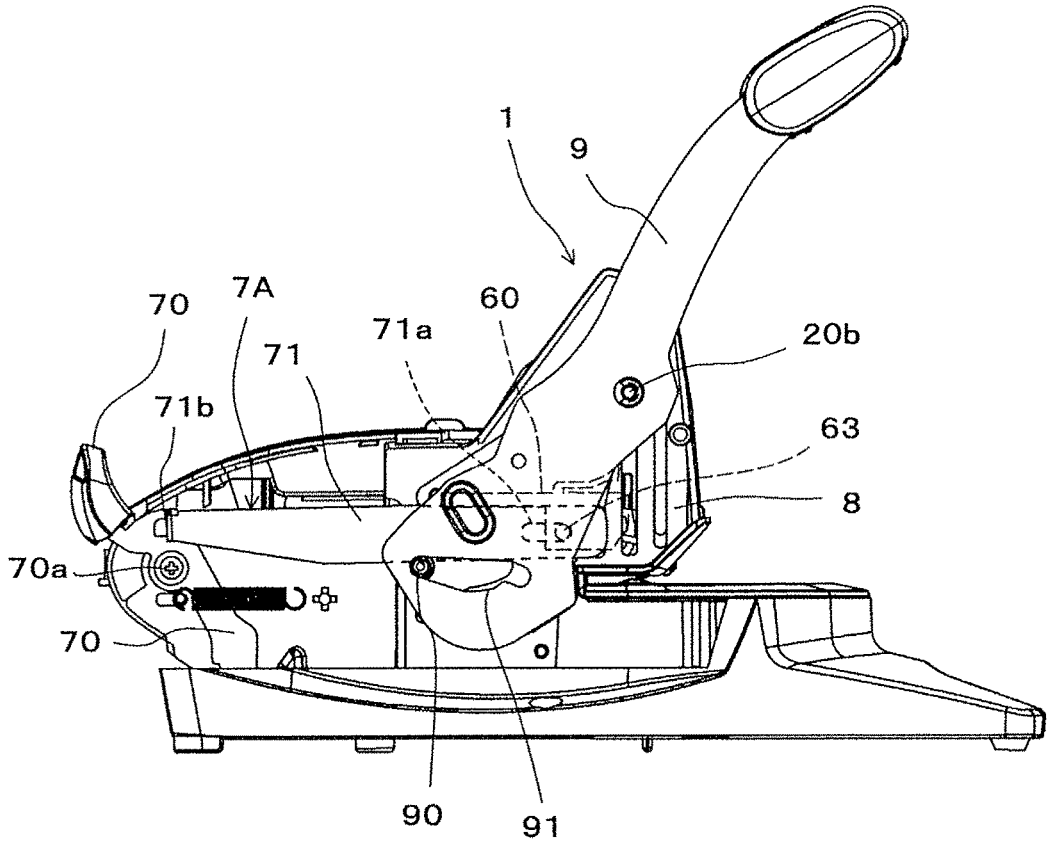
FIG. 46 is a side sectional view of the stapler illustrating one example of an attaching/detaching mechanism.

FIG. 46 is a side sectional view of the stapler illustrating one example of the attaching/detaching mechanism. It will now be described the configuration of the attaching/detaching mechanism 7A for conveying the staple-materials-connecting-body 10*a* received in the staple cartridge 11 to the predetermined position in association with the conveying mechanism 6 when the staple cartridge 11 is mounted.

The attaching/detaching mechanism 7A is one example of an attaching/detaching part, and includes an operating lever 70 and a link 71 for transmitting the operation of the operating lever 70 to the conveying mechanism 6. The operating lever 70 is provided at a rear side of the cartridge receiving portion 81 of the body section 8, and is rotated around a shaft 70*a*.

The link 71 is one example of an operating force transmitting part, and has a tip end side provided with an elongated slot 71*a* engaged with the pin 63 of the pusher 60, and a rear end side attached to the operating lever 70 in such a manner that it can rotate around a shaft 71*b*. The elongated slot 71*a* provided in the link 71 extends along the moving direction of the pusher 60 in accordance with the operation of the operating handle 71, so that the engagement of the pusher 60 and the link 71 does not interfere in the movement of the pusher 60 by the operation of the operating handle 9.

Meanwhile, if the operating lever 70 is rotated rearward using the shaft 70*a* as the fulcrum, since the link 71 connected to the shaft 71*b* is moved rearward, the pin 63 of the pusher 60 is pushed rearward, and thus the pusher 60 is moved rearward. At the retracting operation of the pusher 60, the feed claw 61 is retracted from the hole 10*d* of the staple-materials-connecting-body 10*a*, and the staple-materials-connecting-body 10*a* is maintained in the stop state. Further, if the operating lever 70 is rotated forward using the shaft 70*a* as the fulcrum, the pusher 60 is biased by the spring 60*a*, and thus is moved forward. When the pusher 60 is moved forward, the engaging surface 61*a* of the feed claw 61 is engaged to the hole 10*d* of the staple-materials-connecting-body 10*a*, so that the staple-materials-connecting-body 10*a* is fed forward.

Figure 47A:
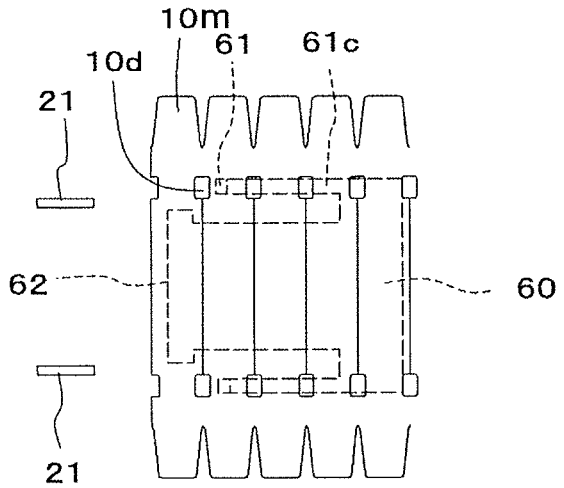
FIGS. 47(*a*) to 47(*c*) illustrate an exemplary operation of conveying the staple-materials-connecting-body by an operation of the attaching/detaching mechanism.
Figure 47B:
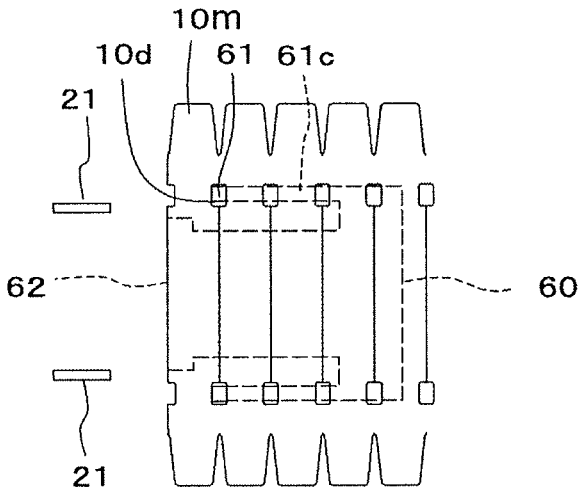
Figure 47C:
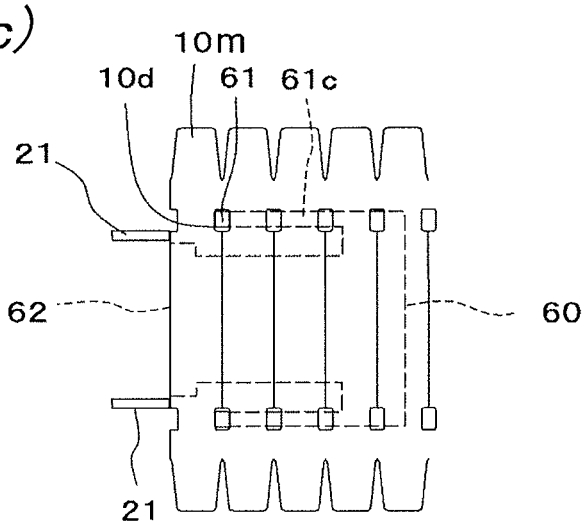

FIG. 47 is an operation chart illustrating an exemplary operation of conveying the staple-materials-connecting-body by the operation of the attaching/detaching mechanism. Since the feed claw 61 of the pusher 60 is engaged with the hole 10*d* of the staple-materials-connecting-body 10*a*, if the pusher 60 is moved forward, as illustrated in FIGS. 47(*a*) and 47(*b*), the staple-materials-connecting-body 10*a* is moved forward.

As illustrated in FIG. 46, if the operating lever 70 is rotated to the mounting position, as illustrated in FIG. 47(*c*), the staple-materials-connecting-body 10*a* is moved forward to the predetermined standby position. In this example, the position in which the tip end of the staple-materials-connecting-body 10*a* abuts against the cutting blade 21 of the penetrating mechanism 2 is referred to as the standby position.

The staple cartridge 11 is mounted in the stapler 1, and the staple-materials-connecting-body 10*a* is moved forward to the determined standby position by the operation of the attaching/detaching mechanism 7A. Therefore, when the staple cartridge 11 is attached or detached, the position of the staple-materials-connecting-body 10*a* can be reliably set to the determined standby position by the operation of the operating lever 70.

Further, when the staple cartridge 11 is removed, the operating lever 70 is rotated backward from the state illustrated in FIG. 46. If the pusher 60 is moved backward by rotating the operating lever 70 rotating backward, the feed claw 61 is moved backward from the hole 10*d* of the staple-materials-connecting-body 10*a* due to the shape of the feed claw 61, so that the staple-materials-connecting-body 10*a* is maintained in the stationary state.

If the operating lever 70 is rotated to the attaching/detaching position, the staple cartridge 11 is lifted up in the state in which the operating lever 70 is held at the attaching/detaching position. Therefore, it is possible to easily detach the staple cartridge 11.

When the staple cartridge 11 is detached in the state in which the staple-materials-connecting-body 10*a* is remained due to jamming or the like, if the staple cartridge 11 is detached in the state in which the pusher 60 is moved forward, the staple cartridge 11 is detached in the state in which the lead staple of the staple-materials-connecting-body 10*a* is engaged with the feed claw 61 of the pusher 60, so that the staple-materials-connecting-body 10*a* is drawn out.

However, the embodiment is configured so that the detachment of the staple cartridge 11 is not possible, without operation of the operating lever 70. Since the pusher 60 is retracted by operation of the operating lever 70, the feed claw 61 is retracted, and thus the engaging state between the lead staple of the staple-materials-connecting-body 10*a* and the feed claw 61 is released, thereby detaching the staple cartridge 11 and thus preventing the staple-materials-connecting-body 10*a* from being drawn.

Exemplary Overall Operation of Stapler

FIGS. 48 to 51 are operation charts illustrating the exemplary operation of the operating handle. FIGS. 52 to 63 are operation charts illustrating the exemplary operation of the entire stapler. FIGS. 64 to 75 are operation charts illustrating the exemplary operation of the penetrating mechanism and the bending mechanism. FIGS. 76 to 87 are operation charts illustrating the exemplary operation of the cutting/forming mechanism. The exemplary overall operation of the entire stapler 1 according to this embodiment will now be described with reference to each drawing.

Standby State

In the standby state illustrated in FIGS. 48, 52, 64, 76, and so forth, the staple 10 located at the leading end which is cut and formed from the staple-materials-connecting-body 10*a* is positioned in the penetrating mechanism 2. Also, the next staple 10 (staple material 10*m*) of the staple-materials-connecting-body 10*a* is positioned in the cutting/forming mechanism 3.

The staple-materials-connecting-body 10*a* conveyed to the cutting/forming mechanism 3 is conveyed to the determined standby position in which it abuts against the cutting blade 21 of the penetrating mechanism 2 by the operation of the above-described attaching/detaching mechanism 7A. Also, in the cutting/forming mechanism 3, the cutter plate 30 is positioned at the retracted position raised with respect to the forming plate 31, and the cutting blade 32 is not exposed.

Operation Start of Cutting Blade

Figure 48:
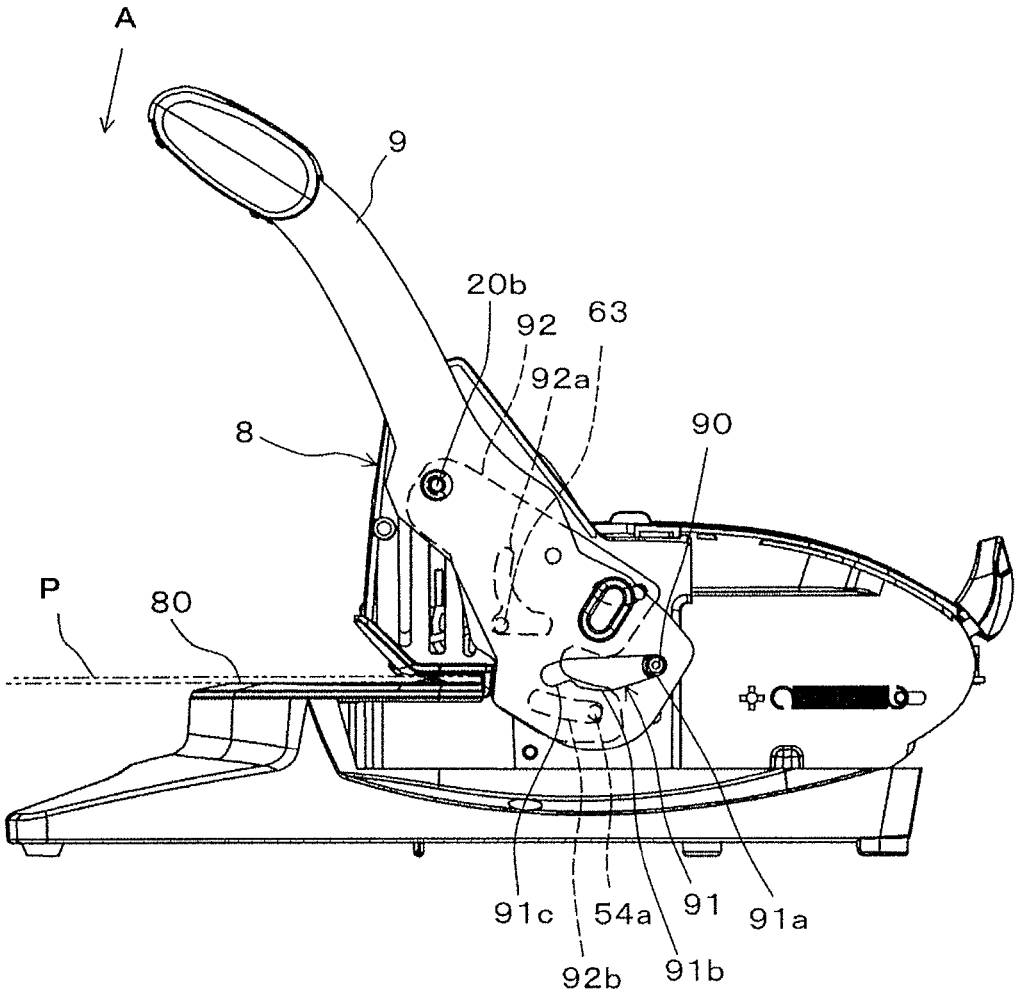
FIG. 48 is an operation chart illustrating an exemplary operation of an operating handle portion.
Figure 53:
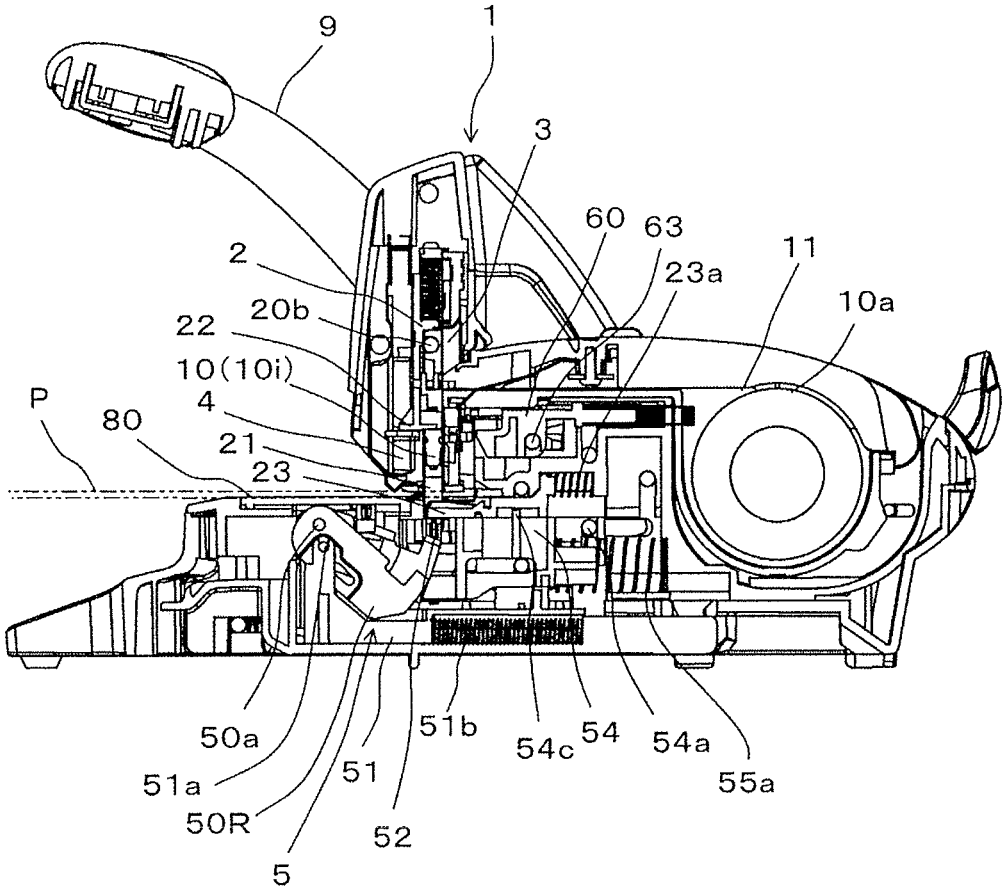
FIG. 53 is an operation chart illustrating an exemplary operation of the entire stapler.

If the operating handle 9 is pushed in a downward direction indicated by the arrow A from the standby state illustrated in FIG. 48, the link 92 connected with the operating handle 9 at the coupling shaft portion 20*b* of the penetrating mechanism 2 is rotated around the coupling shaft portion 20*b* in a direction indicated by the arrow B. Accordingly, as illustrated in FIG. 53, the pusher 60 starts moving backward. As the pusher 60 is moved backward, as described above, the feed claw 61 is spaced apart from the staple-materials-connecting-body 10*a*, and thus the staple-materials-connecting-body 10*a* is maintained in the stationary state.

Figure 65:
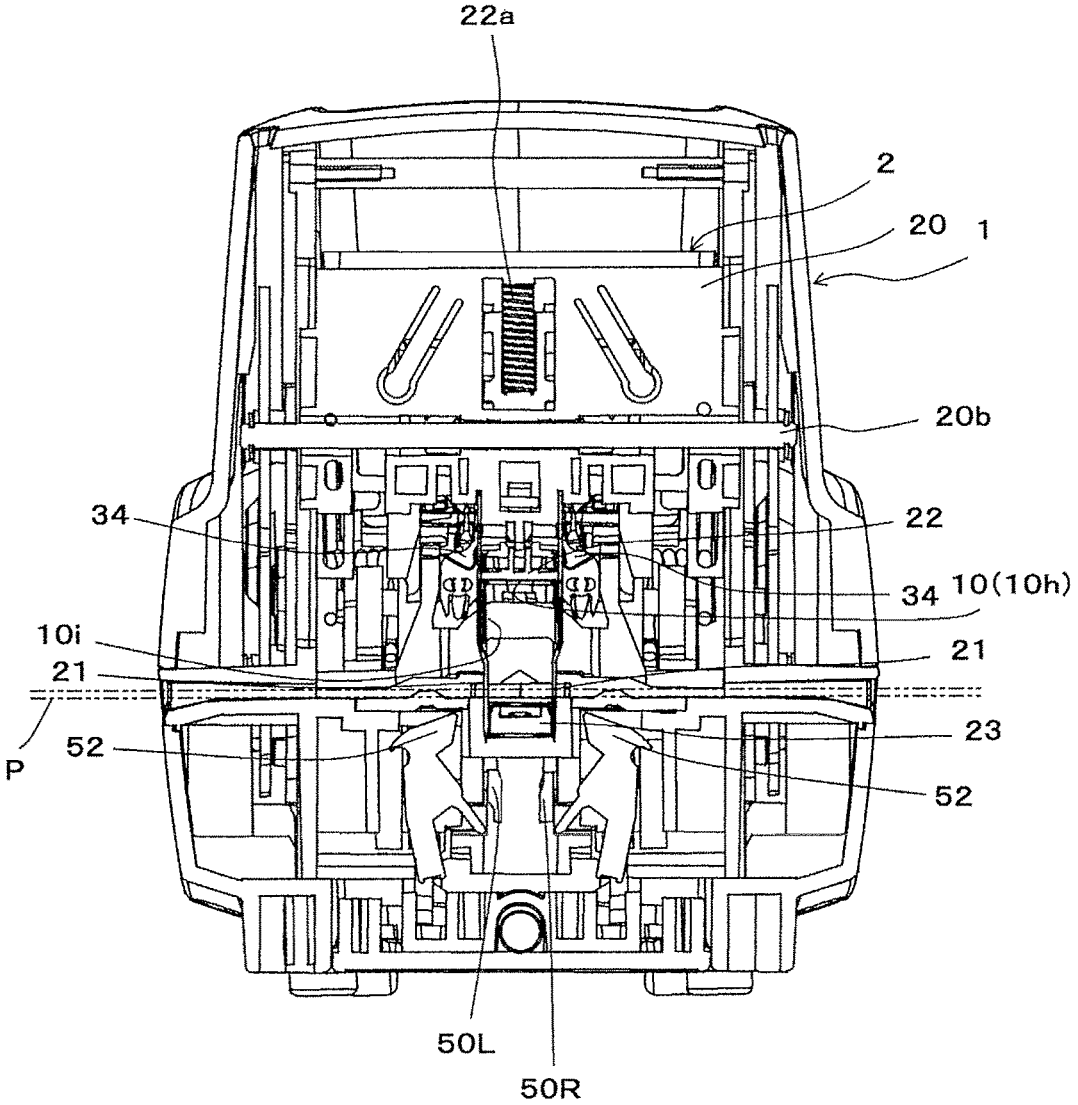
FIG. 65 is an operation chart illustrating an exemplary operation of the penetrating mechanism and the bending mechanism.
Figure 77:
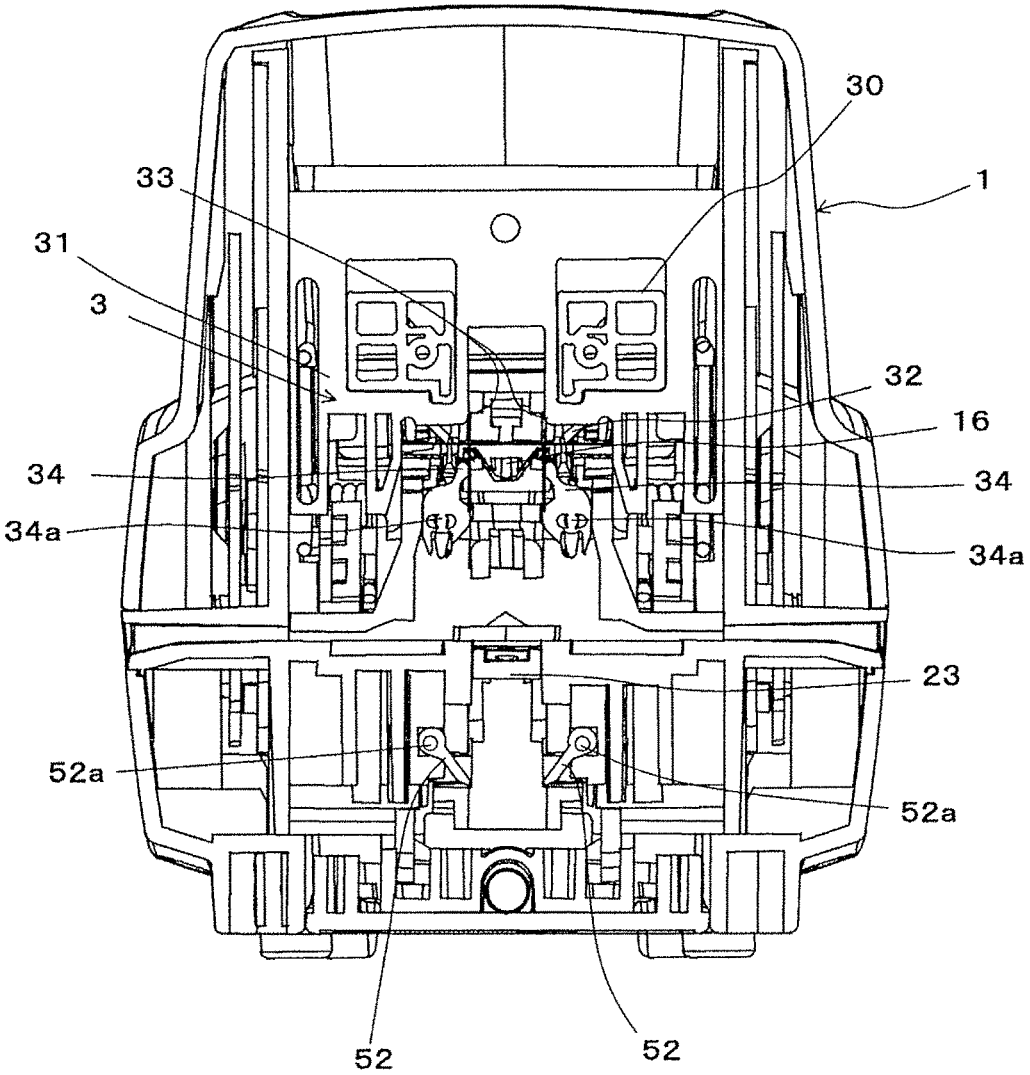
FIG. 77 is an operation chart illustrating an exemplary operation of the cutting/forming mechanism.

Further, as the operating handle 9 pushes the connecting shaft portion 20*b* down, the penetrating mechanism 2 starts lowering, and the paper holding plate 40 of the paper holding mechanism 4 is urged by the spring 41, in association with the operation of the penetrating mechanism 2, so that the paper sheets P placed in the paper placing base 80 are held. In the penetrating mechanism 2, as illustrated in FIG. 65, the blade portion 21*a* of the cutting blade 21 pierces the paper sheets P. In the cutting/forming mechanism 3, as illustrated in FIG. 77, the cutting blade 32 protrudes from the staple forming portion 33 of the forming plate 31.

The operating handle 9 is rotated around the imaginary fulcrum defined by the track of the cam groove 91 guided by the shaft 90 and the track of the coupling shaft portion 20*b*, to lower the penetrating mechanism 2, so that the operating load becomes light at the timing at which the staple 10 starts to penetrate the paper sheets P.

Forming and Slide Member Operation Start

Figure 54:
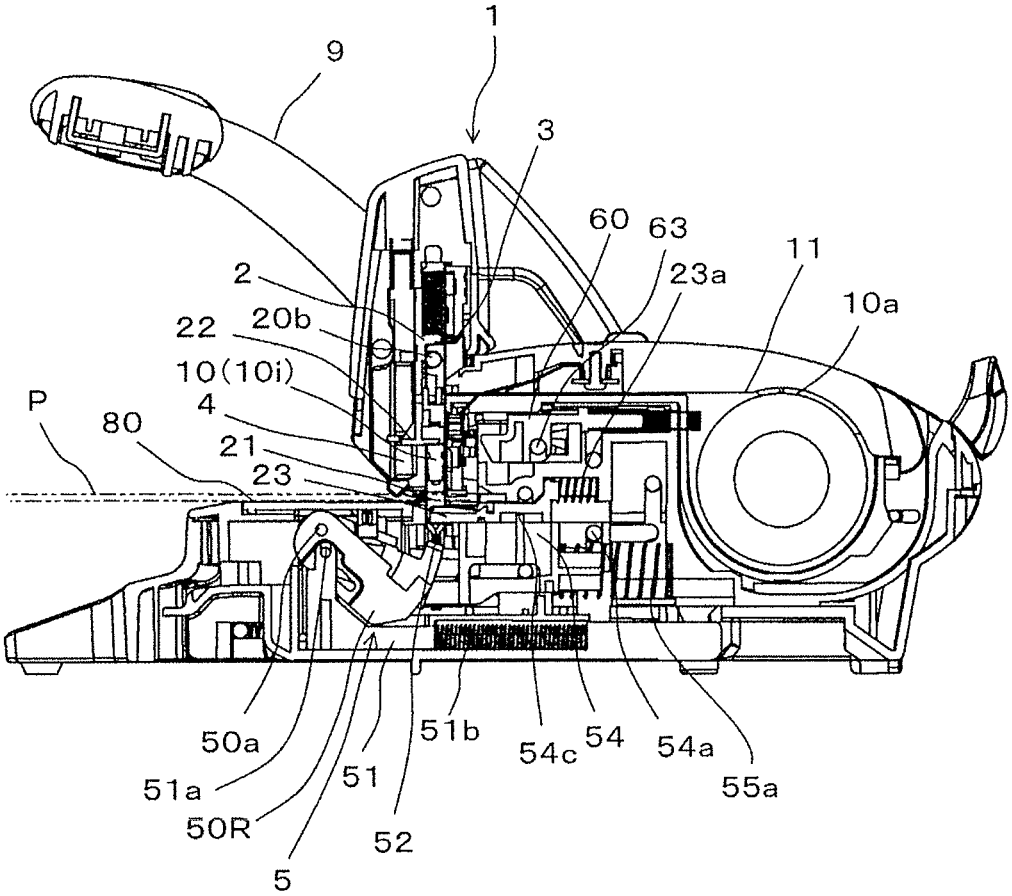
FIG. 54 is an operation chart illustrating an exemplary operation of the entire stapler.
Figure 66:
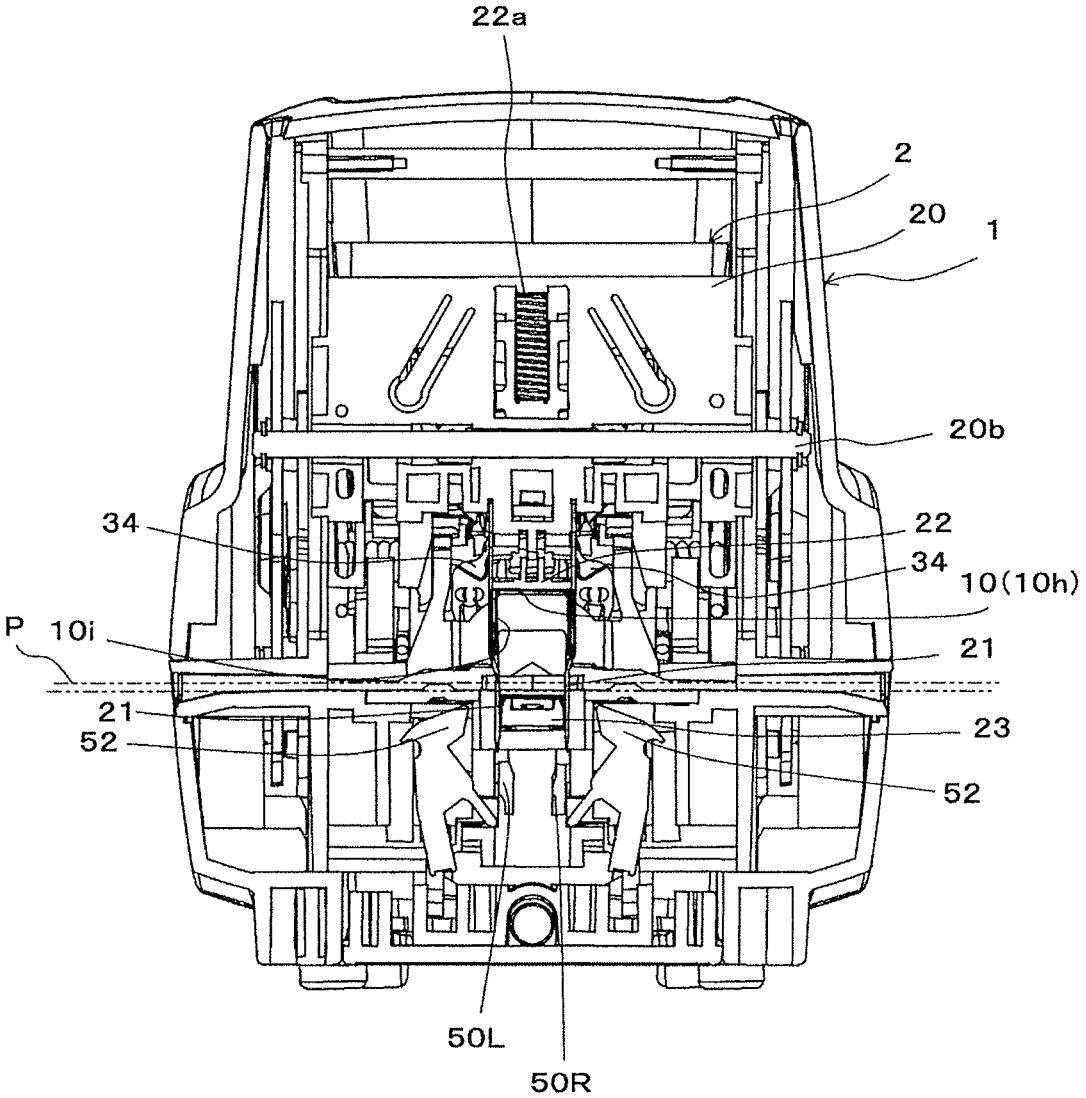
FIG. 66 is an operation chart illustrating an exemplary operation of the penetrating mechanism and the bending mechanism.

If the operating handle 9 is pushed down at the position illustrated in FIG. 54, the retreating operation of the pusher 60 is continuously performed. In the penetrating mechanism 2, as illustrated in FIG. 66, the first penetrating portion 21*b* of the cutting blade 21 penetrates the paper sheets P. The one pair of cutting blades 21 prevents the tip end side of the cutting blade 21 from being inclined inwardly, while the cutting blade guide 23 protrudes inside the first penetrating portion 21*b* penetrating the paper sheets P.

Figure 78:
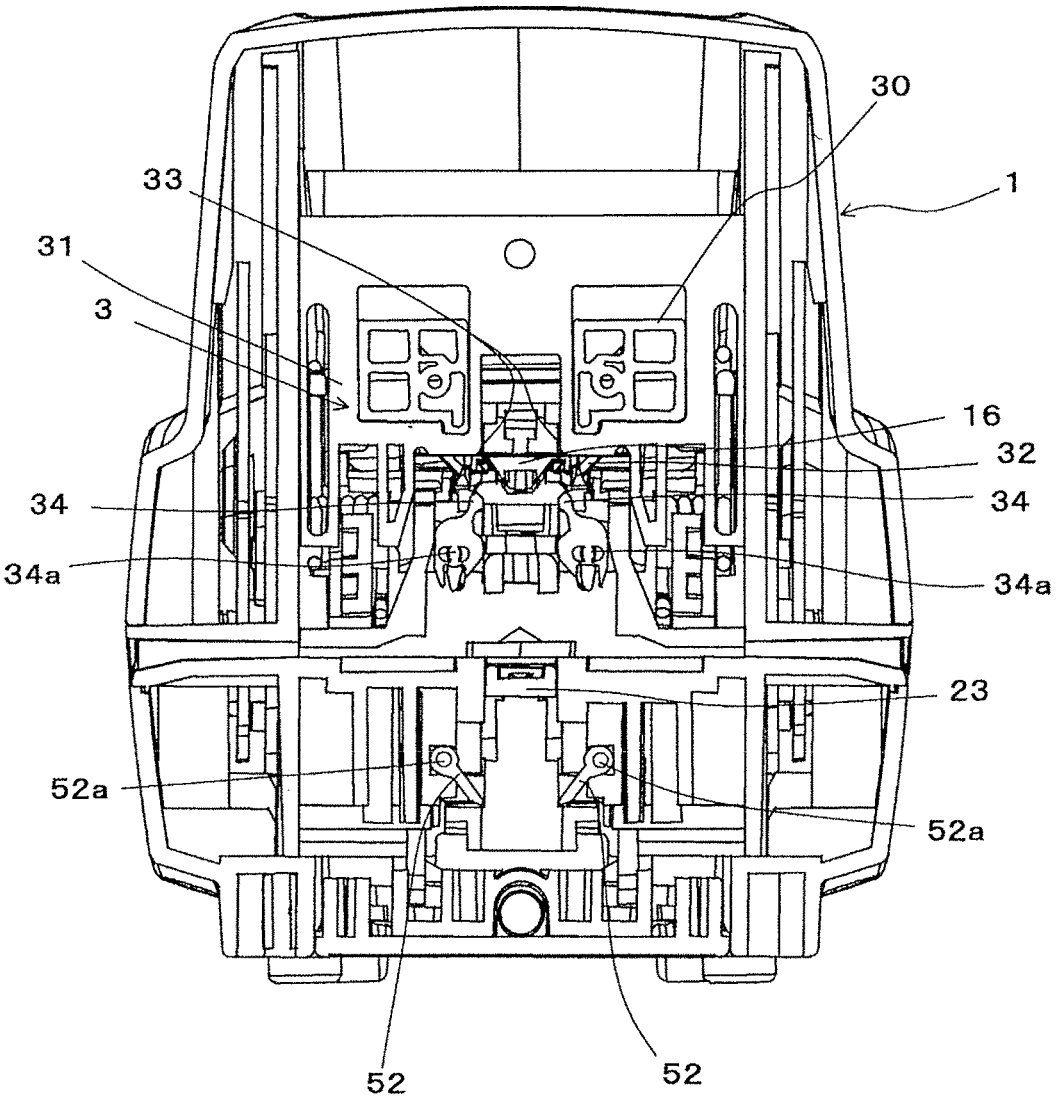
FIG. 78 is an operation chart illustrating an exemplary operation of the cutting/forming mechanism.

In the cutting/forming mechanism 3, as illustrated in FIG. 78, the cutter plate 30 and the forming plate 31 are lowered as one body, and as illustrated in FIG. 37, the staple material 10*m* located at the leading end of the staple-materials-connecting-body 10*a* is cut by the cutting blade 32. In addition, the staple forming portion 33 of the forming plate 31 abuts against the cut staple 10 to start the forming of the staple 10, and the leg portions 10*i* of the staple 10 are gradually bent by the staple forming portion 33.

Figure 49:
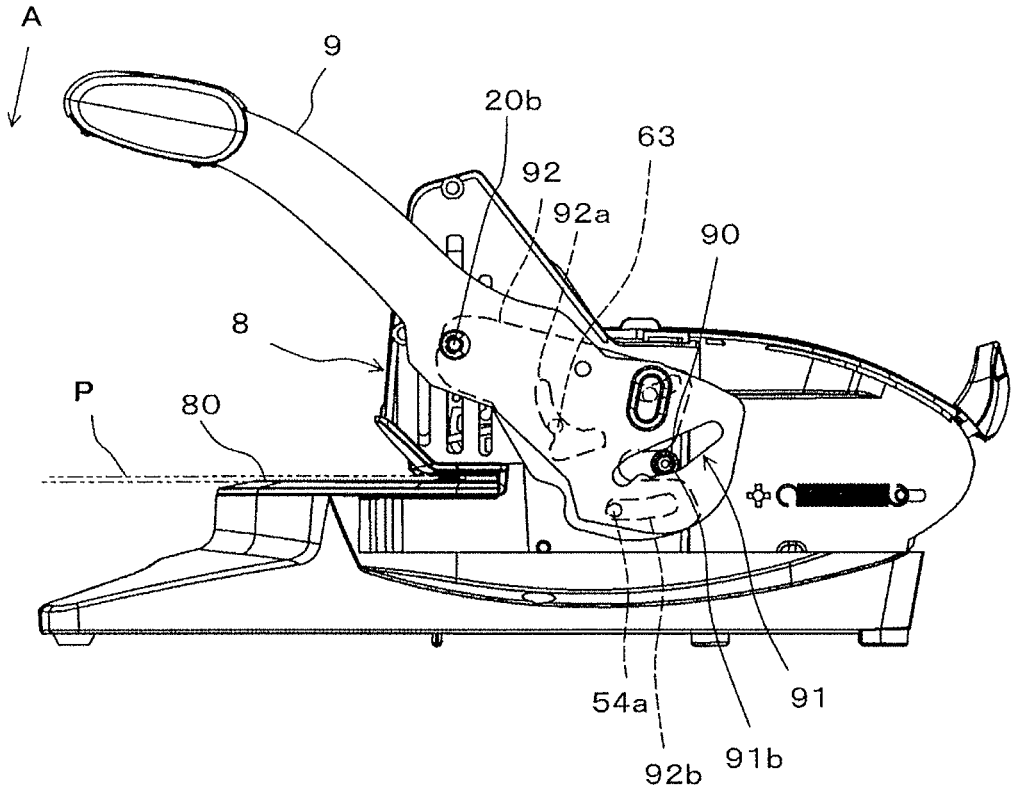
FIG. 49 is an operation chart illustrating an exemplary operation of the operating handle portion.

If the operating handle 9 is pushed down at the position illustrated in FIG. 54, as illustrated in FIG. 49, the elongated slot 92*b* of the link 92 abuts against the pin 54*a* of the slide member 54, and thus, the retreat of the slide member 54 starts.

Expansion Start of Hole

Figure 55:
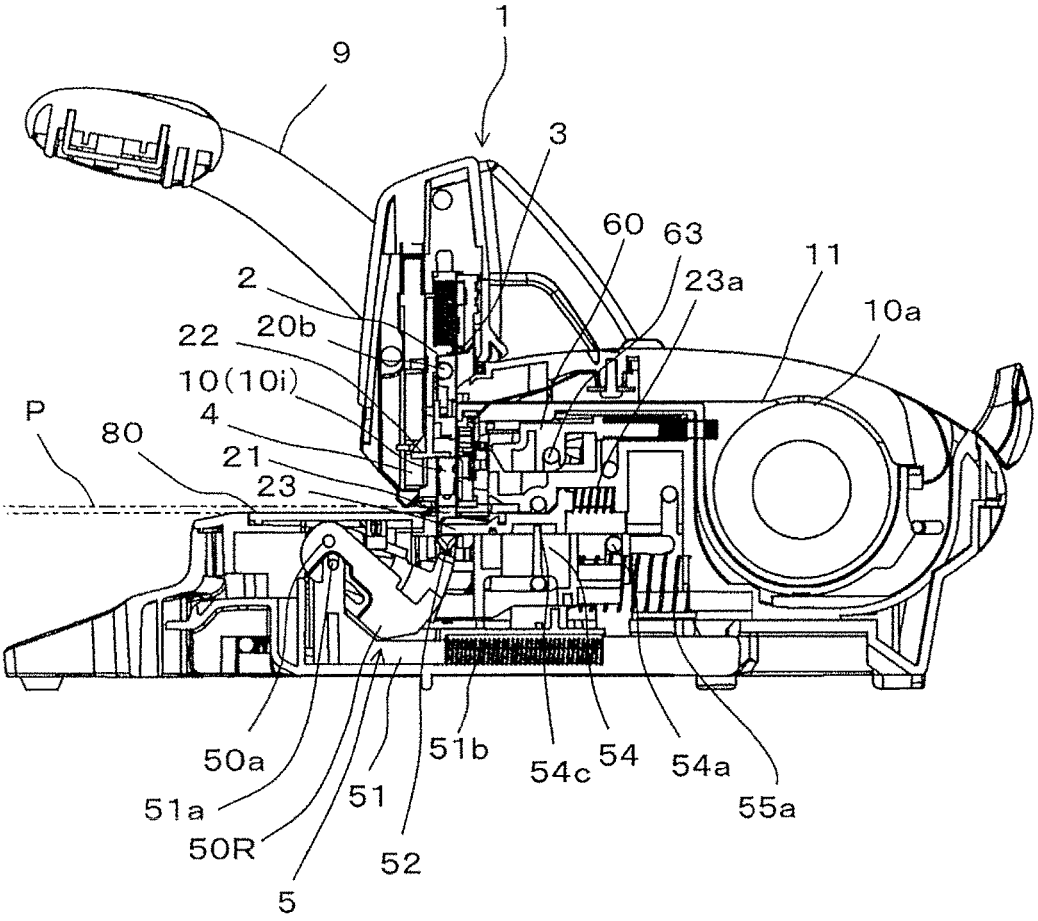
FIG. 55 is an operation chart illustrating an exemplary operation of the entire stapler.
Figure 67:
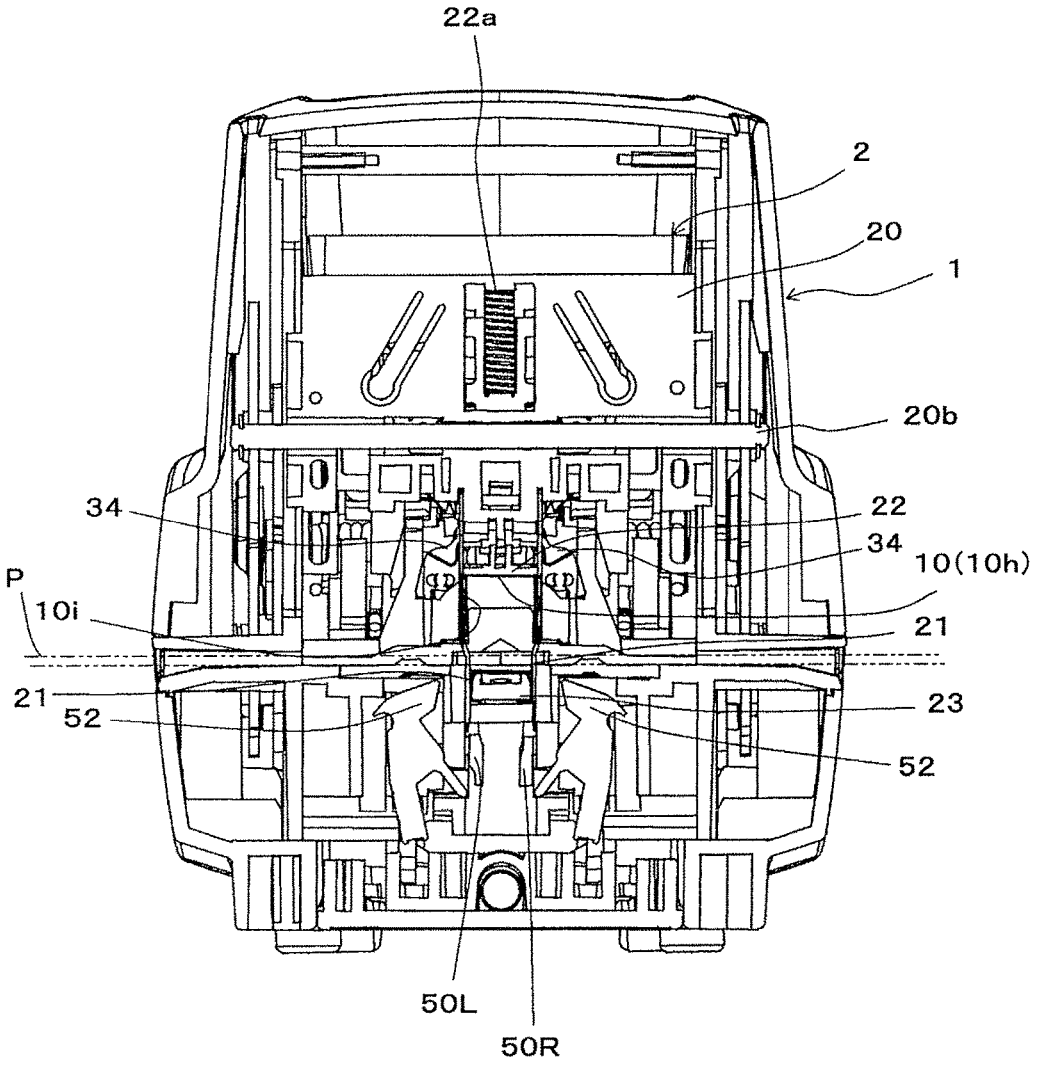
FIG. 67 is an operation chart illustrating an exemplary operation of the penetrating mechanism and the bending mechanism.
Figure 79:
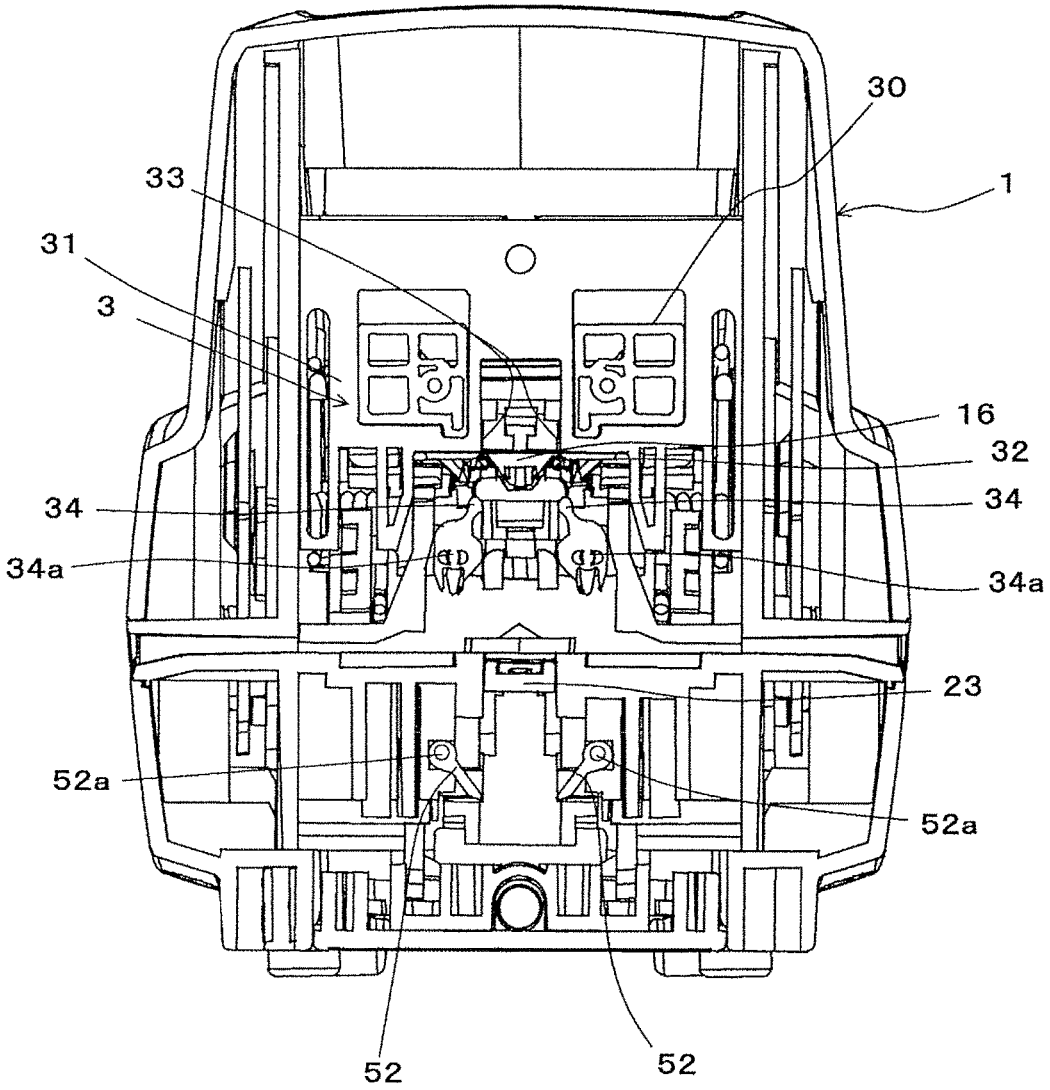
FIG. 79 is an operation chart illustrating an exemplary operation of the cutting/forming mechanism.

If the operating handle 9 is pushed down at the position illustrated in FIG. 55, the retreating operation of the pusher 60 and the slide member 54 is continuously performed. In the penetrating mechanism 2, as illustrated in FIGS. 21 and 67, the hole expansion portion 21*e* of the cutting blade 21 arrives at the paper sheets P, and the hole P1 opened in the paper sheets P is winded in the outward direction. The forming of the staple by the cutting/forming mechanism 3 is continuously performed, as illustrated in FIG. 79.

Operation Start of Opening Retaining Member

Figure 56:
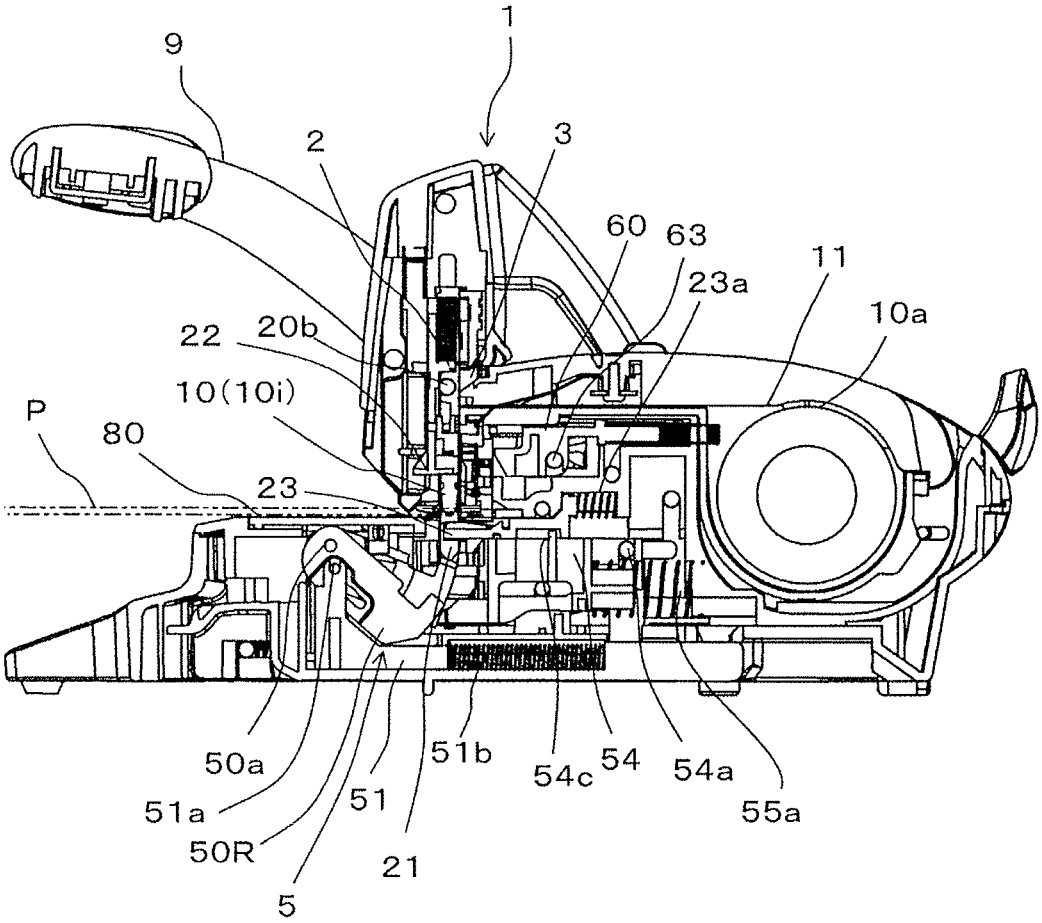
FIG. 56 is an operation chart illustrating an exemplary operation of the entire stapler.
Figure 68:
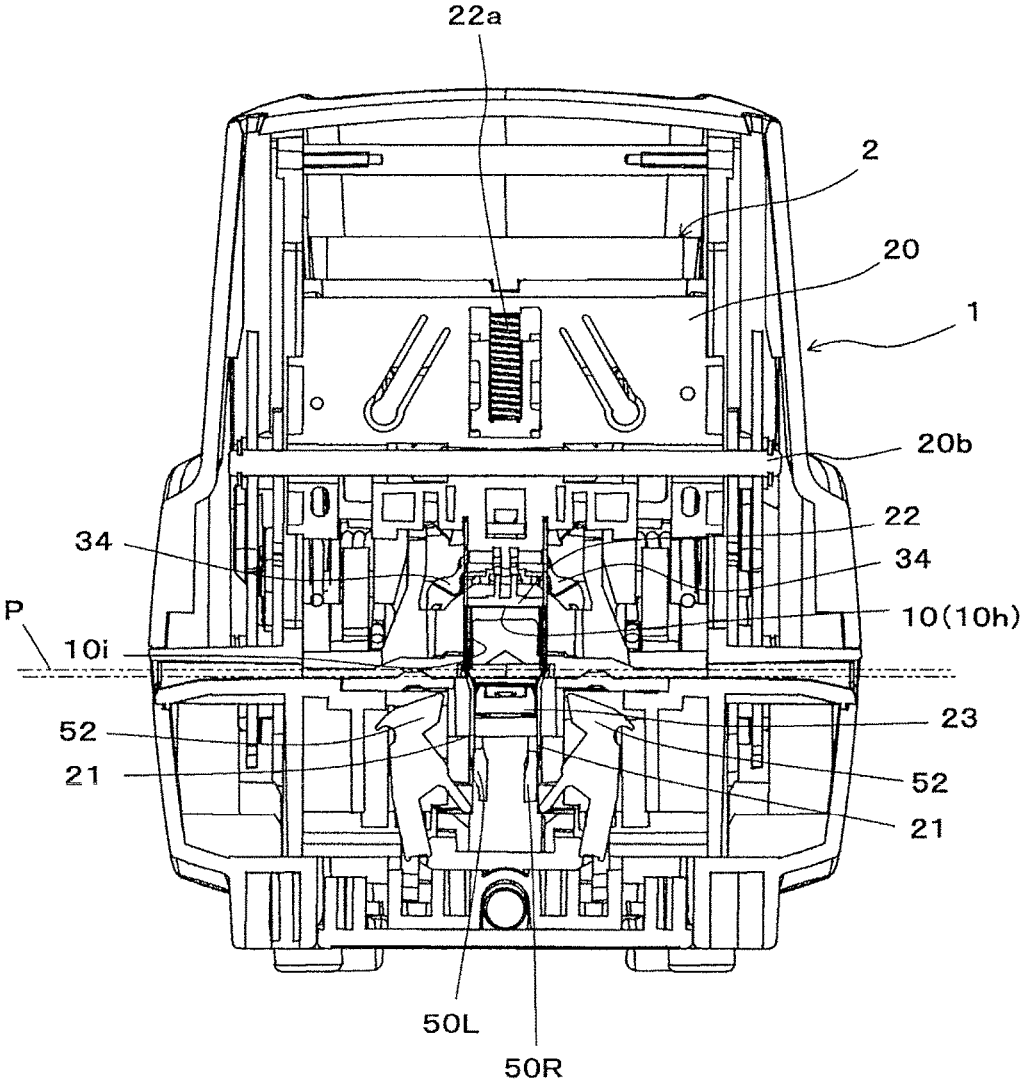
FIG. 68 is an operation chart illustrating an exemplary operation of the penetrating mechanism and the bending mechanism.
Figure 80:
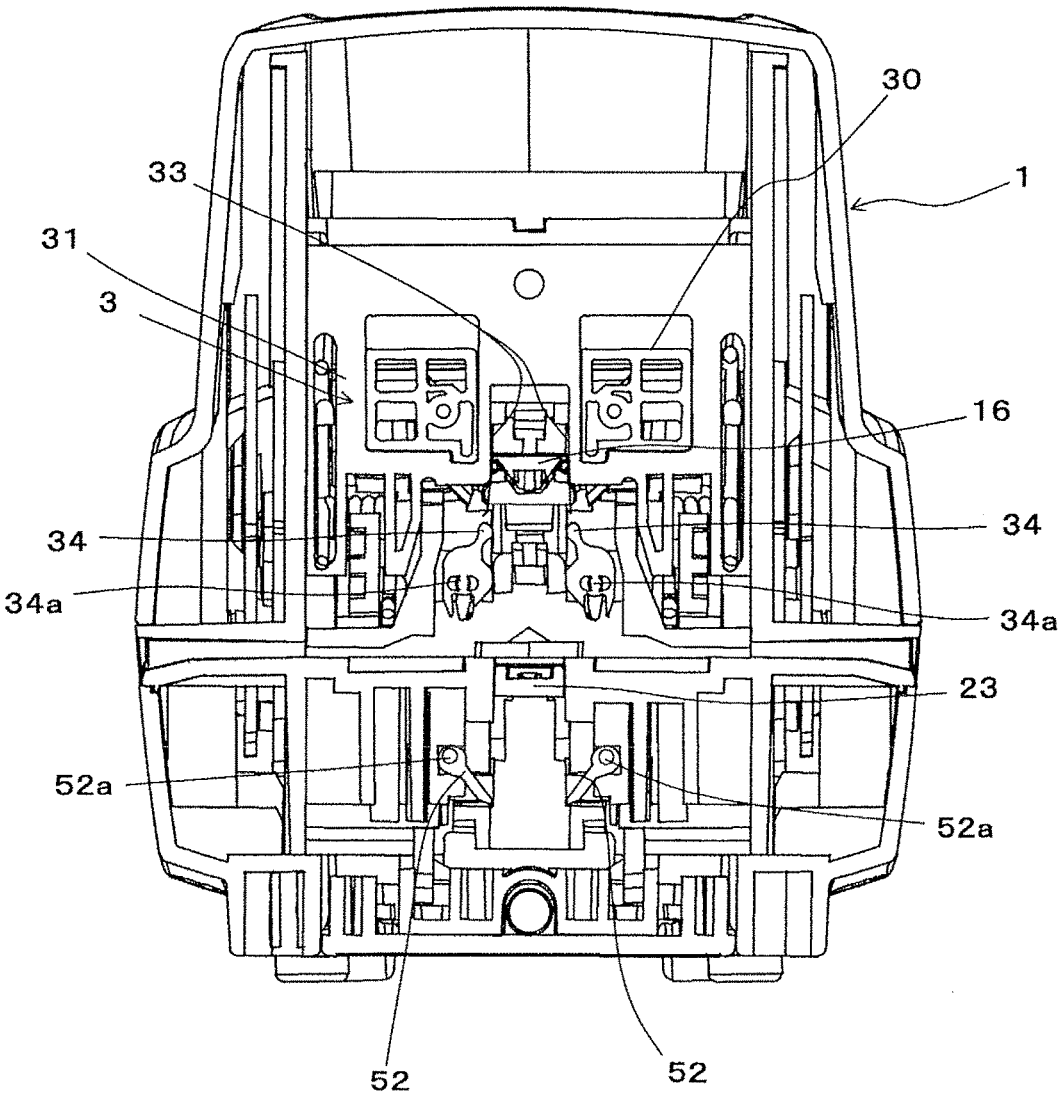
FIG. 80 is an operation chart illustrating an exemplary operation of the cutting/forming mechanism.

If the operating handle 9 is pushed down at the position illustrated in FIG. 56, the retreating operation of the pusher 60 and the slide member 54 is continuously performed. In the penetrating mechanism 2, as illustrated in FIG. 68, the hole expansion portion 21*e* of the cutting blade 21 penetrates the paper sheets P. In the cutting/forming mechanism 3, as illustrated in FIG. 80, as the cutter plate 30 and the forming plate 31 are lowered, the opening retaining members 34 abut against open cam surfaces 84*a* formed on the body section 8, and thus starts opening outwardly.

Operation End of Cutting Blade Guide

Figure 57:
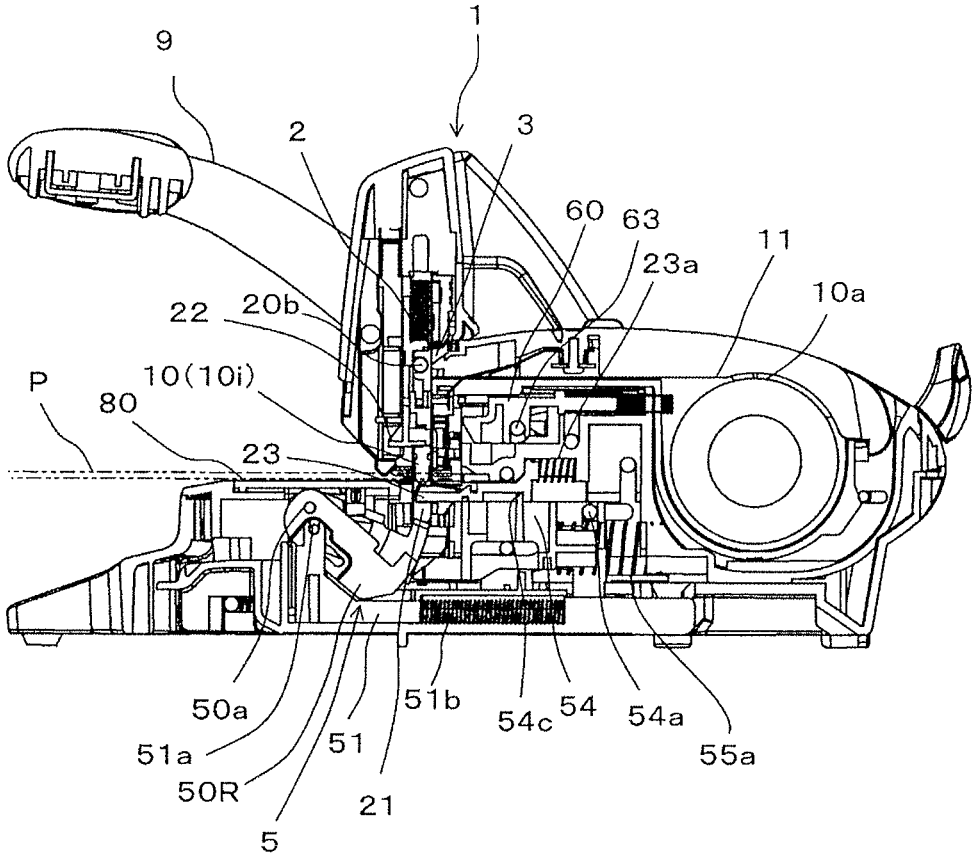
FIG. 57 is an operation chart illustrating an exemplary operation of the entire stapler.

If the operating handle 9 is pushed down at the position illustrated in FIG. 57, the retreating operation of the pusher 60 and the slide member 54 is continuously performed, and the operating convex portion 54*c* of the slide member 54 abuts against the cutting blade guide 23. The spring 23*a* is compressed, and the cutting blade guide 23 starts retreating.

Figure 69:
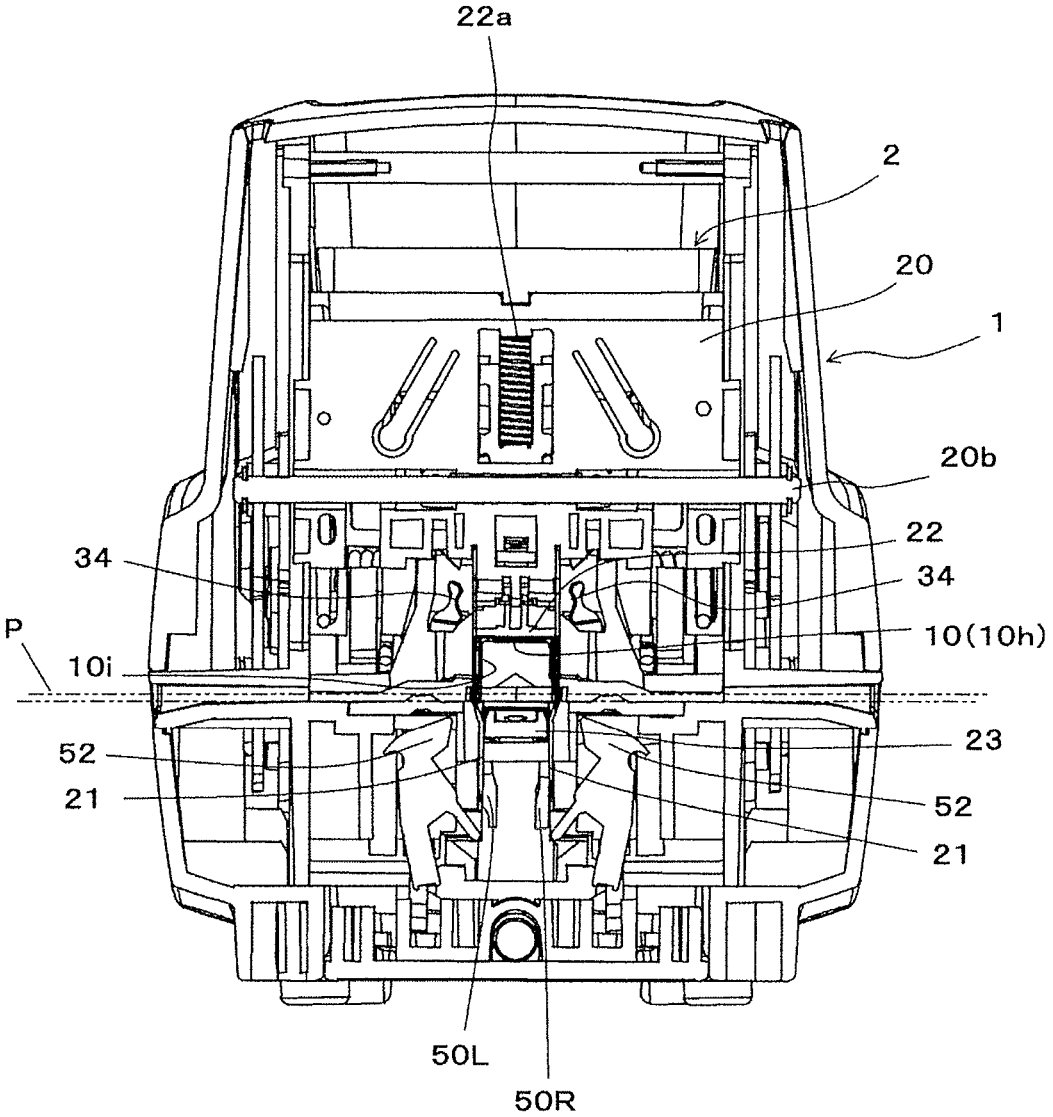
FIG. 69 is an operation chart illustrating an exemplary operation of the penetrating mechanism and the bending mechanism.

In the penetrating mechanism 2, as illustrated in FIG. 69, the second penetrating portion 21*c* of the cutting blade 21 penetrates the paper sheets P, and thus the staple 10 held inside the cutting blades 21 penetrates the paper sheets P. The front end of each cutting blade 21 is guided by the first bending member 50R and the second bending member 50L. As a result, even though the cutting blade guide 23 is retreated, the displacement in the inclining direction is suppressed.

Figure 81:
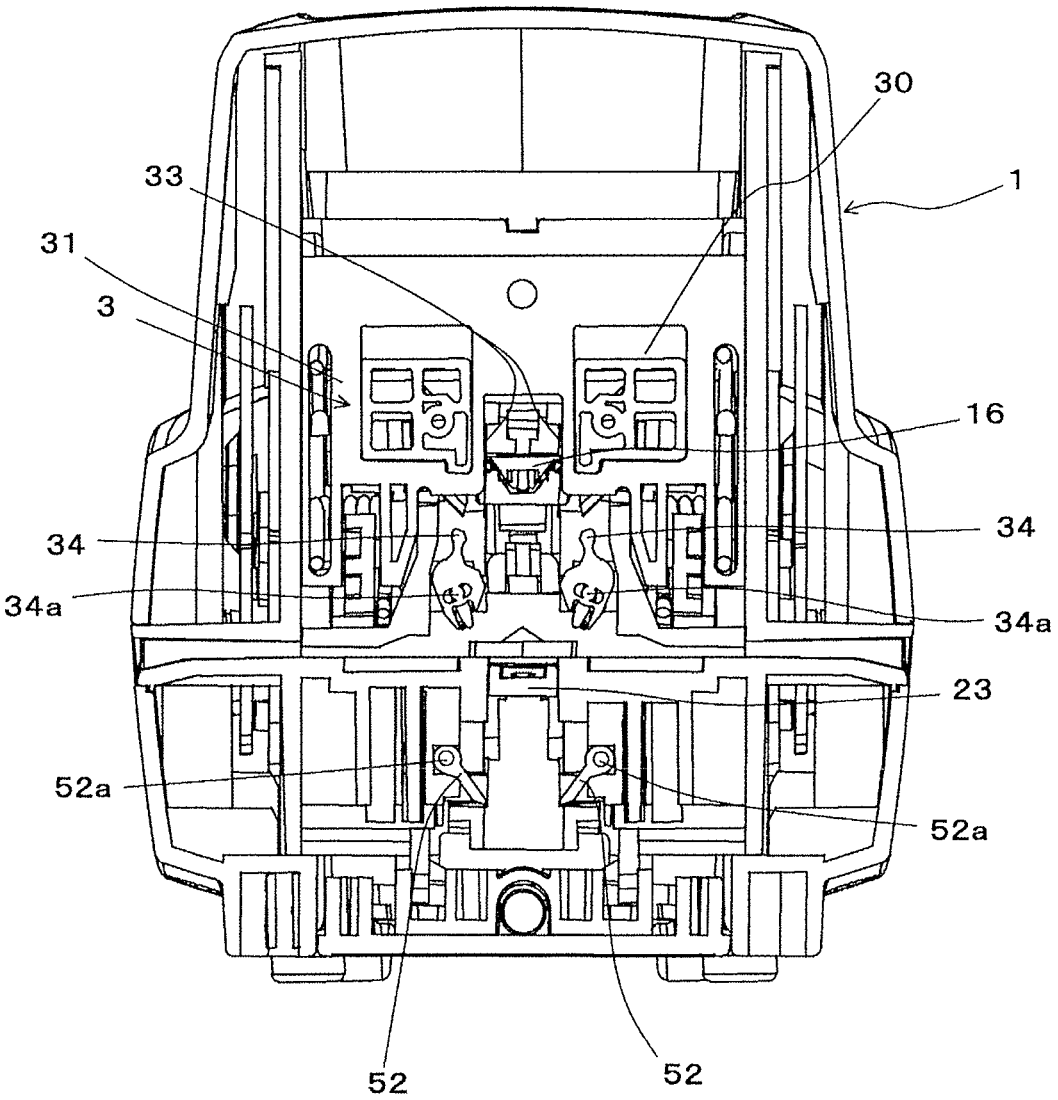
FIG. 81 is an operation chart illustrating an exemplary operation of the cutting/forming mechanism.
Figure 82:
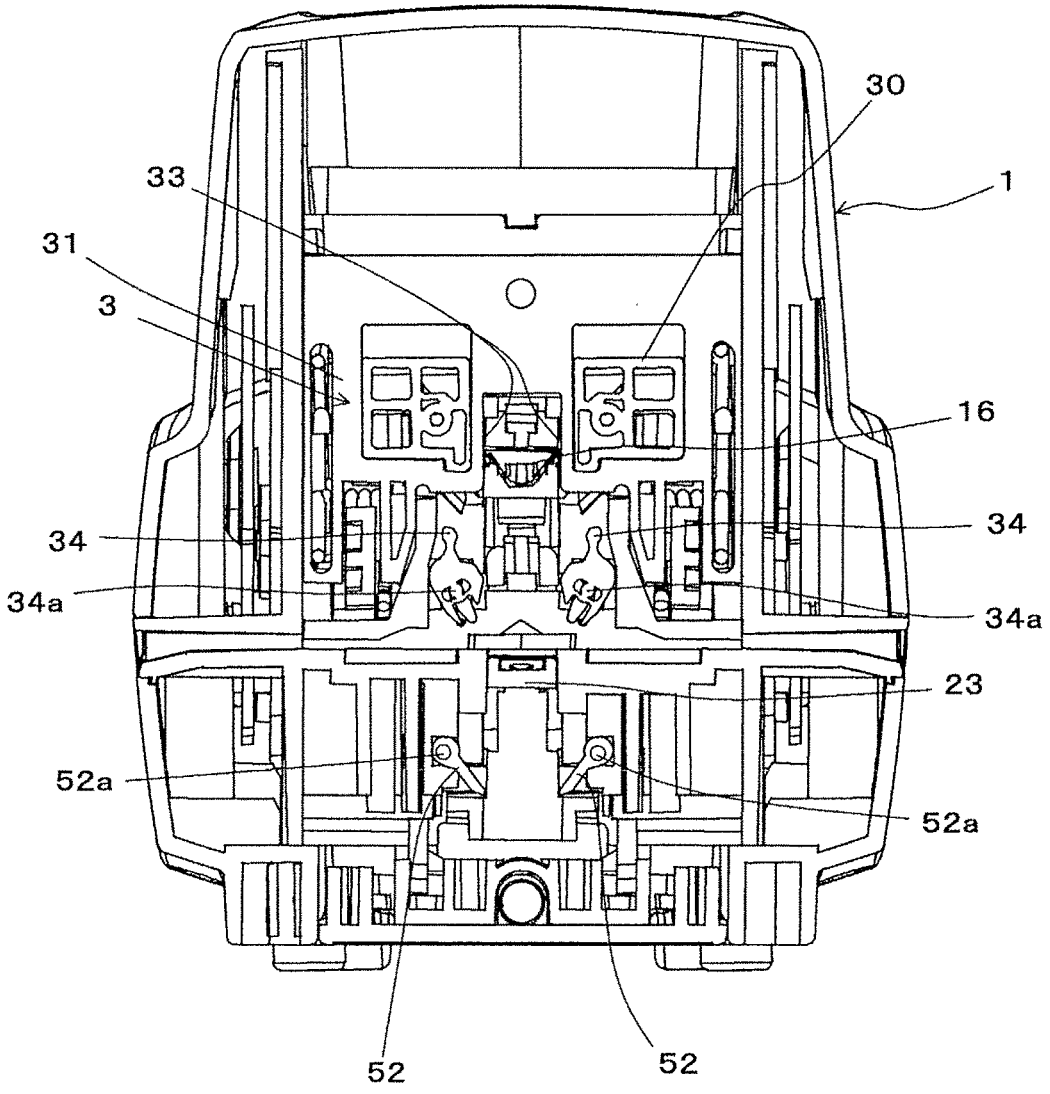
FIG. 82 is an operation chart illustrating an exemplary operation of the cutting/forming mechanism.
Figure 83:
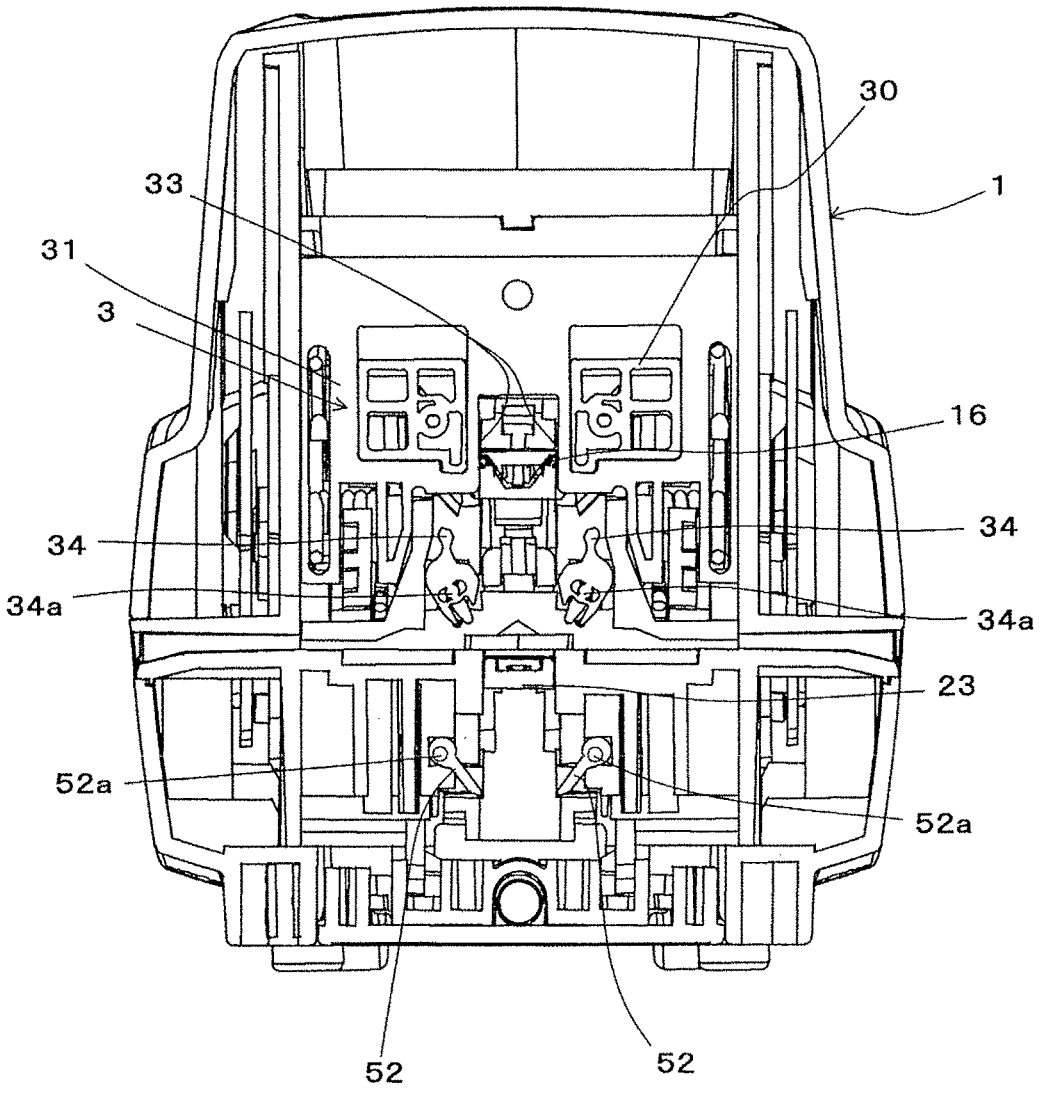
FIG. 83 is an operation chart illustrating an exemplary operation of the cutting/forming mechanism.
Figure 84:
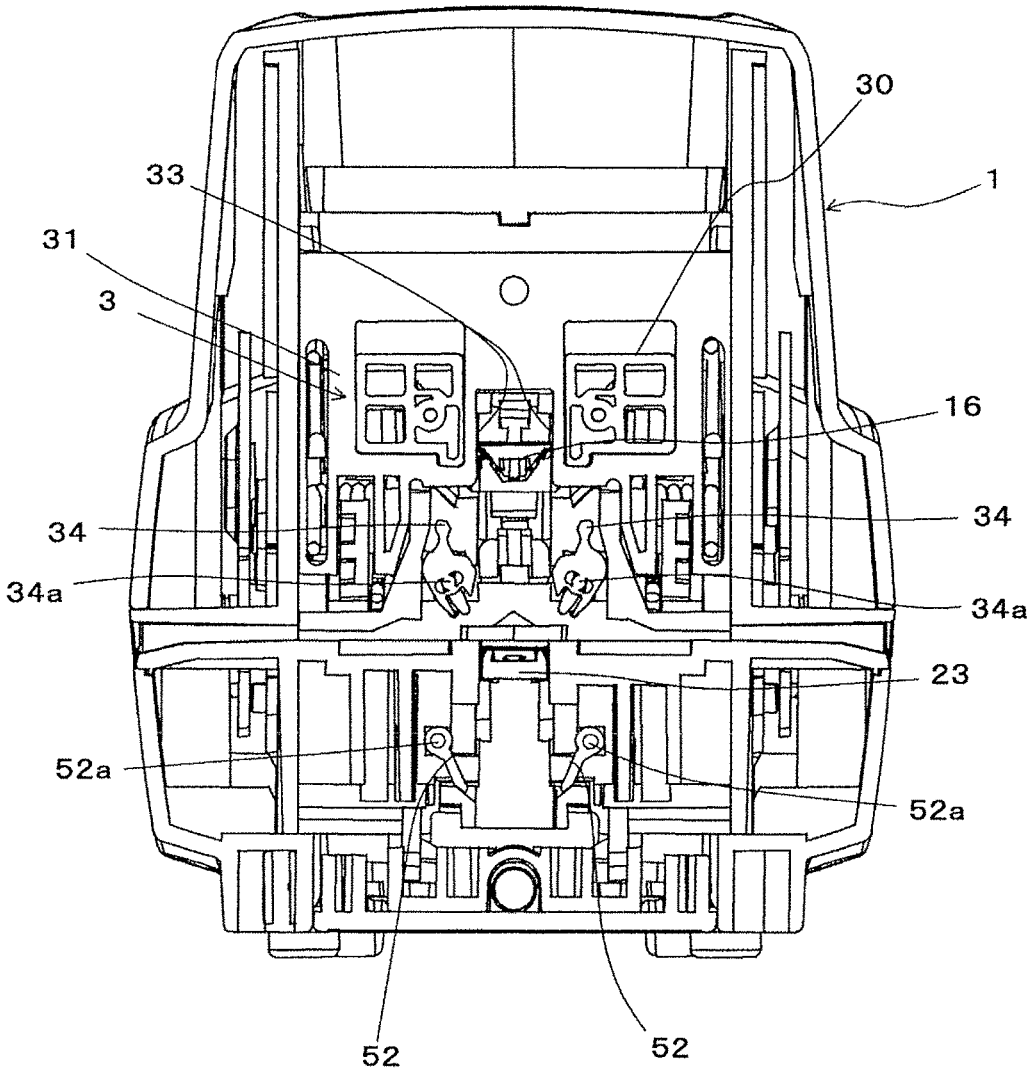
FIG. 84 is an operation chart illustrating an exemplary operation of the cutting/forming mechanism.
Figure 85:
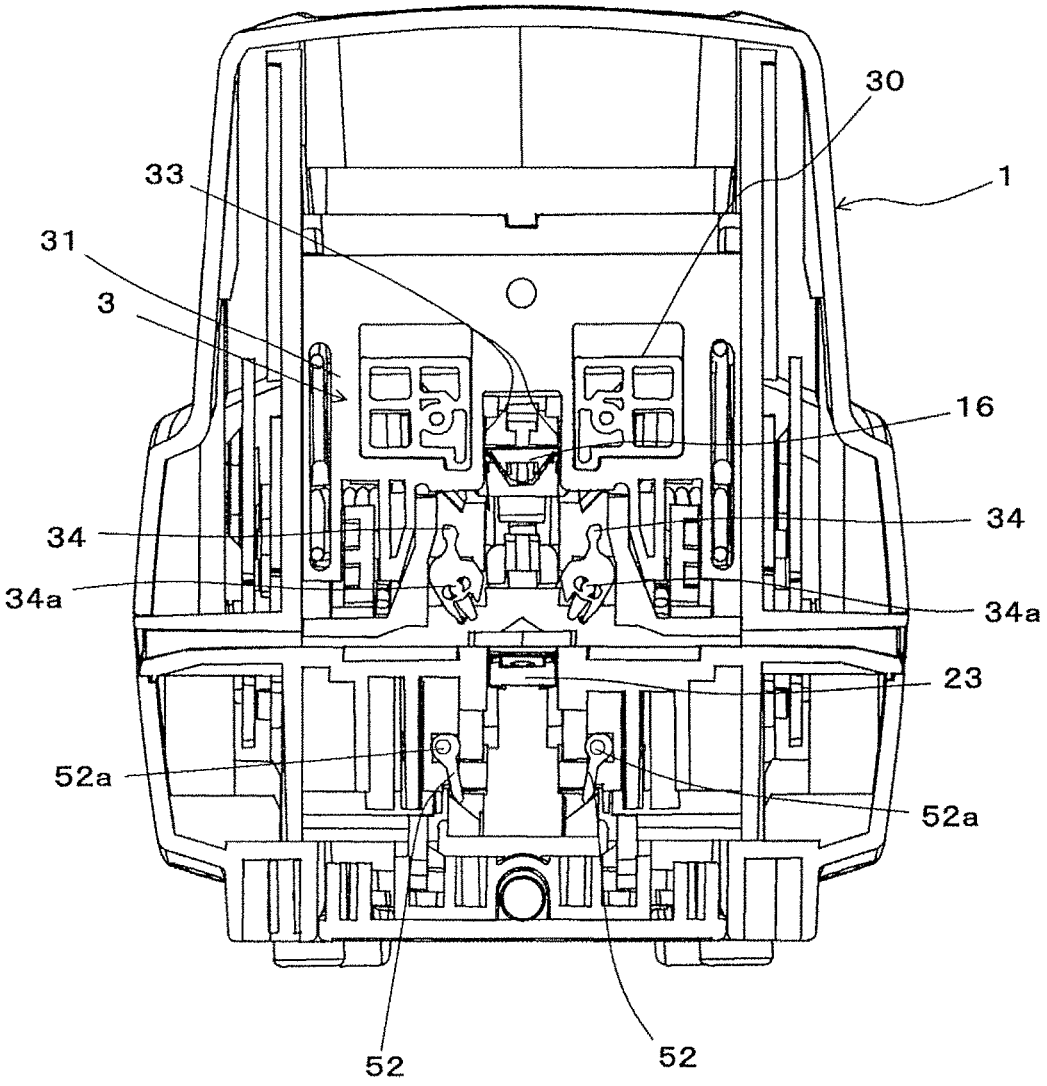
FIG. 85 is an operation chart illustrating an exemplary operation of the cutting/forming mechanism.
Figure 86:
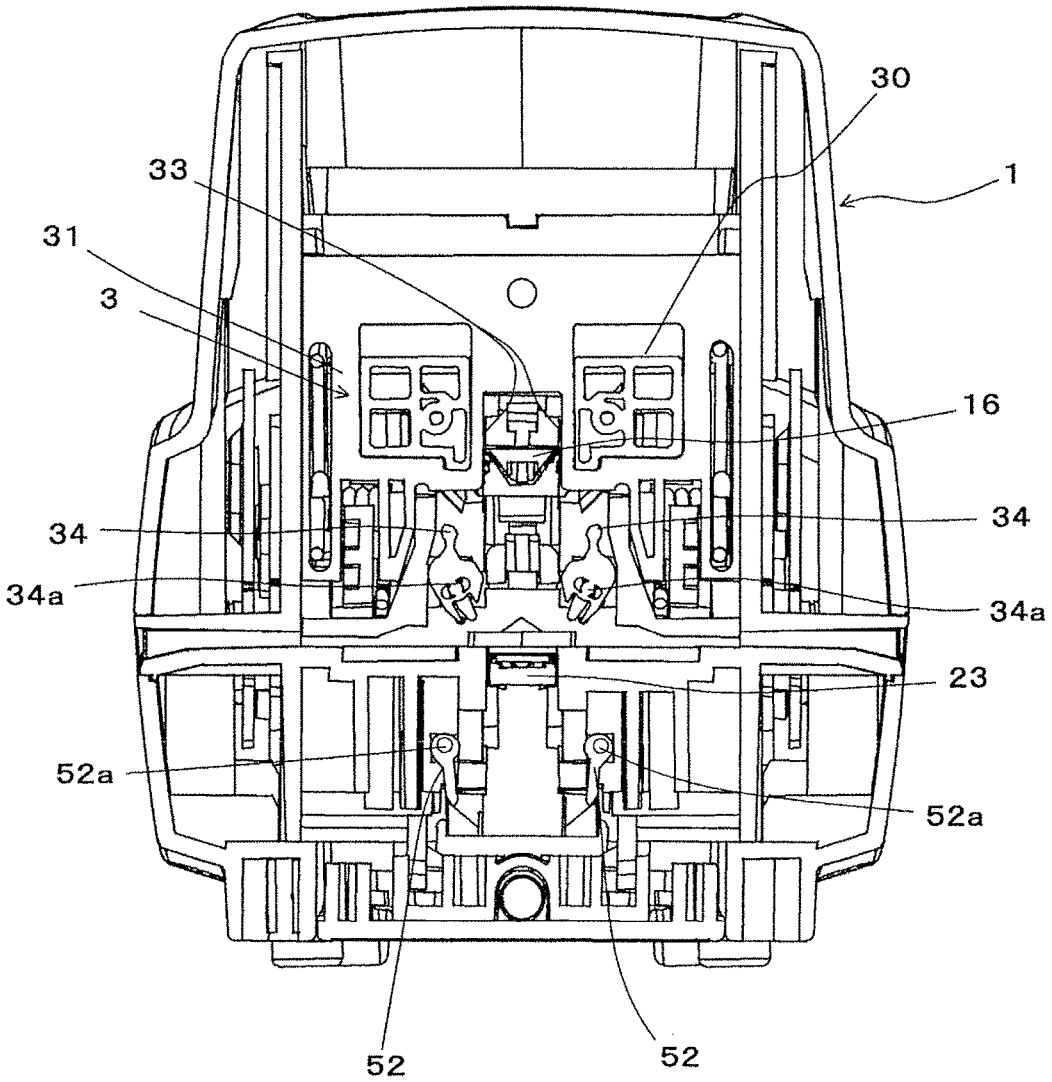
FIG. 86 is an operation chart illustrating an exemplary operation of the cutting/forming mechanism.
Figure 87:
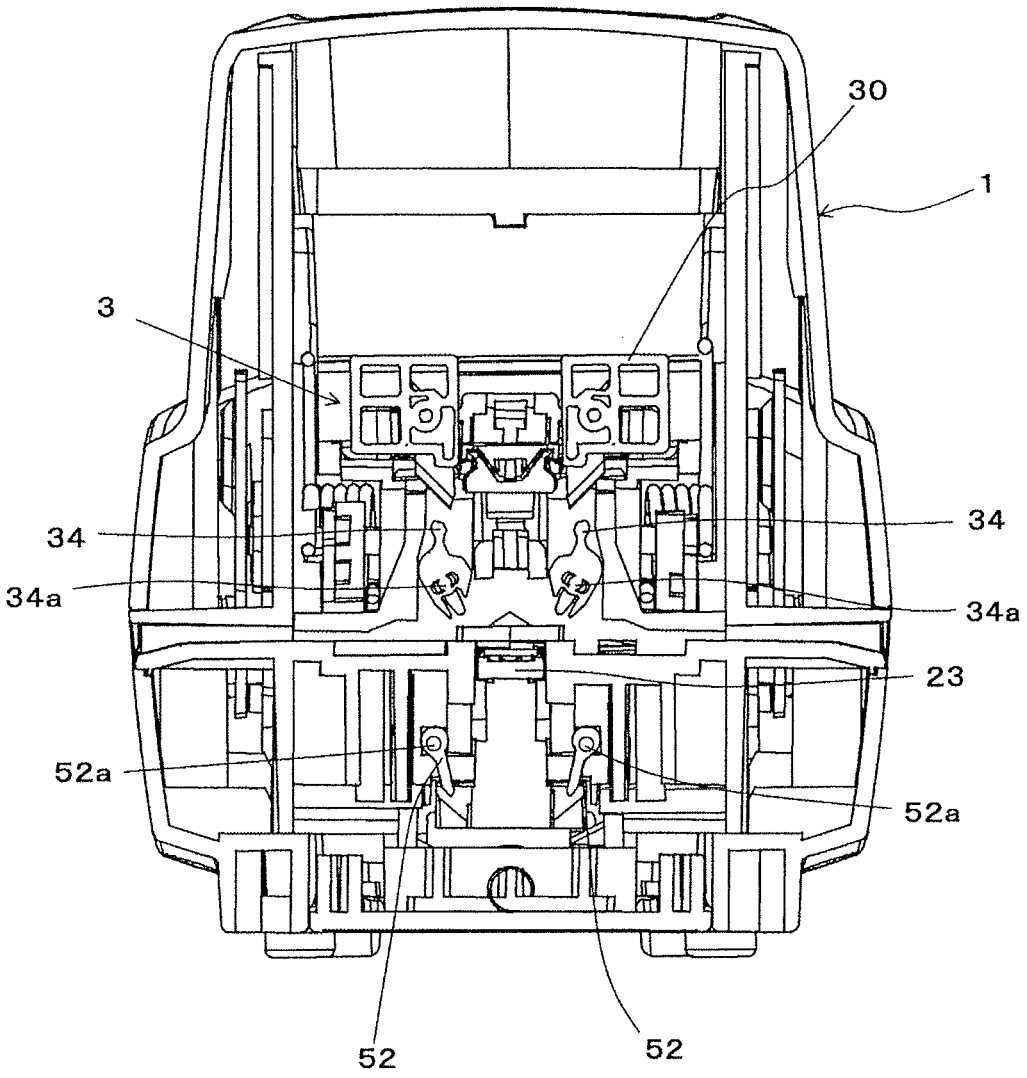
FIG. 87 is an operation chart illustrating an exemplary operation of the cutting/forming mechanism.

In the cutting/forming mechanism 3, as illustrated in FIGS. 35 and 81, as the cutter plate 30 and the forming plate 31 are lowered, the staple 10 is bent in the first direction so that the one pair of leg portions 10*i* are substantially parallel to each other, thereby forming the crown portion 10*h* and the leg portions 10*i*. As a result, the forming is terminated. Also, opening retaining members 34 are opened, and then the operation is terminated.

Operation End of Opening Retaining Members

Figure 58:
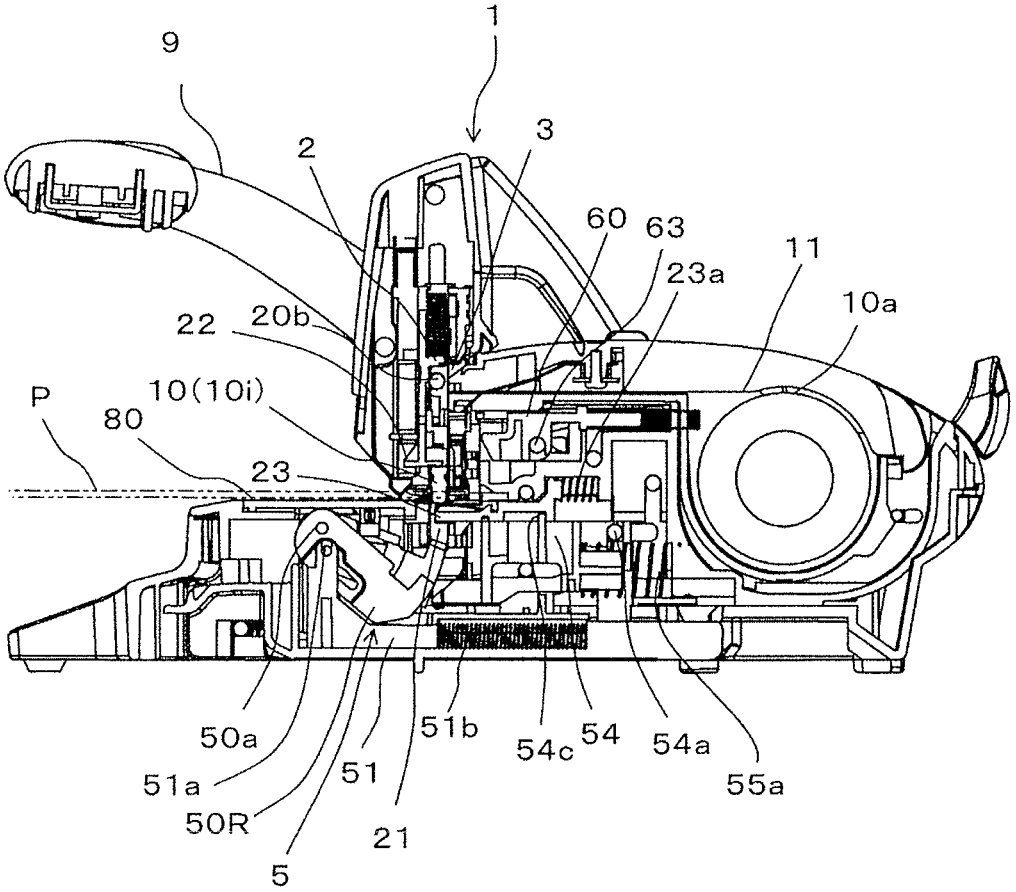
FIG. 58 is an operation chart illustrating an exemplary operation of the entire stapler.
Figure 70:
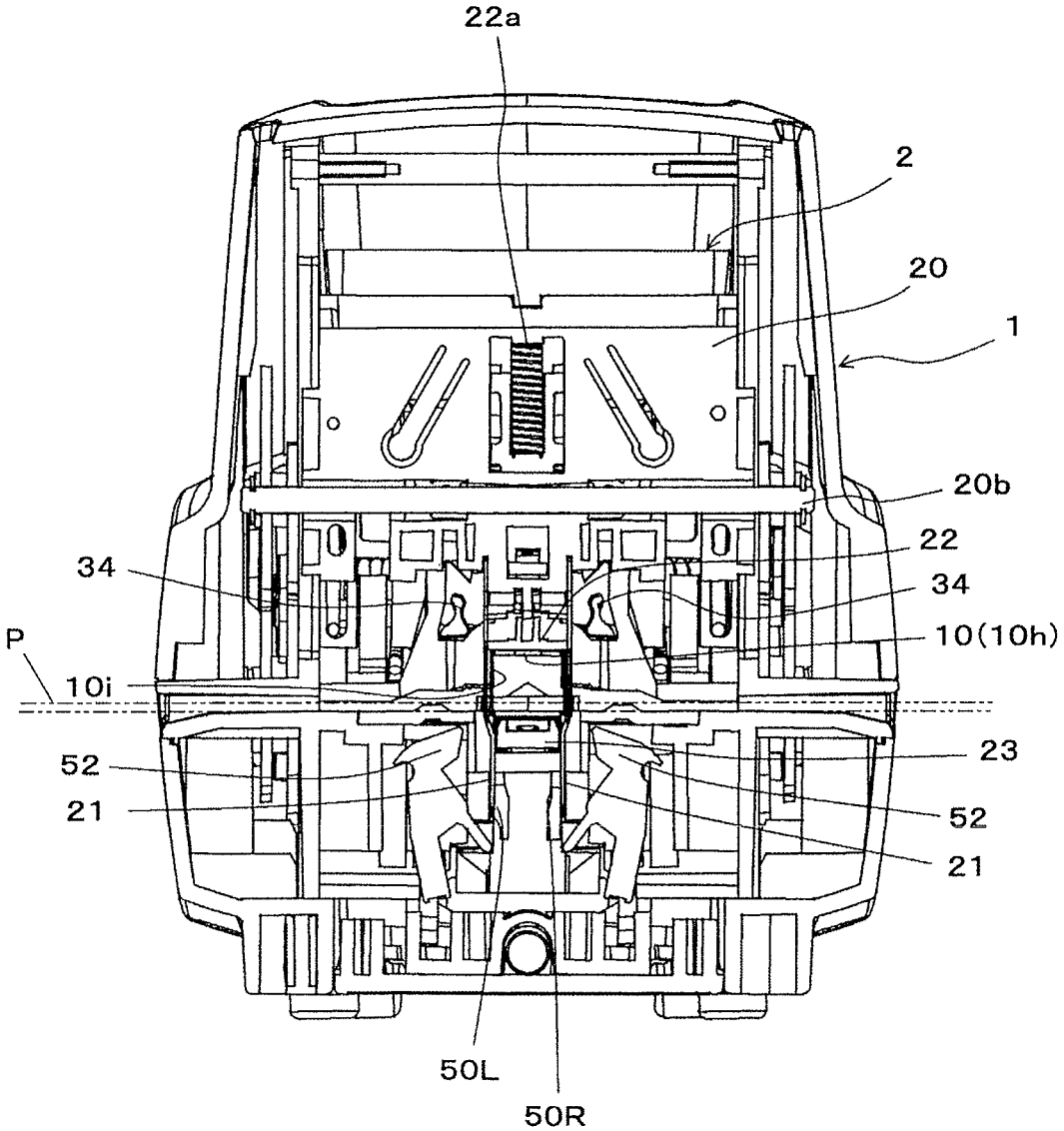
FIG. 70 is an operation chart illustrating an exemplary operation of the penetrating mechanism and the bending mechanism.

If the operating handle 9 is pushed down at the position illustrated in FIG. 58, the retreating operation of the pusher 60 and the slide member 54 is continuously performed In the penetrating mechanism 2, as illustrated in FIG. 70, the second penetrating portion 21*c* of the cutting blade 21 penetrates the paper sheets P, and the staple 10 held inside the cutting blades 21 starts penetrating the paper sheets P. The cutting/forming mechanism 3 is lowered to a lower end position shown in FIG. 82, and thus is not operated.

Operation Start of Ejecting Member

Figure 59:
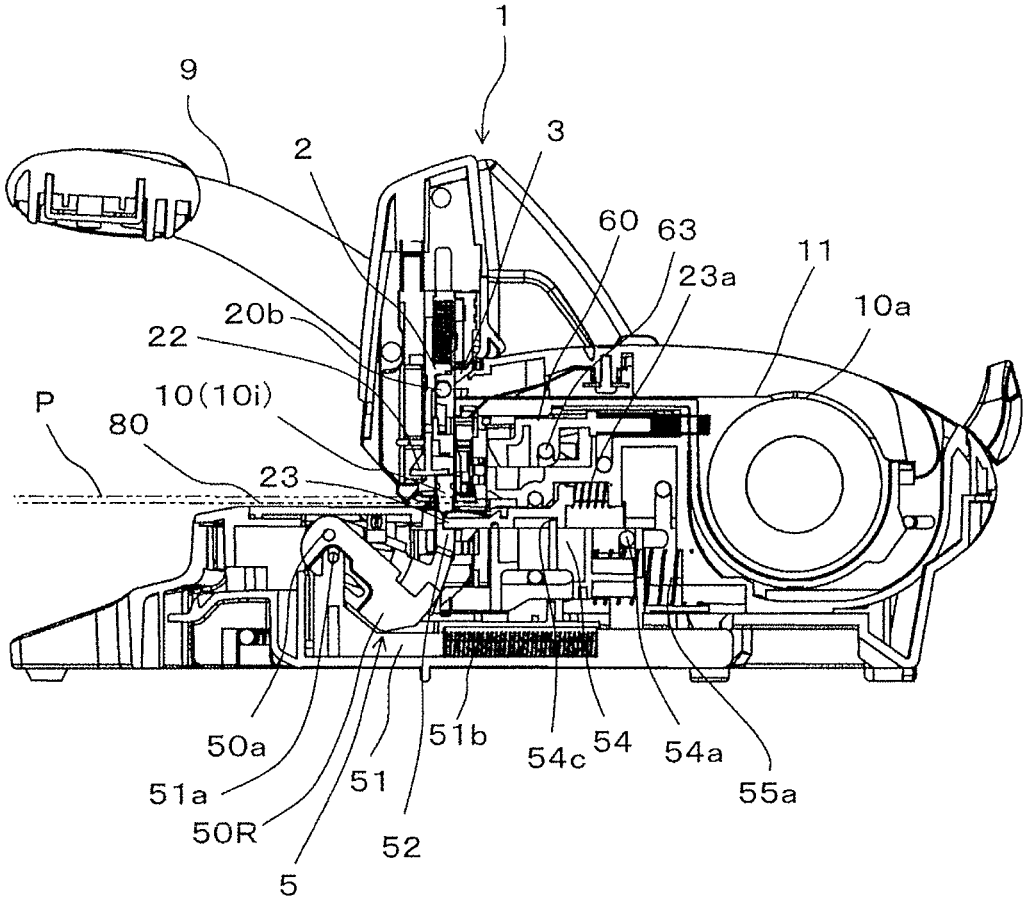
FIG. 59 is an operation chart illustrating an exemplary operation of the entire stapler.
Figure 71:
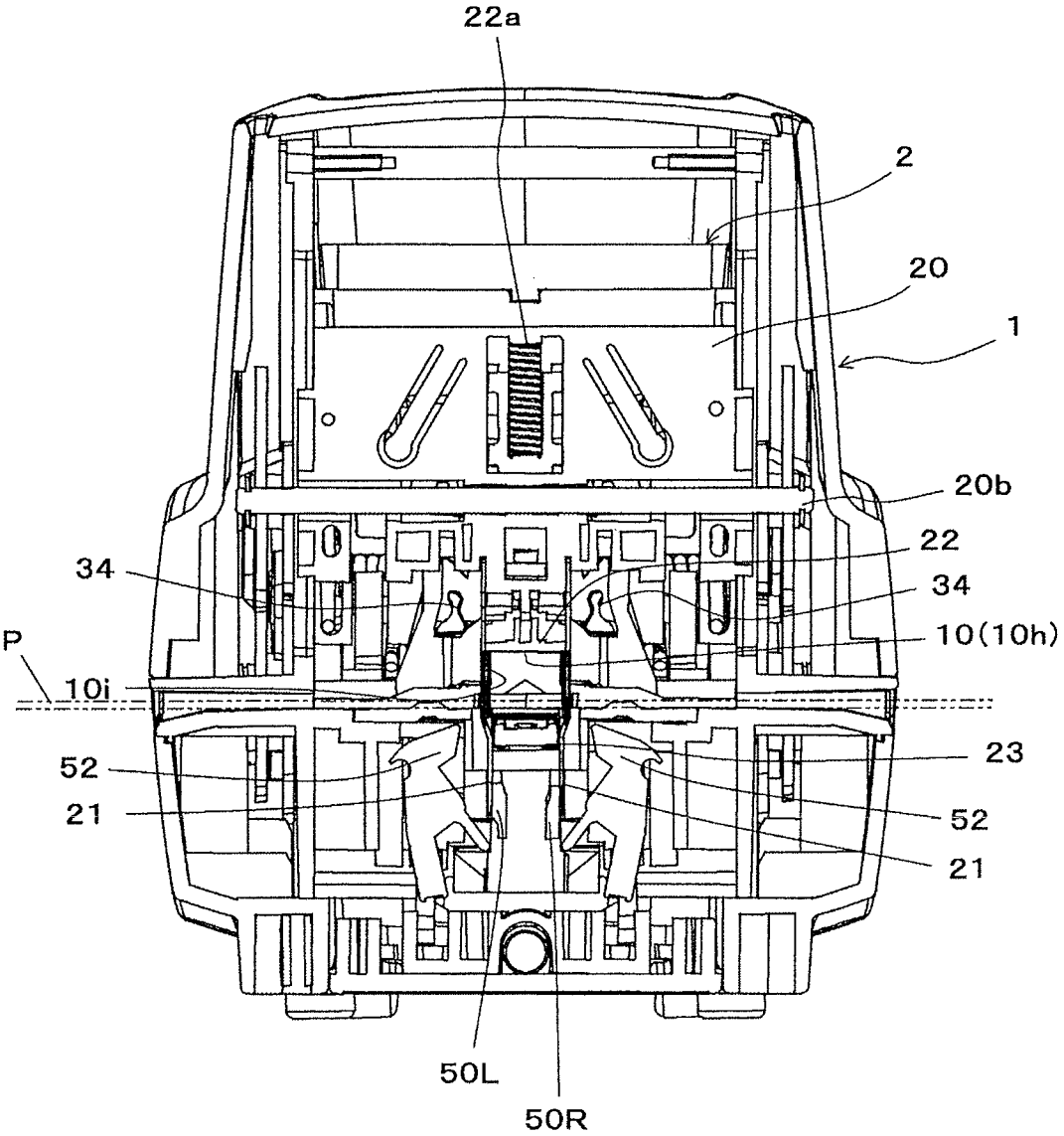
FIG. 71 is an operation chart illustrating an exemplary operation of the penetrating mechanism and the bending mechanism.

If the operating handle 9 is pushed down at the position illustrated in FIG. 59, the retreating operation of the pusher 60 and the slide member 54 is continuously performed, and is guided by the guide surface of the guide portion 54*b* of the slide member 54. As a result, as illustrated in FIG. 71, the ejecting members 52 start closing in the inward direction. In the penetrating mechanism 2, the second penetrating portion 21*c* of the cutting blade 21 penetrates the paper sheets P, and thus the staple 10 held inside the cutting blades 21 penetrate the paper sheets P. The cutting/forming mechanism 3 is lowered to a lower end position shown in FIG. 83, and thus is not operated.

Start of Staple Bending

Figure 60:
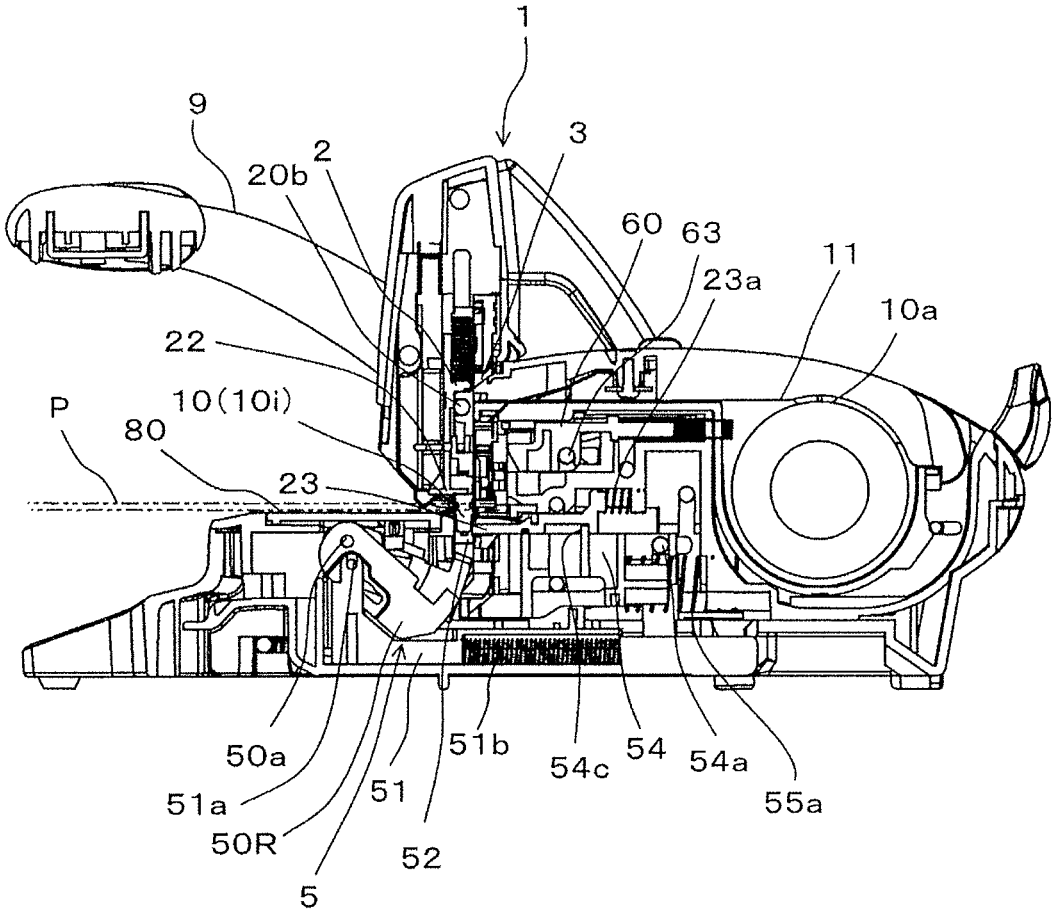
FIG. 60 is an operation chart illustrating an exemplary operation of the entire stapler.

If the operating handle 9 is pushed down at the position illustrated in FIG. 60, the retreating operation of the pusher 60 and the slide member 54 is continuously performed, and is guided by the guide surface of the guide portion 54*b* of the slide member 54. As a result, the ejecting members 52 are closed in the inward direction, and protrude into the ejecting hole 21*f* of the cutting blade 21 lowered at the predetermined position. The cutting/forming mechanism 3 is lowered to a lower end position shown in FIG. 84, and thus is not operated.

Figure 72:
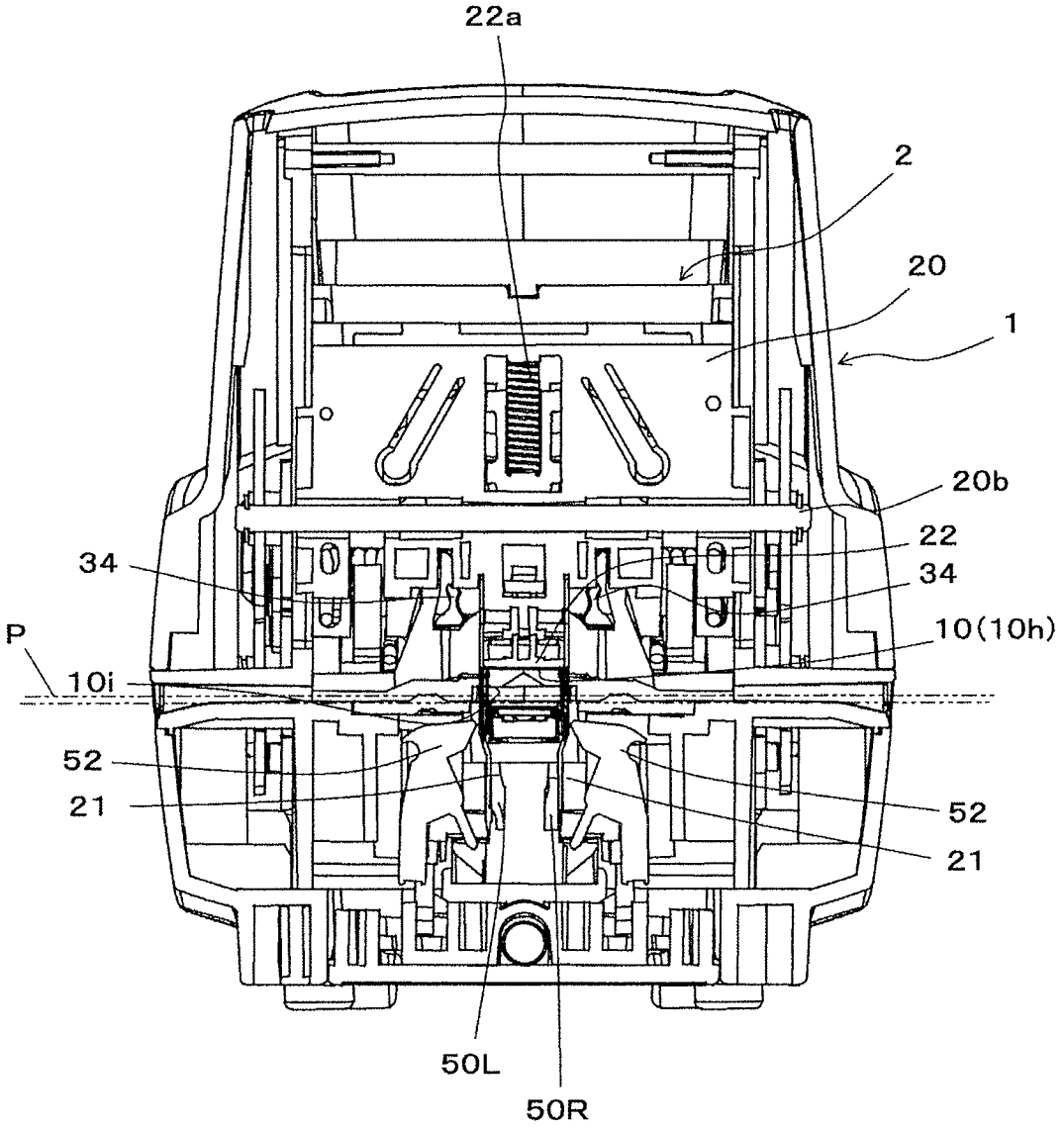
FIG. 72 is an operation chart illustrating an exemplary operation of the penetrating mechanism and the bending mechanism.

In the penetrating mechanism 2, as illustrated in FIG. 72, the second penetrating portion 21*c* of the cutting blade 21 penetrates the paper sheets P. In association with the penetrating operation of the staple 10 held inside the cutting blades 21 into the paper sheets P, the one pair of leg portions 10*i* of the staple 10 are bent in the inward direction by the ejecting member 52 protruding into the ejecting hole 21*f*.

Landing of Staple Press-Down Portion

Figure 50:
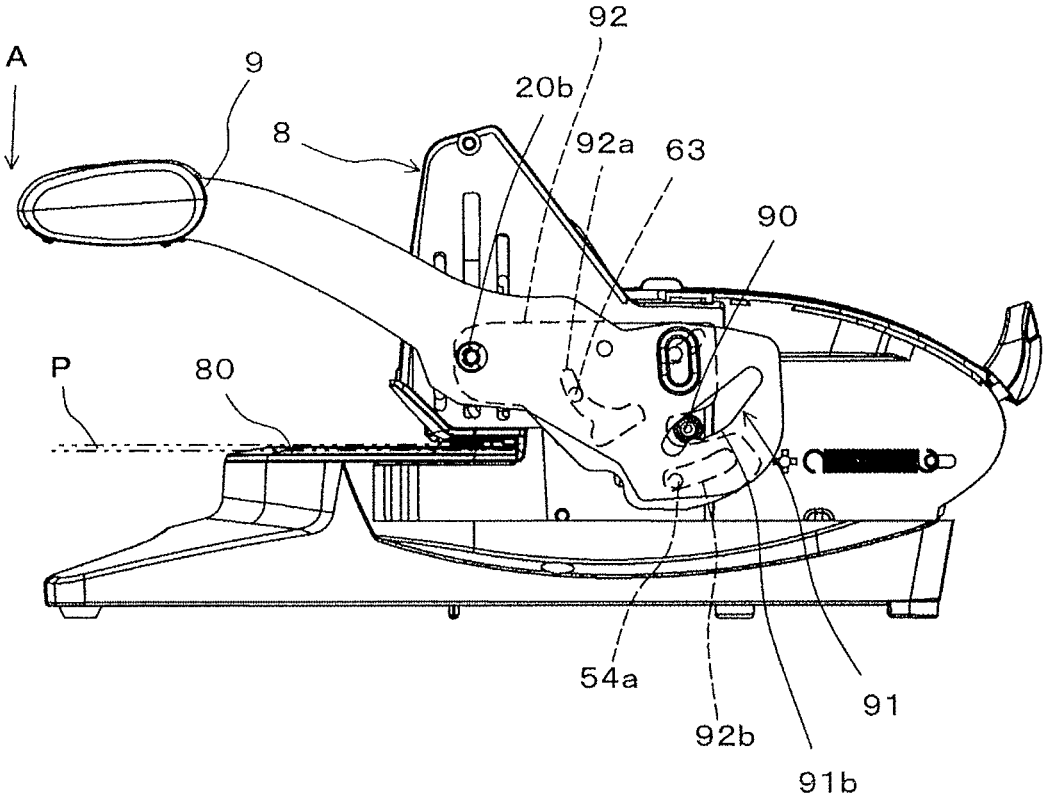
FIG. 50 is an operation chart illustrating an exemplary operation of the operating handle portion.
Figure 61:
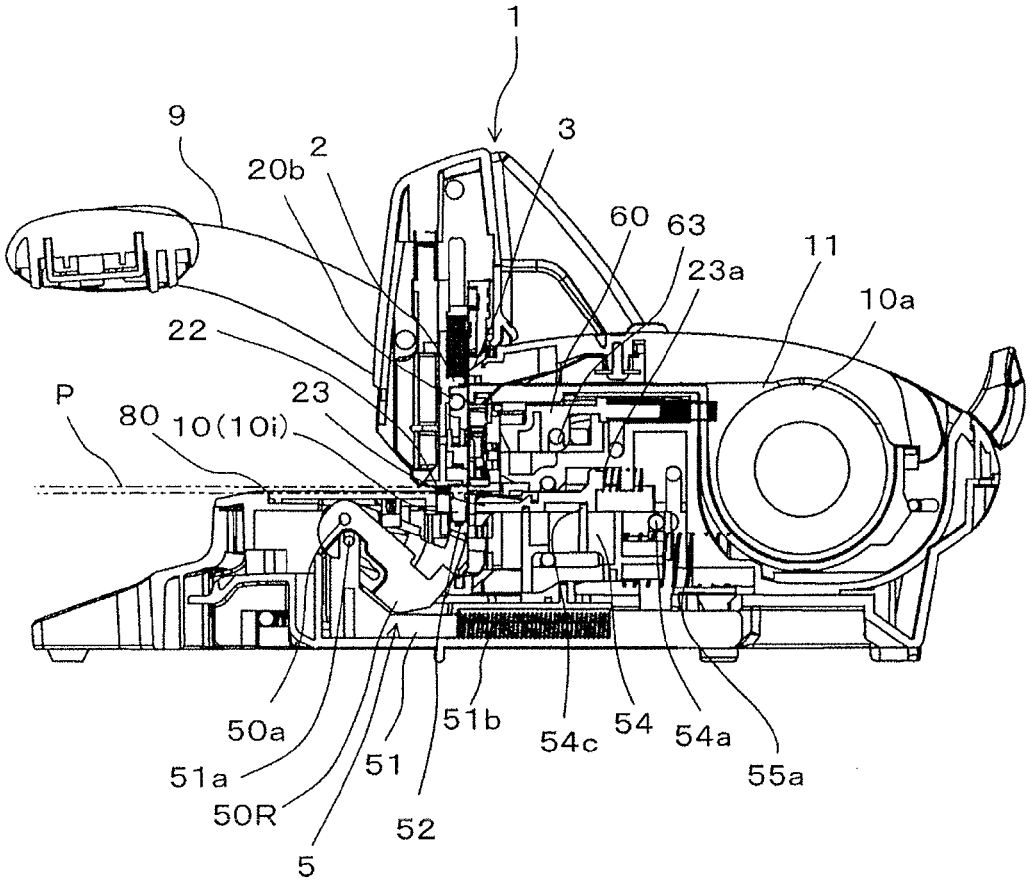
FIG. 61 is an operation chart illustrating an exemplary operation of the entire stapler.

If the operating handle 9 is pushed down at the position illustrated in FIGS. 50 and 61, the retreating operation of the pusher 60 and the slide member 54 is continuously performed. In the penetrating mechanism 2, as illustrated in FIG. 73, the staple press-down portion 22 lands on the paper sheets P.

Figure 73:
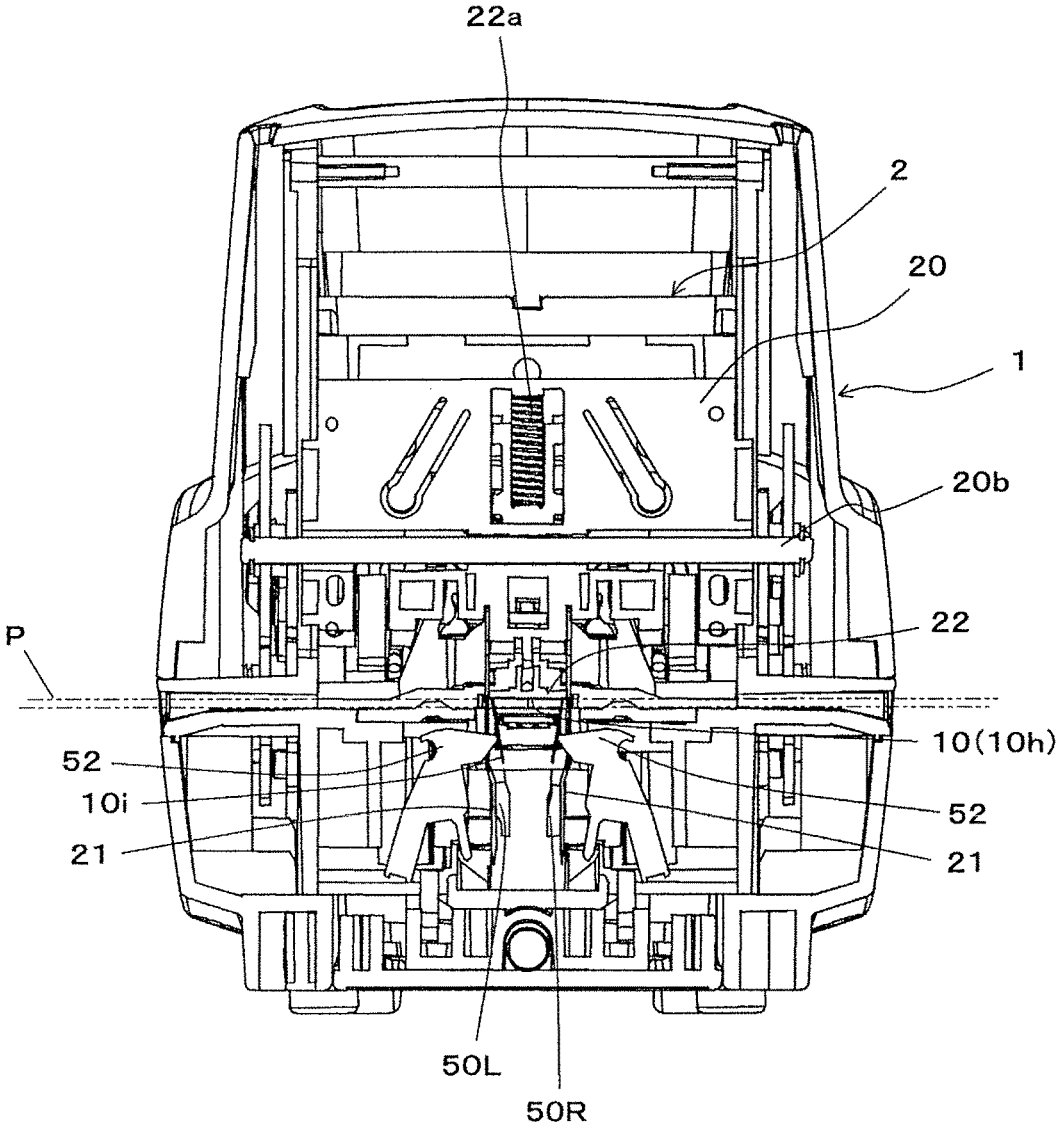
FIG. 73 is an operation chart illustrating an exemplary operation of the penetrating mechanism and the bending mechanism.
Figure 74:
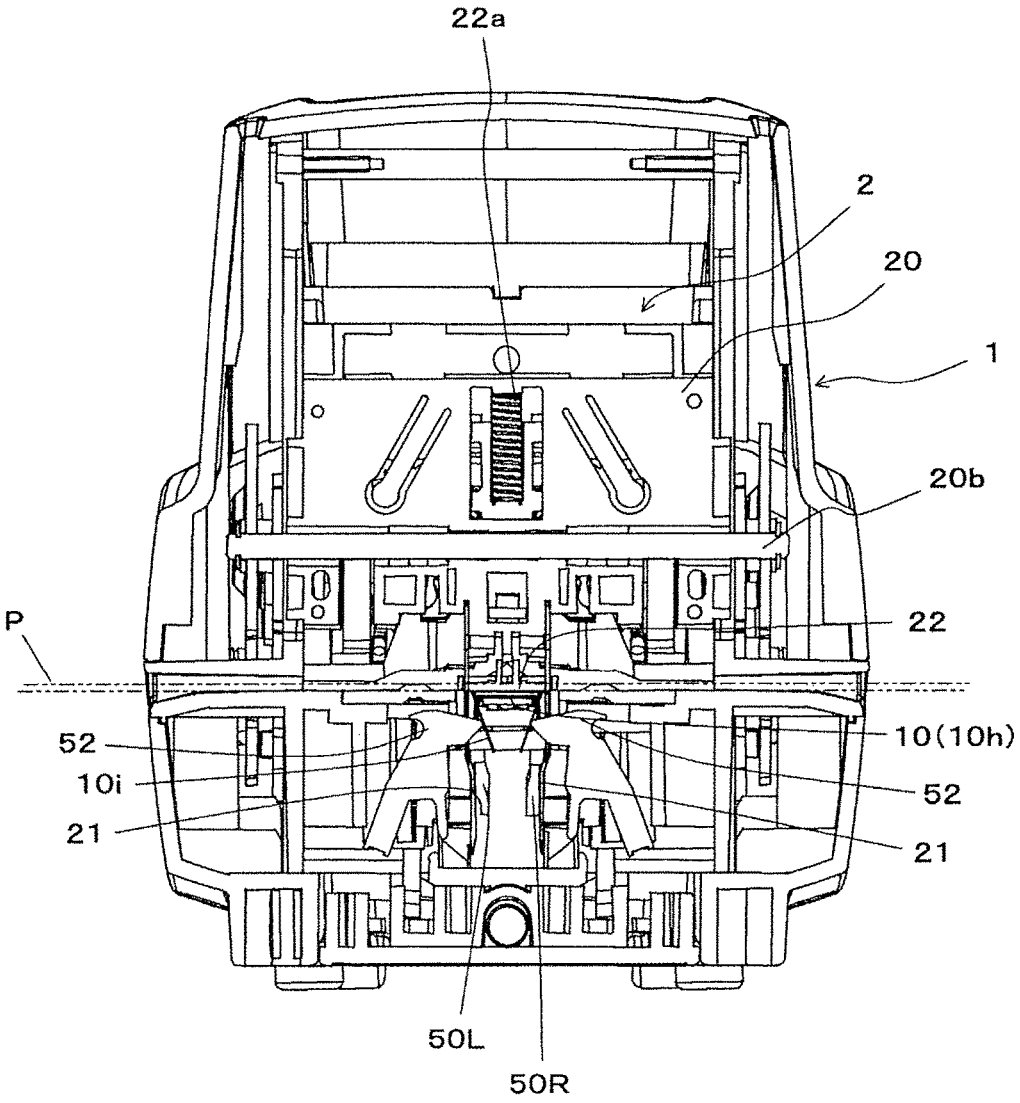
FIG. 74 is an operation chart illustrating an exemplary operation of the penetrating mechanism and the bending mechanism.
Figure 75:
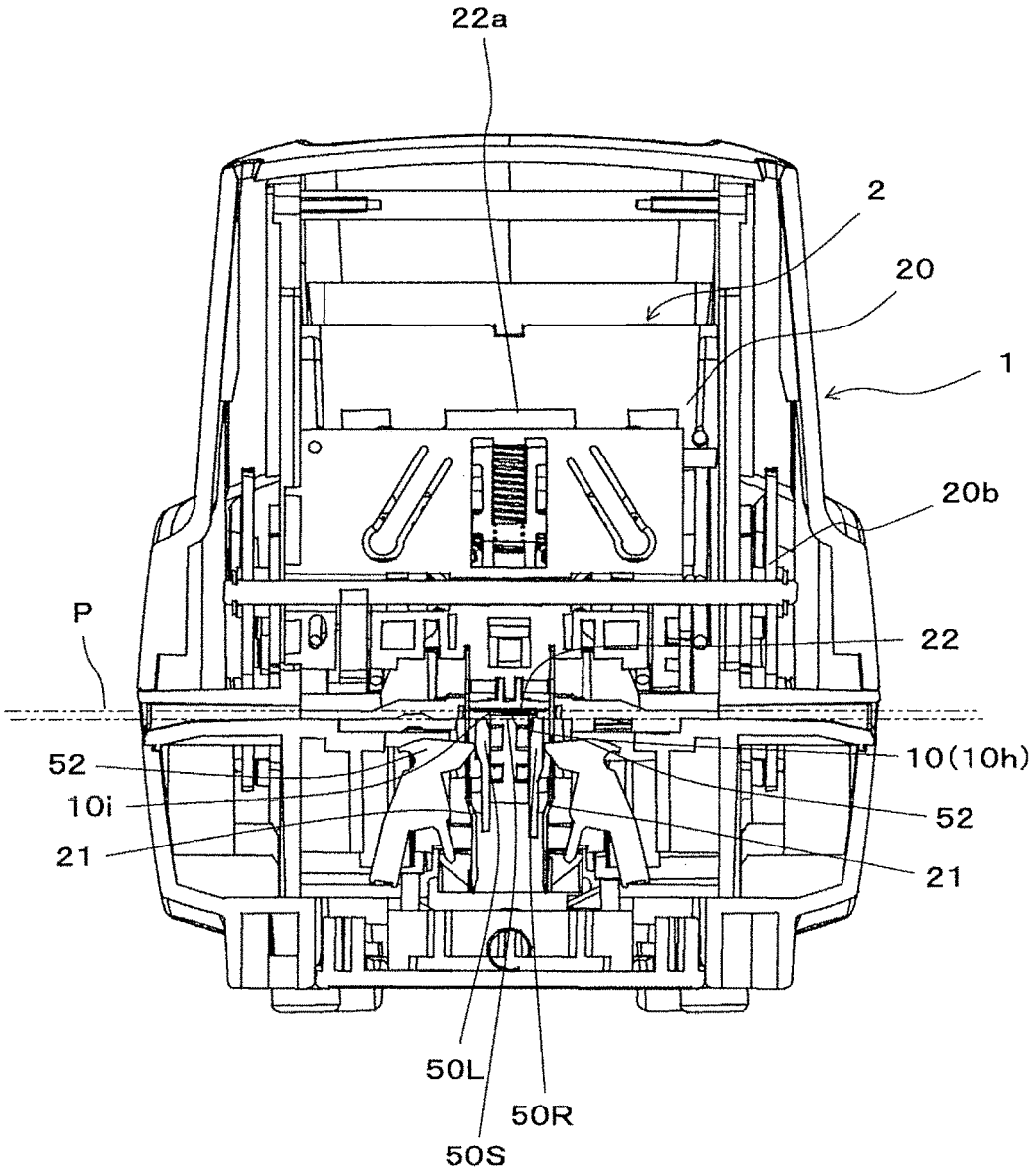
FIG. 75 is an operation chart illustrating an exemplary operation of the penetrating mechanism and the bending mechanism.
Figure 76:
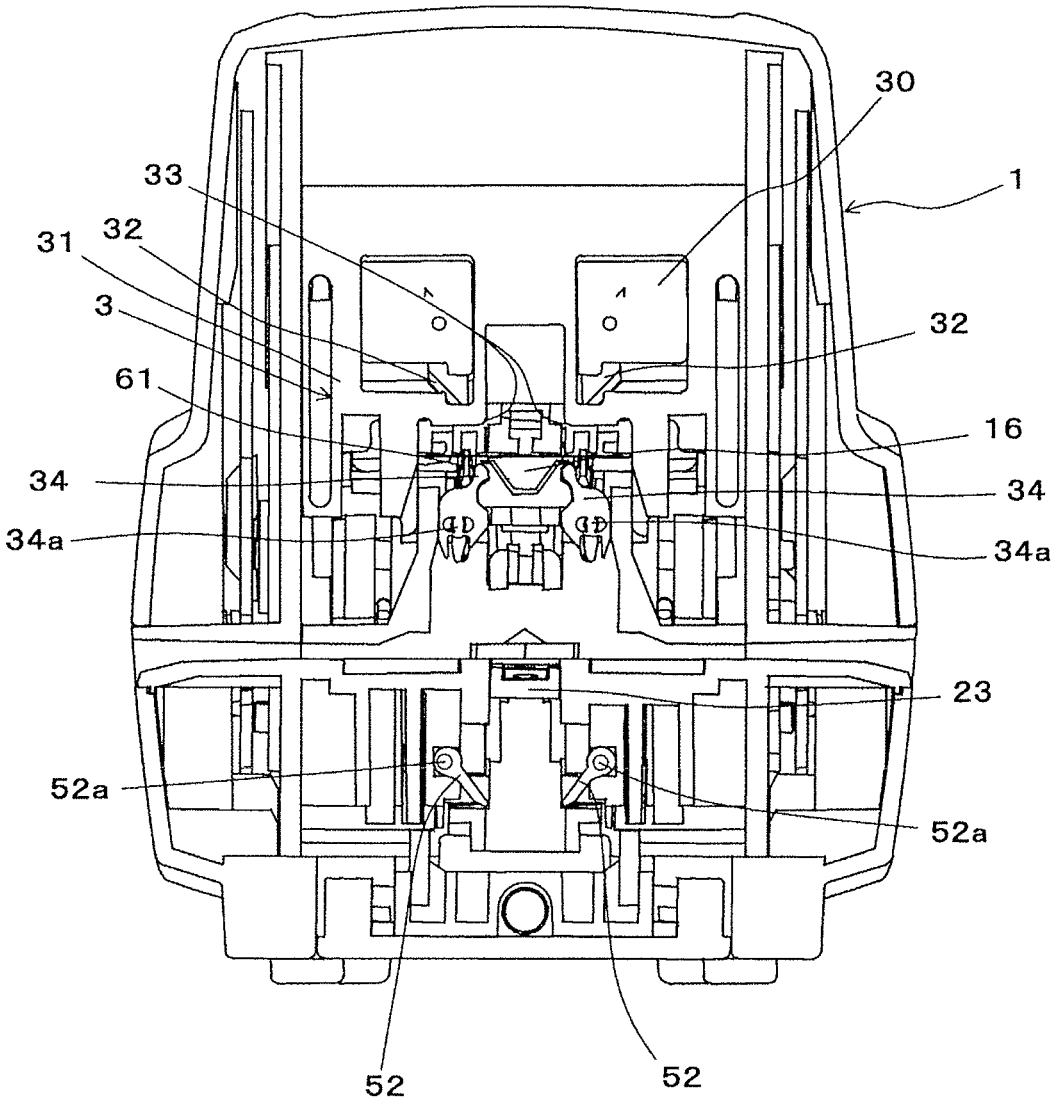
FIG. 76 is an operation chart illustrating an exemplary operation of the cutting/forming mechanism.

In the penetrating mechanism 2, when the operating handle 9 is pushed down at the position illustrated in FIGS. 50 and 61, the is lowered to the bending mechanism operating position M, as illustrated in FIGS. 26, 27, and 73, and the crown portion 10*h* of the staple 10 is stapled by the staple press-down portion 22 to press the paper sheets P. The cutting/forming mechanism 3 is lowered to a lower end position shown in FIG. 85, and thus is not operated.

Clinch Start

Figure 62:
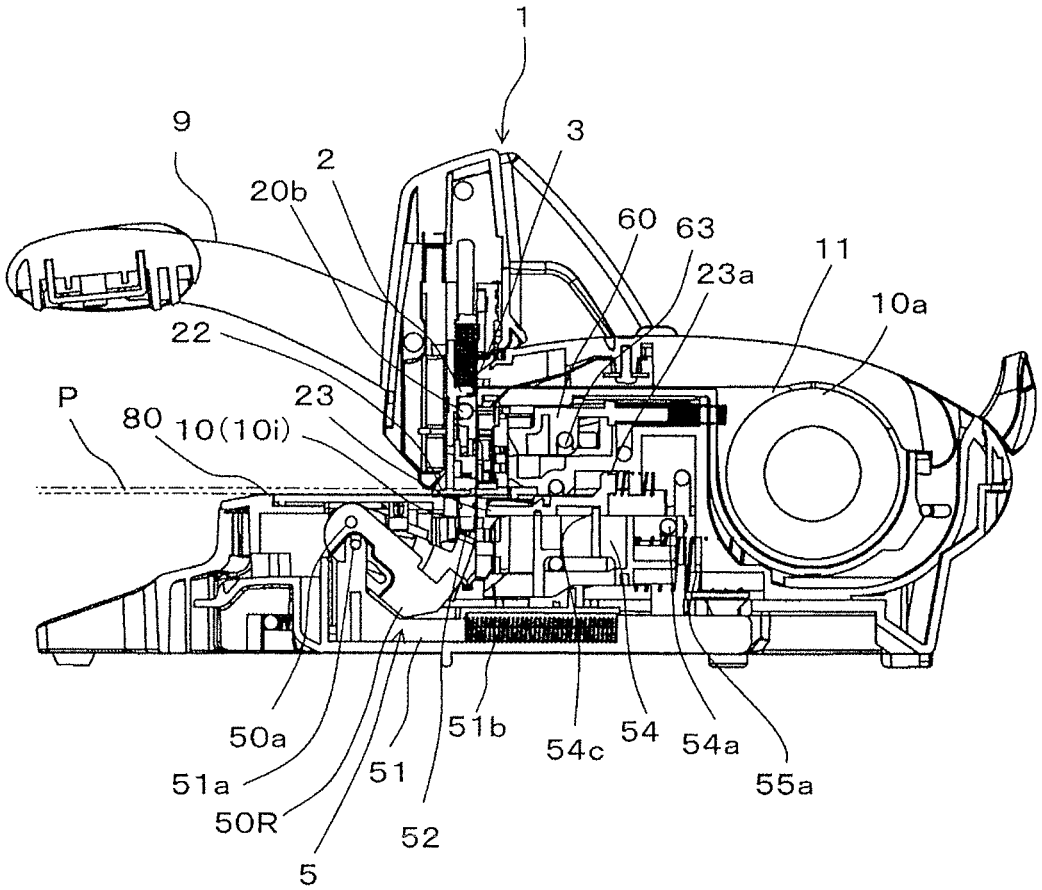
FIG. 62 is an operation chart illustrating an exemplary operation of the entire stapler.

If the operating handle 9 is pushed down at the position illustrated in FIG. 62, the retreating operation of the pusher 60 and the slide member 54 is continuously performed. In the bending mechanism 5, as illustrated in FIGS. 41 to 44, the push-up member 51 is moved rearward in a direction indicated by an arrow R1 by the pushing force of the operating handle 9. As the push-up member 51 is moved rearward, the first bending member 50R, the second bending member 50L, and the bonding member 50S start pushing up by the push-up member 51, and the clinch operation, i.e., bending the pair of the leg portions 10*i* of the staple 10 that have been inwardly bent by the ejecting member 52 is started. The cutting/forming mechanism 3 is lowered to a lower end position shown in FIG. 86, and thus is not operated.

When the operating handle 9 is rotated around the imaginary fulcrum defined by the track of the cam groove 91 guided by the shaft 90 and the track of the coupling shaft portion 20*b*, the push-up of the first bending member 50R, the second bending member 50L, and the bonding member 50S by the push-up member 51 starts, so that the operating load becomes light at the timing at which the leg portions 10*i* of the staple 10 are bent.

Clinch of Right Leg Portion

If the operating handle 9 is pushed down, the retreating operation of the pusher 60 and the slide member 54 is continuously performed. In the bending mechanism 5, as illustrated in FIGS. 41(*a*), 42(*a*), 54(*a*) and 45(*b*), the push-up member 51 is moved rearward in the direction indicated by the arrow R1 by the pushing force of the operating handle 9. The first bending member 50R is pushed up by the push-up member 51, so that the right leg 10*i* of the staple 10 is bent.

The leg portion 10*i* of the staple 10 is bent inwardly at a desired amount by the ejecting member 52. As the first bending member 50R is rotated upwardly, since the first bending member 50R is pushed up while being displaced in an external direction, the first bending member reliably enters the outside of the right leg portion 10*i* of the staple 10, so that the leg portion 10*i* is bent.

Clinch of Left Leg Portion

If the operating handle 9 is pushed down, the retreating operation of the pusher 60 and the slide member 54 is continuously performed. In the bending mechanism 5, as illustrated in FIGS. 42(*b*), 43(*b*), 45(*c*) and 45(*d*), the push-up member 51 is moved rearward in the direction indicated by the arrow R1 by the pushing force of the operating handle 9. The second bending member 50L is pushed up by the push-up member 51, so that the left leg 10*i* of the staple 10 is bent.

As the second bending member 50L is rotated upwardly, since the second bending member 50L is pushed up while being displaced in the external direction, the second bending member reliably enters the outside of the left leg portion 10*i* of the staple 10, so that the leg portion 10*i* is bent.

Clinch End

Figure 51:
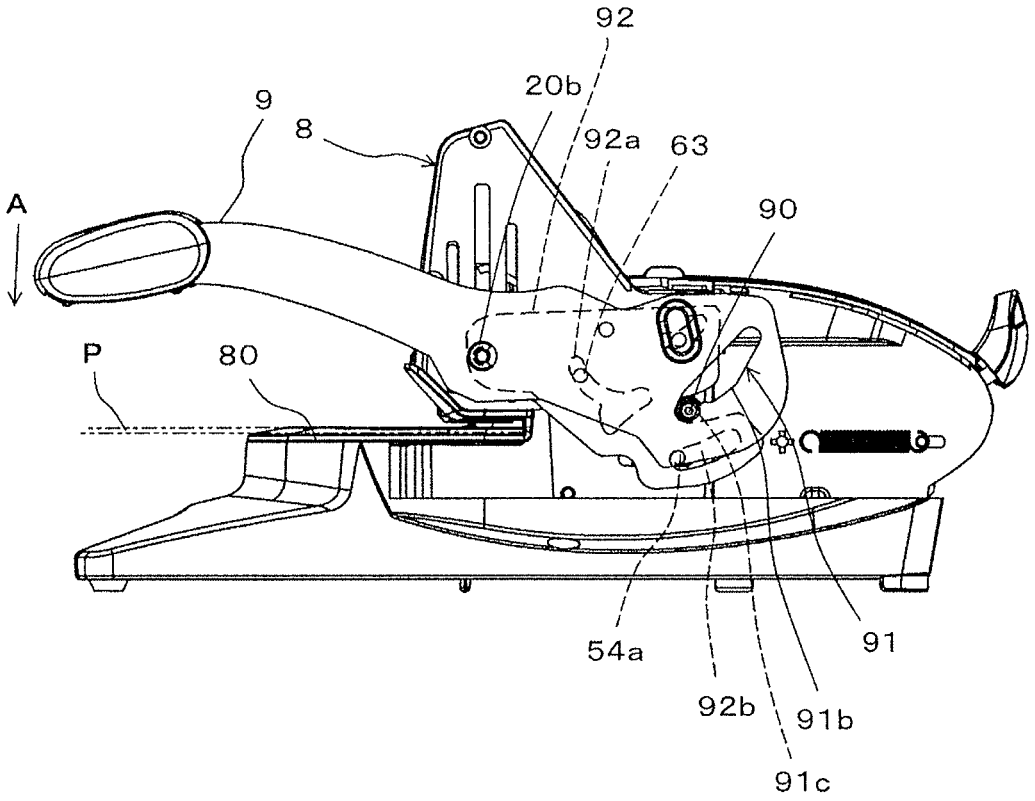
FIG. 51 is an operation chart illustrating an exemplary operation of the operating handle portion.
Figure 63:
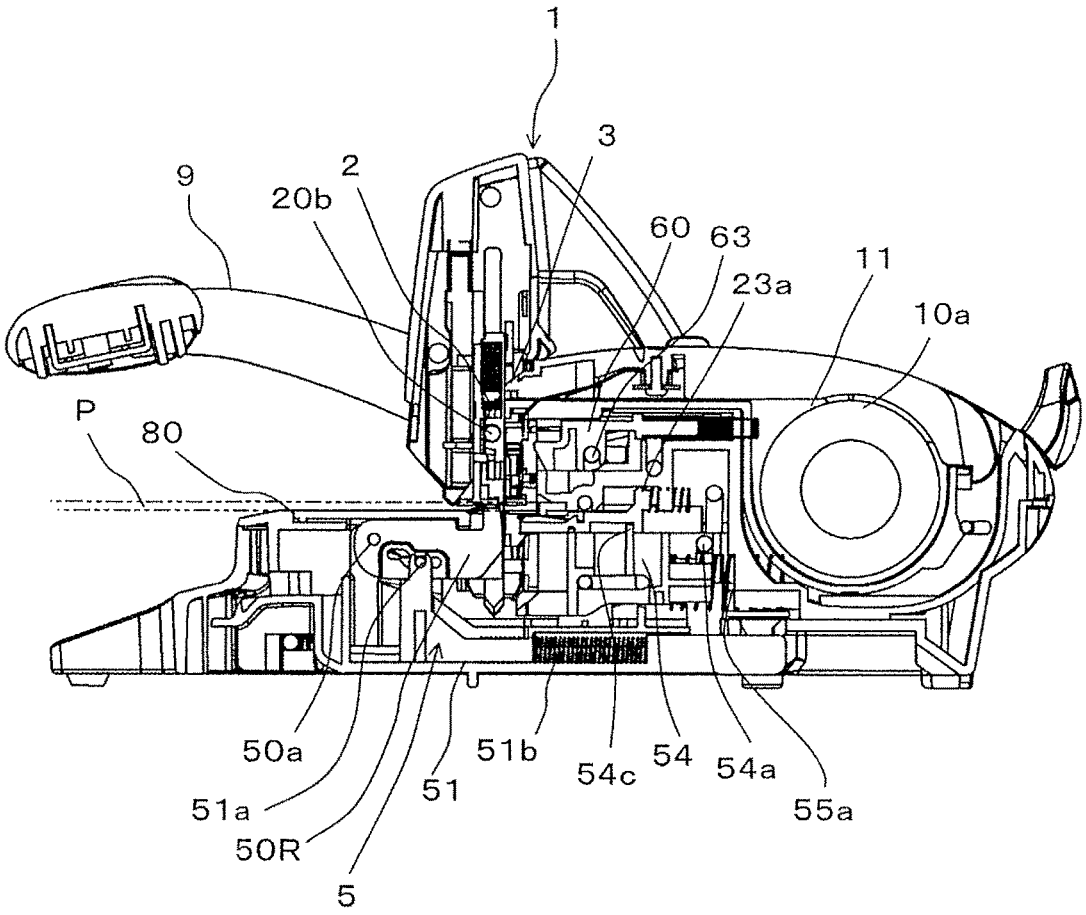
FIG. 63 is an operation chart illustrating an exemplary operation of the entire stapler.
Figure 64:
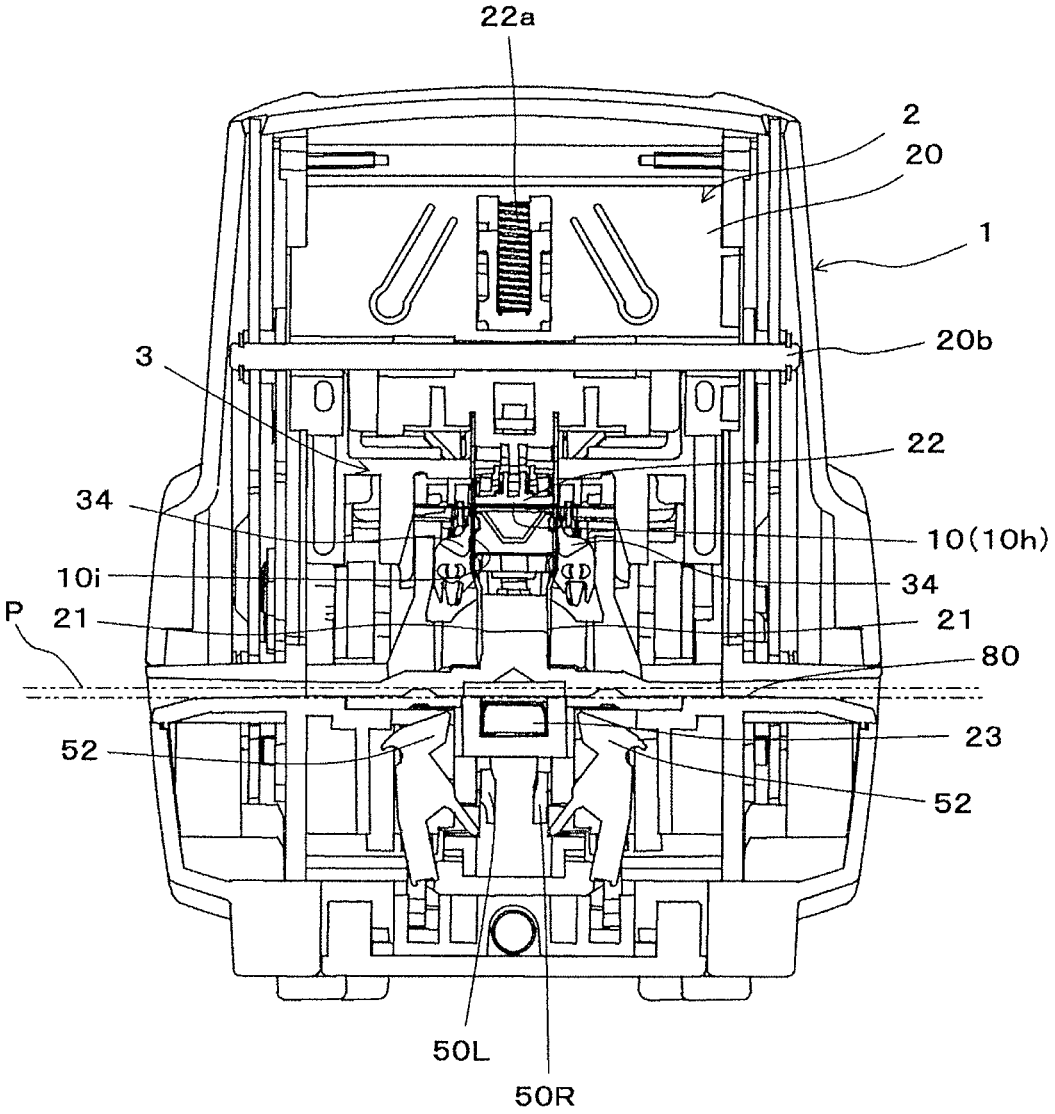
FIG. 64 is an operation chart illustrating an exemplary operation of the penetrating mechanism and a bending mechanism.

If the operating handle 9 is pushed down at the position illustrated in FIGS. 51 and 63, the retreating operation of the pusher 60 and the slide member 54 is continuously performed. In the bending mechanism 5, as illustrated in FIGS. 43©, 44©, 45(*e*) and 75, the push-up member 51 is moved rearward in the direction indicated by the arrow R1 by the pushing force of the operating handle 9. The bonding member 50S is pushed up by the push-up member 51, so that the one pair of overlapped leg portions 10*i* of the staple are pressed adjacent to the center portion thereof. Accordingly, as illustrated in FIG. 11, the one pair of leg portions 10*i* are bonded at the bonding portion 10*f*, and the clinch is terminated. The cutting/forming mechanism 3 is lowered to a lower end position shown in FIG. 87, and thus is not operated.

Return Operation Start

If the operating handle 9 is pushed up after the clinch is terminated, in association with the advance of the slide member 54, the cutting blade guide 23 is moved forward between the cutting blades while being urged by the spring 23*a*, and simultaneously, the ejecting member 52 is moved backward outwardly from the cutting blade 21. In addition, the pusher 60 is moved forward. As described above, the feed claw 61 is engaged with the staple-materials-connecting-body 10*a* to start conveyance of the staple-materials-connecting-body 10*a* forward, by the advancing movement of the pusher 60.

In the penetrating mechanism 2, the cutting blades 21 are moved up in a direction to be withdrawn from the paper sheets P. In the cutting/forming mechanism 3, in association with the operation of the penetrating mechanism 2, after the cutter plate 30 is moved to the retreat position lifted with respect to the forming plate 31, the forming plate 31 is moved up together with the cutter plate 30. If the forming plate 31 is moved up, the formed staple 10 starts withdrawing from the staple forming portion 33. In the bending mechanism 5, in association with the upward movement of the penetrating mechanism 2, the push up member 51 is moved forward, and the first bending member 50R, the second bending member 50L, and the bonding member 50S are moved down.

Further, as the cutter plate 30 and the forming plate 31 are moved up, the opening retaining members 34 abut against a close cam surface 84*b* formed on the body section 8 to start closing in the inward direction.

Return Operation

If the operating handle 9 is pushed up, the advancing operation of the pusher 60 is continuously performed. The advance of slide member 54 is stopped, since the pin 54*a* is separated from the elongated slot 92*b* of the link 92.

In the penetrating mechanism 2, the cutting blades 21 are moved up in the direction to be withdrawn from the paper sheets P. In the cutting/forming mechanism 3, in association with the operation of the penetrating mechanism 2, the cutter plate 30 and the forming plate 31 are moved up, and thus the opening retaining members 34 are closed, thereby preventing the leg portions 10*i* of the formed staple 10 from being opened by holding them from the outside.

Figure 52:
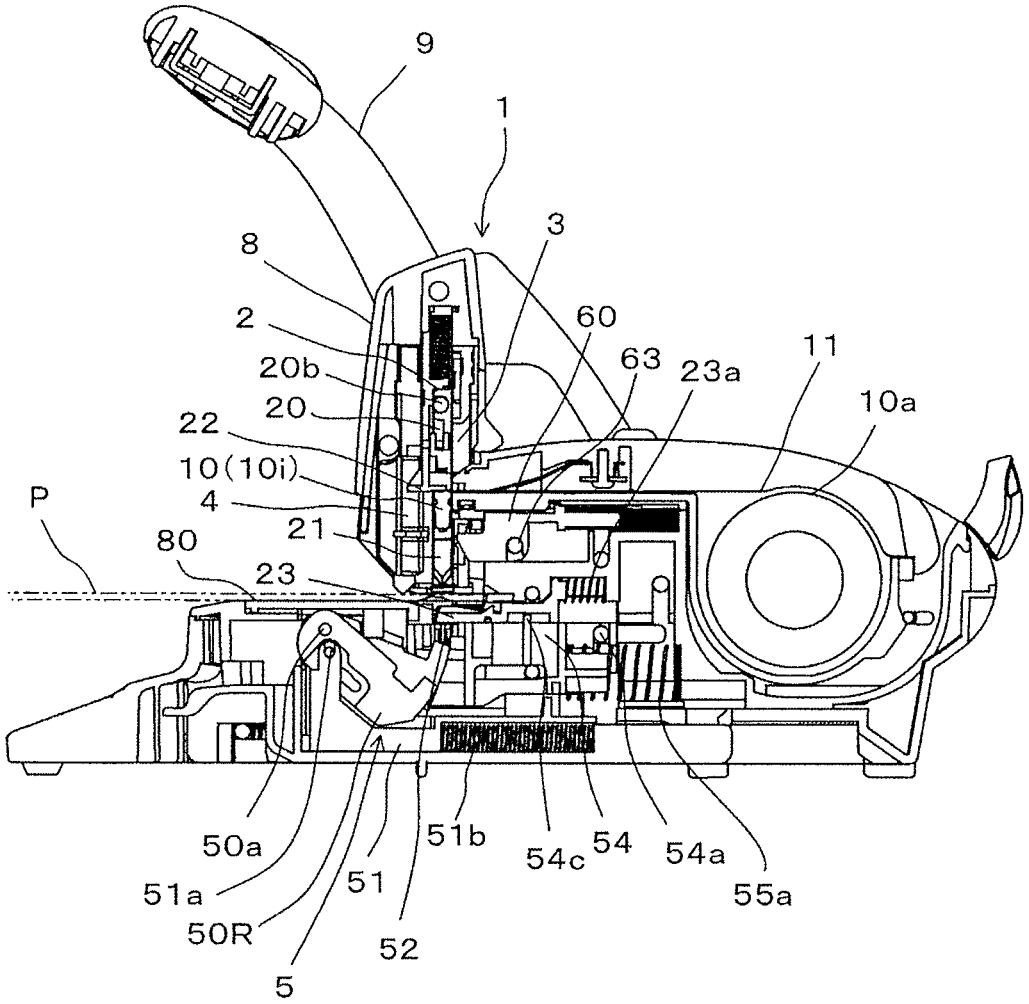
FIG. 52 is an operation chart illustrating an exemplary operation of the entire stapler.

If the operating handle 9 is returned to the standby position, as illustrated in FIG. 52, in the penetrating mechanism 2, the cutting blade 21 is withdrawn from the paper sheets P, so that the stapled paper sheets P can be ejected. Also, as the pusher 60 is moved forward, the next staple cut and formed by the cutting/forming mechanism 3 is conveyed to the penetrating mechanism 2, and is supported between the one pair of cutting blades 21. Simultaneously, the next staple-materials-connecting-body 10*a* is conveyed to the cutting/forming mechanism 3.

Other Exemplary Configuration of Stapler According to this Embodiment

Figure 88:
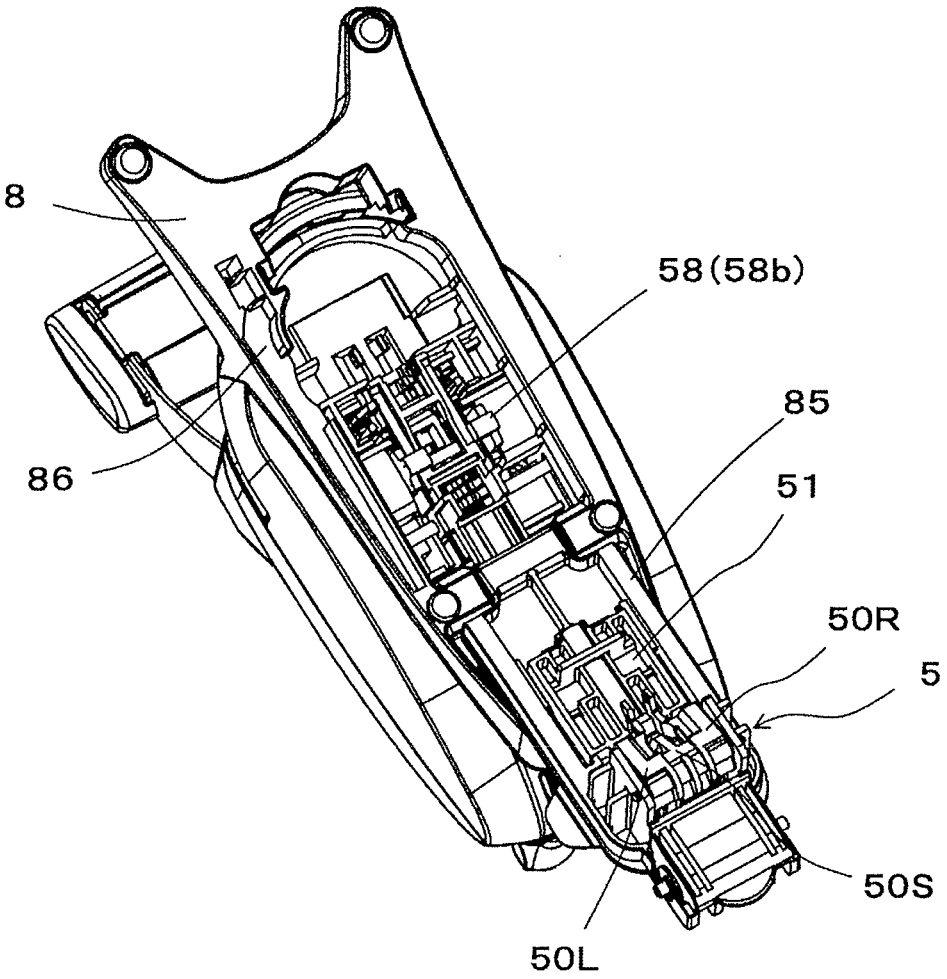
FIG. 88 is a perspective view illustrating an example of other configuration of the stapler according to the embodiment.
Figure 89:
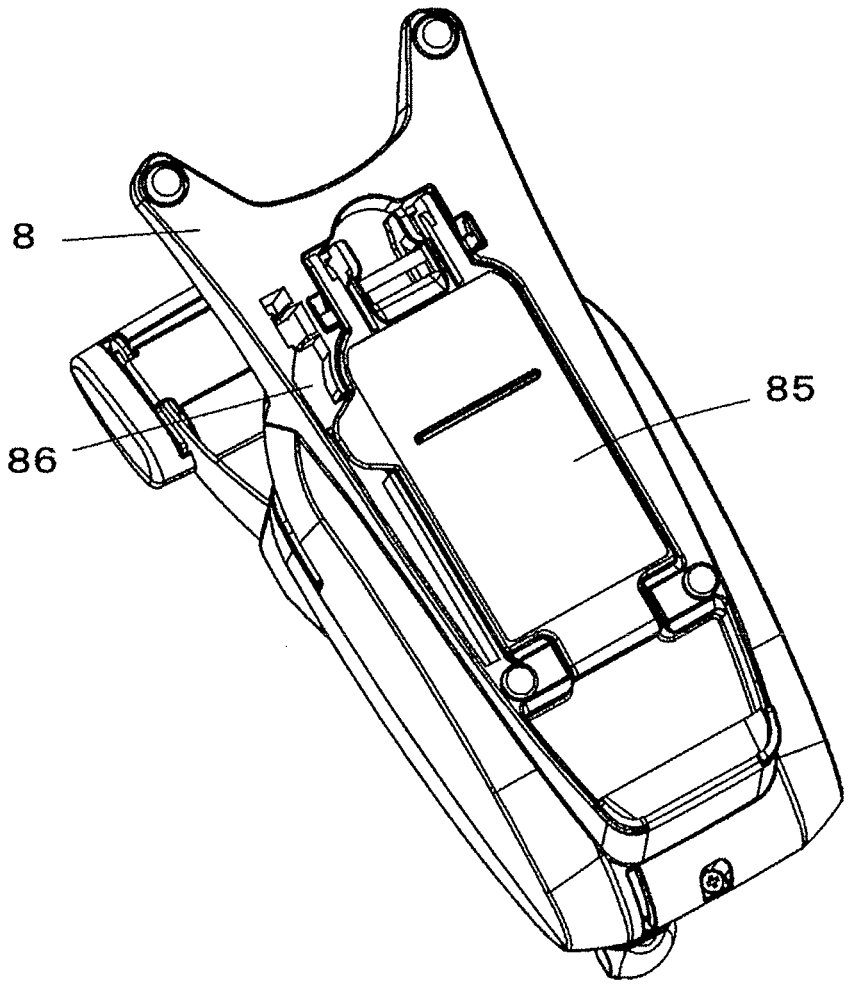
FIG. 89 is a perspective view illustrating an example of other configuration of the stapler according to the embodiment.

FIGS. 88 and 89 are perspective views illustrating other exemplary configuration of the stapler according to this embodiment. The stapler 1 includes a cover 85 at the bottom of the body section 8. The cover 85 is provided to open or close the body section 8 by rotation using a shaft (not illustrated) as a fulcrum.

The stapler 1 is configured so that the interior of the body section 8 is exposed by operating the cover 85. The stapler 1 of this embodiment is configured so that the force of the operating handle 9 is transmitted to the bending mechanism 5 using the driving force transmitting section of the cam mechanism, such as the clincher cam 57 and the clincher lever 58 to operate the first bending member 50R, the second bending member 50L, and the bonding member 50S.

For this reason, the first bending member 50R, the second bending member 50L, the bonding member 50S, and the push-up member 51 which are provided at the lower side of the paper placing base 80 can be engaged with or disengaged from the clincher cam 57 and the clincher lever 58.

In the example, the first bending member 50R, the second bending member 50L, the bonding member 50S, and the push-up member 51 in the bending mechanism 5 are attached to the cover 85. The clincher lever 58 for transmitting the driving force to the push-up member 51 and the clincher cam 57 illustrated in FIG. 49 are attached to the body section 8.

The push-up member 51 and the clincher lever 58 are detachably engaged with each other by opening/closing operation of the cover 85. If the cover 85 is closed, the engaging portion 58*b* of the clincher lever 58 is engaged with the push-up member 51, or if the cover 85 is opened, the engagement is released. Accordingly, the push-up member 51 and the clincher lever 58 are engaged with or disengaged from each other by opening/closing operation of the cover 85.

In the stapler 1, since the first bending member 50R, the second bending member 50L, the bonding member 50S, and the push-up member 51 are exposed by opening the cover 85, the jammed staple 10 can be easily removed. Further, since the staple 10 is provided with the bonding portion 10*f* for bonding the leg portions 10*i*, an adhesive component may be adhered to the member configuring the bending mechanism 5. However, since the first bending member 50R, the second bending member 50L, the bonding member 50S, and the bonding member 50S are exposed by opening the cover 85, the adhered adhesive component can be easily removed. Further, paper dust formed by penetration of the cutting blades 21 into the paper sheets P can be easily removed from the interior of the body section 8 by opening the cover 85.

In addition, the stapler 1 includes a container 86 at the bottom of the body section 8. The container 86 is formed by providing a space opened and closed by the cover 85, and houses a pair of tweezers, for example. Therefore, the jammed staple 10 can be removed by use of the tweezers.

The present invention may be applied to a stapler manipulated by a human power or an electric motor to staple a workpiece with the staple made of a non-metal material which is a soft material, such as paper.

The invention claimed is:

1. A stapler configured to bind a workpiece using a non-metal staple, the stapler comprising:

an operating member configured to be rotatable;

a penetrating part configured to cause a pair of leg portions of the non-metal staple to penetrate the workpiece by rotation of the operating member; and a bending part configured to bend the pair of leg portions of the non-metal staple, which has penetrated the workpiece by the penetrating part, wherein the penetrating part includes a pair of cutting blades an interval of which corresponds to a length of a crown portion of the non-metal staple, and each of which is configured to form a hole in the workpiece by an insertion/withdrawal operation with respect to the workpiece, wherein the operating member includes a cam groove which is guided along a shaft installed to a body section of the stapler, wherein cooperation of the shaft and the cam groove defines a fulcrum axis of rotation, and wherein the fulcrum axis of rotation of the operating member is shifted by a shape of the cam groove in accordance with the operation of the operating member so that a distance between: a force receiving portion of the operating member; and the fulcrum axis, and a distance between: a force acting portion which is a connecting portion between the operating member and the penetrating part; and the fulcrum axis are displaced, so as to change a reduction rate of a load applied to the operating member.

2. The stapler according to claim 1, wherein the cam groove is configured to allow movement of the fulcrum axis.

3. The stapler according to claim 2, wherein the shape of the cam groove is set so that an operating load of the operating member becomes lighter as the operating member is operated.

4. The stapler according to claim 3, wherein the cam groove is provided with a guide groove portion which is guided by the shaft at a timing at which the staple starts to penetrate into the workpiece by the operation of the penetrating part.

5. The stapler according to claim 3, wherein the cam groove is provided with a guide groove portion which is guided by the shaft at a timing at which the staple penetrates into the workpiece by the operation of the penetration part.

6. The stapler according to claim 3, wherein the cam groove is provided with a guide groove portion which is guided by the shaft at a timing at which the staple is bent by the operation of the bending part.

* * * * *